US005993230A

United States Patent [19]

Gauker et al.

[11] Patent Number: 5,993,230

[45] Date of Patent: Nov. 30, 1999

[54] ORIENTATIONLESS SQUIB CONNECTOR ASSEMBLY FOR AUTOMOTIVE AIR BAG ASSEMBLIES

[75] Inventors: Bradford K. Gauker, Clinton Township; David J. Rhein, Memphis, both of Mich.; Scott J. Lapraik, Spartanburg, S.C.

[73] Assignee: Thomas & Betts International, Inc., Memphis, Tenn.

[21] Appl. No.: 08/908,066

[22] Filed: Aug. 11, 1997

Related U.S. Application Data

[60] Provisional application No. 60/024,017, Aug. 12, 1996, provisional application No. 60/029,863, Nov. 1, 1996, and provisional application No. 60/035,680, Jan. 24, 1997.

[51] Int. Cl.[6] ..... H01R 13/703

[52] U.S. Cl. ..... 439/188; 439/352; 439/675; 200/51.1

[58] Field of Search ..... 439/188, 352, 439/358, 675; 200/51.1

[56] References Cited

U.S. PATENT DOCUMENTS

| | | | |
|---|---|---|---|
| 3,694,793 | 9/1972 | Concelman | 439/358 |
| 3,869,191 | 3/1975 | Tolnar, Jr. et al. | 339/111 |
| 3,971,320 | 7/1976 | Lee | 102/28 |
| 4,152,041 | 5/1979 | Hollyday et al. | 339/147 |
| 4,261,263 | 4/1981 | Coultas et al. | 102/28 |
| 4,306,499 | 12/1981 | Holmes | 102/202.4 |
| 4,376,563 | 3/1983 | Margrave et al. | 439/358 |
| 4,380,346 | 4/1983 | Davis et al. | 280/736 |
| 4,696,705 | 9/1987 | Hamilton | 149/21 |
| 4,698,107 | 10/1987 | Goetz et al. | 149/7 |
| 4,806,180 | 2/1989 | Goetz et al. | 149/5 |
| 4,850,888 | 7/1989 | Denlinger et al. | 439/188 |
| 4,858,951 | 8/1989 | Lenzen | 280/741 |
| 5,027,707 | 7/1991 | Mei | 102/202.8 |
| 5,076,607 | 12/1991 | Woods et al. | 280/737 |
| 5,099,762 | 3/1992 | Drapala | 102/202.1 |
| 5,129,680 | 7/1992 | Mori | 280/806 |
| 5,131,680 | 7/1992 | Coultas et al. | 280/737 |
| 5,140,906 | 8/1992 | Little, II | 102/202.14 |
| 5,151,042 | 9/1992 | Okada | 439/169 |
| 5,184,846 | 2/1993 | Goetz | 280/736 |
| 5,200,574 | 4/1993 | Cunningham et al. | 102/530 |
| 5,203,719 | 4/1993 | Kozono | 439/489 |
| 5,213,362 | 5/1993 | Coultas | 280/736 |
| 5,226,667 | 7/1993 | Coultas | 280/734 |
| 5,242,194 | 9/1993 | Popek | 280/737 |
| 5,257,819 | 11/1993 | Frantom et al. | 280/737 |
| 5,259,643 | 11/1993 | Kraft et al. | 280/740 |
| 5,273,312 | 12/1993 | Coultas et al. | 280/737 |
| 5,297,976 | 3/1994 | VanDerStuyf et al. | 439/271 |
| 5,334,025 | 8/1994 | Föhl | 439/188 |

(List continued on next page.)

*Primary Examiner*—Neil Abrams
*Attorney, Agent, or Firm*—Weingarten, Schurgin, Gagnebin & Hayes LLP

[57] ABSTRACT

An orientationless squib connector assembly (10) for automotive air bag assemblies is disclosed. A single initiator pin (24, 326) is provided axially aligned within a squib socket (12, 324). An annular ground plate (28, 328) surrounds and shunts to ground the initiator pin near the base of the socket. An associated connector (16, 202, 312, 410) includes a first, axially located terminal (64, 280, 314, 416) for electrical contact with the initiator pin and a second terminal (66, 282, 316, 418) comprising a depending leg or beam (110, 320) radially aligned with the first terminal for electrically contacting the ground plate at any rotational orientation of the connector with respect to the socket and for moving a part of the ground plate (28) out of electrical engagement with pin (24). Eliminating a required rotational orientation of the connector simplifies its manufacture and assembly and its incorporation into a vehicle. Preferably, the entering wires, surrounded by a ferrite block (84), are also axially aligned with the first and second terminals. CPAs (72, 322, 420) may be used to prevent unlatching of the connector assembly. Closure of the CPA may be prevented by a blocking feature on the associated connector that is automatically displaced when the connector is properly engaged in the socket.

50 Claims, 41 Drawing Sheets

U.S. PATENT DOCUMENTS

| | | | |
|---|---|---|---|
| 5,345,875 | 9/1994 | Anderson | 102/530 |
| 5,351,988 | 10/1994 | Bishop et al. | 280/737 |
| 5,351,989 | 10/1994 | Popek et al. | 280/737 |
| 5,383,388 | 1/1995 | Ono | 89/1.14 |
| 5,389,751 | 2/1995 | Breed | 200/61.45 |
| 5,401,180 | 3/1995 | Muzslay | 439/188 |
| 5,406,889 | 4/1995 | Letendre et al. | 102/201 |
| 5,417,312 | 5/1995 | Tsuchitani et al. | 188/181 A |
| 5,427,030 | 6/1995 | Kidd et al. | 102/202 |
| 5,458,371 | 10/1995 | Fulmer et al. | 280/741 |
| 5,466,420 | 11/1995 | Parker et al. | 422/164 |
| 5,468,017 | 11/1995 | Kirsch et al. | 280/741 |
| 5,481,139 | 1/1996 | Lucas | 307/9.1 |
| 5,482,316 | 1/1996 | Lang et al. | 280/741 |
| 5,483,896 | 1/1996 | Hock et al. | 102/530 |
| 5,494,450 | 2/1996 | Kirsch et al. | 439/188 |
| 5,498,164 | 3/1996 | Ward et al. | 439/15 |
| 5,503,806 | 4/1996 | Fulmer et al. | 422/164 |
| 5,528,161 | 6/1996 | Liken et al. | 324/760 |
| 5,529,334 | 6/1996 | Meduvsky et al. | 280/738 |
| 5,609,498 | 3/1997 | Muzslay | 439/352 |
| 5,613,865 | 3/1997 | Dullin et al. | 439/188 |
| 5,653,606 | 8/1997 | Chrysostomou | 439/352 |

ORIENTATIONLESS SQUIB CONNECTOR ASSEMBLY FOR AUTOMOTIVE AIR BAG ASSEMBLIES

CROSS-REFERENCE TO RELATED APPLICATIONS

This application claims priority under 35 U.S.C. § 119(e) of U.S. Provisional Application No. 60/024,017, filed on Aug. 12, 1996, U.S. Provisional Application No. 60/029,863, filed on Nov. 1, 1996, and U.S. Provisional Application No. 60/035,680, filed on Jan. 24, 1997, the disclosures of all of which are incorporated by reference herein.

STATEMENT REGARDING FEDERALLY SPONSORED RESEARCH OR DEVELOPMENT

None.

BACKGROUND OF THE INVENTION

Supplemental inflatable restraints or air bag assemblies are becoming increasingly common as a safety device in vehicles throughout the world. The assembly comprises an inflatable canister located in the steering column, the passenger-side dashboard, the side door panel, or seat. Upon a sufficiently great deceleration, the canister is inflated by an explosive device known as a squib which contains a gun powder-based material. The squib is fired electronically upon a signal sent via wires from a deceleration or other sensor in the vehicle. The wires are attached to the squib via a squib connector which plugs into the squib socket.

A common form of squib assembly has two pins which extend within the socket, and an associated connector has two terminals which are in electrical contact with the pins when the connector is plugged into the socket. When the connector is removed from the socket, typically for servicing the inflation canister, a shorting clip or shunt is biassed into electrical contact with the two pins to form an electrical connection therebetween to reduce the risk of misfiring, for example, by static electricity. The connector urges the shorting clip out of electrical contact with the pins when the connector is plugged into the socket.

During manufacture of a two-pin squib assembly, two rotational orientation concerns must be addressed. The pins must located at the correct clocking position relative to the connector and the squib. Also, the pins must be parallel to each other and perpendicular to the socket floor, or the entire assembly must be discarded. Also, during assembly of the vehicle, the vehicle manufacturer must be concerned about routing of the wires. A keying feature must be provided to ensure proper orientation of the assembly.

Other prior art air bag connectors are shown in U.S. Pat. Nos. 5,334,025 and 5,401,180.

SUMMARY OF THE INVENTION

The present invention provides a single-pin squib connector assembly which has no required rotational orientation. In the preferred embodiment, the connector assembly is axial, wherein the pair of wires entering the connector assembly are parallel to the lengthwise orientation of a single pin in the squib socket. This type of connector is suitable for applications in which space is limited, such as driver, passenger, side door, or knee bolster air bags or seat belt pretensioners.

More particularly, the connector assembly includes a connector and a cylindrical socket for receiving the connector. In the socket, a first terminal is provided by a single axial pin extending along the central axis of the cylindrical socket and anchored to the initiator cup of the squib. A second terminal comprising a flat, radially extending ground plate annularly surrounds the pin and is fixed to the initiator cup within the socket. The ground plate includes a contact or shorting member in the form of an inner ring which surrounds the pin and is biassed upwardly to contact the pin along an inner edge of the ring. In this manner, a shunt between the pin and the ground plate is provided when the connector is removed from the socket.

The connector includes a first or female terminal comprising a pair of opposed beams which contact the pin in the socket when the connector is inserted into the socket. A hood surrounds the beams to protect them from damage by the initiator pin during insertion of the connector into the socket. The connector also includes a second terminal in the form of a depending beam radially offset from the pair of beams contacting the pin. A contacting ring is formed at the end of the depending beam to surround the female terminal and the central pin in the socket. During insertion of the connector into the socket, the ring contacts the contact beam of the shorting member, moving it downwardly out of contact with the central pin. The contacting ring is able to contact the ground plate at any rotational orientation with respect to the socket. The terminals include wire crimp sections which grip associated wires entering the connector either along the axis of the single pin in the squib socket or perpendicular to the pin axis.

The connector includes a connector body or housing, a cover, and a connector position assurance member or CPA. The wire crimp portions of the first and second terminals and the associated entering wires are sandwiched between the housing and the cover, which are held together by a suitable latching mechanism, such as latching tabs, which are preferably internal to prevent tampering or easy disassembly.

The CPA includes a shell which is slidable between an open position and a closed position on the cover. The connector body includes a latching arm which fits over and latches to an external groove in the socket. When the connector is engaged in the socket, the CPA is slidable to the closed position where it latches onto a retention key on the housing and, in this position, ensures correct positioning of the connector in the socket and blocks removal of the latching arm from the groove, so that the connector assembly cannot be removed from the socket. To remove the connector assembly, the CPA is pulled upwardly to disengage from the housing retention key and unblock the latching arm.

DESCRIPTION OF THE DRAWINGS

The invention will be more fully understood from the following detailed description taken in conjunction with the accompanying drawings in which.

DETAILED DESCRIPTION OF THE INVENTION

Figure 1:
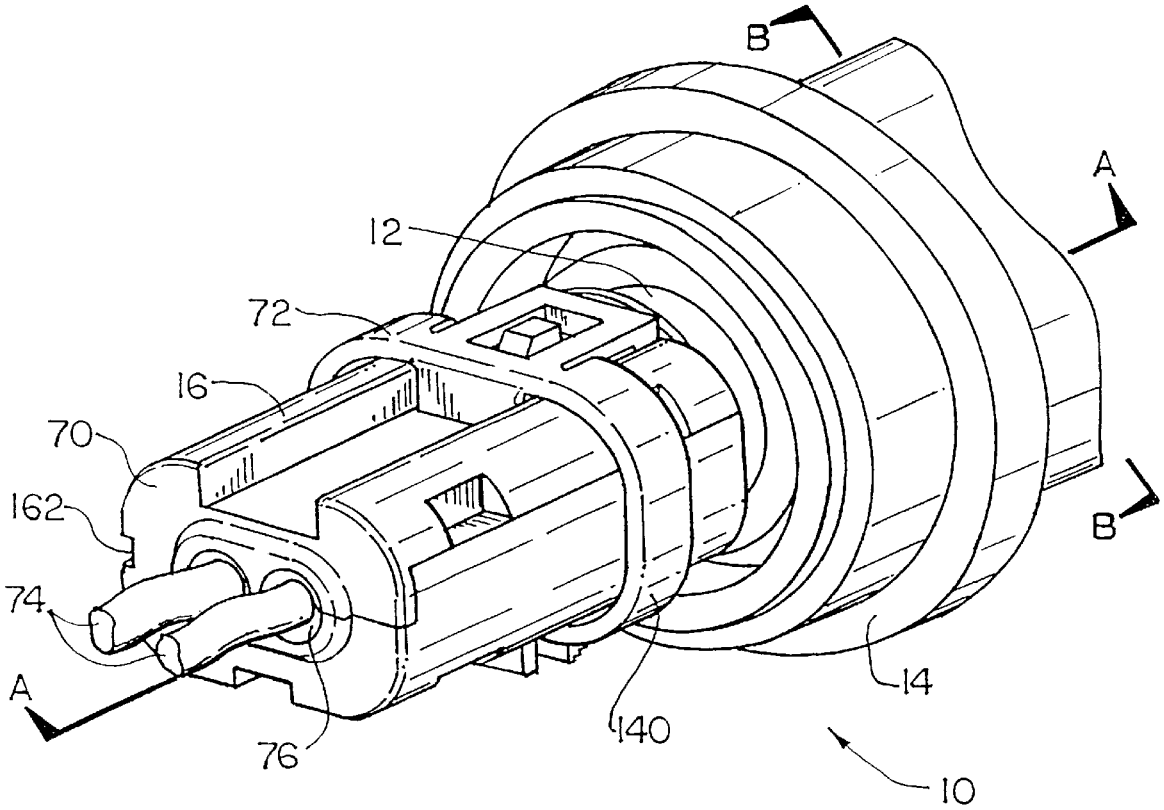
FIG. 1 is an isometric view of a squib connector assembly according to the present invention.
Figure 2:
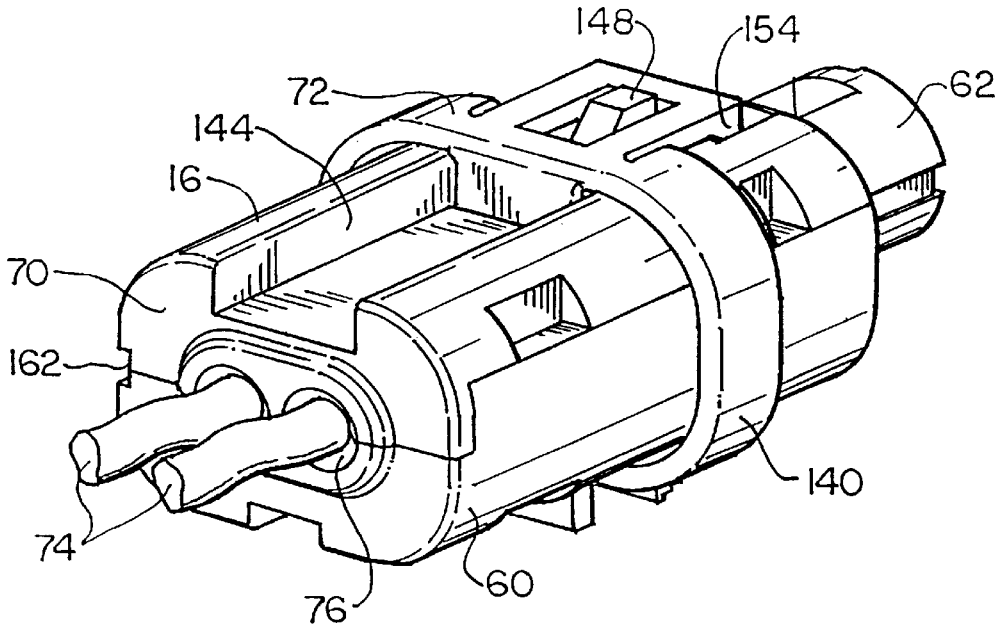
FIG. 2 is an isometric view of the connector of FIG. 1.

Referring to FIG. 1, the squib connector assembly 10 of the present invention comprises a receptacle or socket 12 of a squib assembly 14 and a connector 16 sized to fit within the socket. As shown more particularly in FIGS. 3 and 15–18, the socket includes a cylindrical housing 18 and socket liner 20 which are roll crimped over an initiator or squib ignitor cup 22. A first terminal in the form of a single initiator or ignitor pin 24 is anchored to the initiator cup to extend along the central axis 26 of the socket 12.

Figure 54:
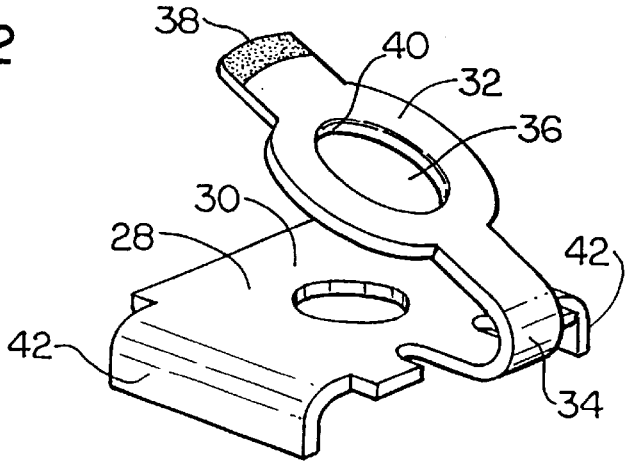
FIG. 54 is an isometric view of a ground terminal in the squib assembly of FIGS. 1 and 19.

A second terminal or ground plate 28 is also anchored to the initiator cup 22. The ground plate, shown more particularly in FIG. 54, includes a base plate 30 and an upwardly biassed contact or shorting member 32 formed as a beam connected to the base plate by a flexible hinge element 34. The contact beam 32 includes a central elliptical opening 36 formed therein through which the initiator pin 24 extends. The contact beam also includes a tip 38 for contact with an associated ground terminal in the connector, discussed further below. The ground plate may be stamped and formed from a single piece of a resilient electrically conductive material.

The contact beam 32 provides an electrical shunt to the initiator pin 24 when the connector 16 is not present in the socket: 12. The inner edge 40 of the opening 36 in the contact beam is located to contact the initiator pin 24 when no force is applied to deflect the contact beam downwardly against the upward bias. The inner edge 40 is preferably plated with an electrically conductive material to ensure a good electrical contact between the contact beam and the pin. In this manner, the terminals of the squib are shorted when the connector is removed, minimizing the possibility of accidental firing of the air bag due, for example, to static electricity. When the connector, discussed further below, is inserted into the socket, it contacts the contact beam and pushes the contact beam downwardly against the upward bias and out of electrical contact with the initiator pin.

The ground plate 30 includes a number of downwardly depending anchor legs 42 which are welded to the initiator cup 22 by a suitable welding process. Two anchor legs are suitable, although any desired number may be used. The ground plate can be attached to the initiator cup in other suitable ways. Preferably if a welding process is used to attach the ground plate to the initiator cup, the ground plate is formed of the same material as the initiator cup. A conductive material may be plated onto the upwardly facing surface of the tip 38 of the ground plate where a terminal of the connector 16 contacts the ground plate, as discussed further below. The initiator cup and electrical circuitry contained therein are in all other respects conventional and known to those of ordinary skill in the art.

The socket liner 20 in the socket housing 18 provides a dielectric insulation between the connector 16 and the socket housing 18 and between the initiator cup 22 and the socket housing 18. The dielectric insulation ensures that the positive and negative/ground electrical elements are contained within the signal circuit and do not short out to chassis ground. The liner is preferably formed of an injection molded plastic.

Figure 19:
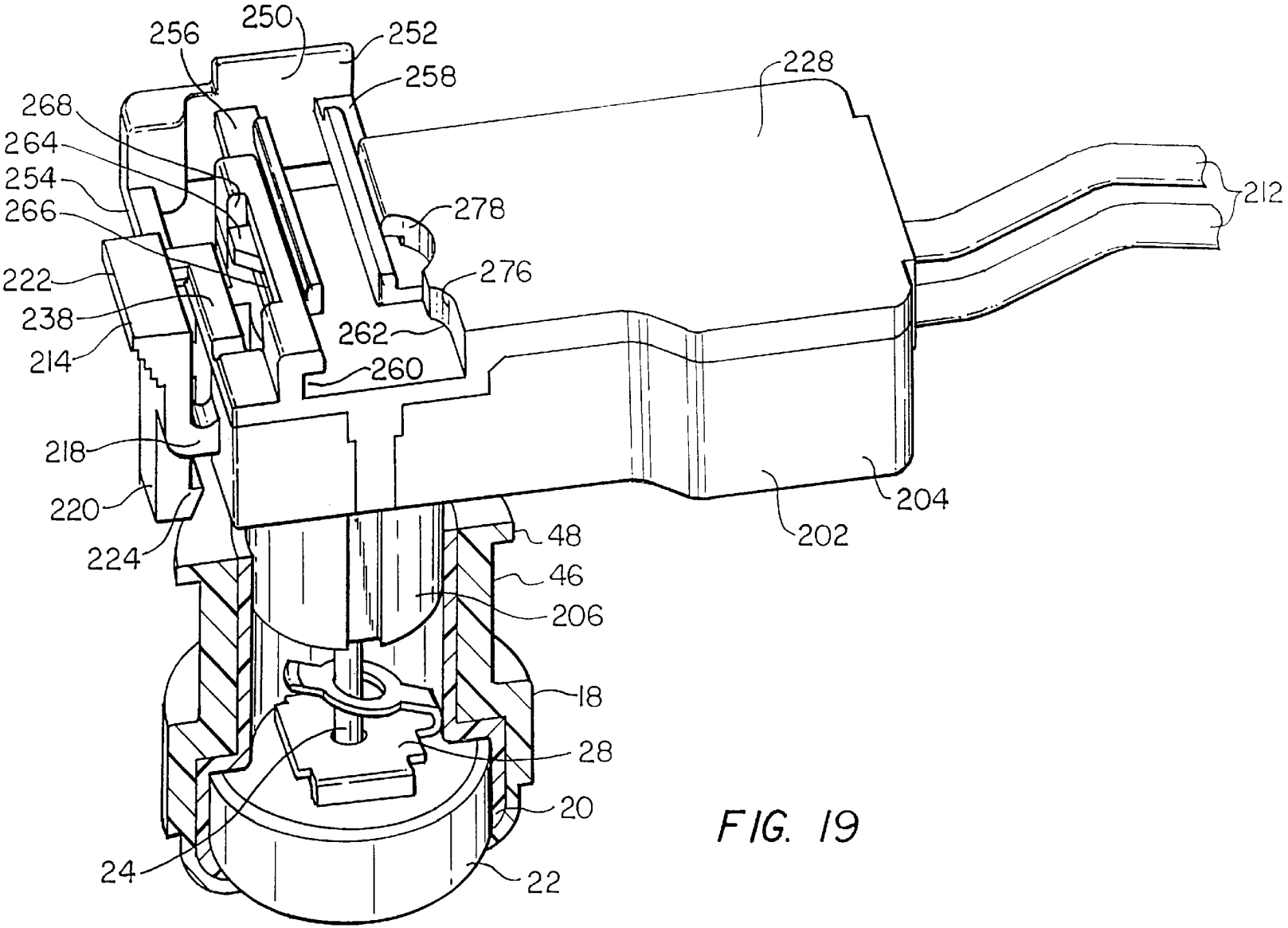
FIG. 19 is a partially cut away isometric view of a further embodiment of a squib connector assembly according to the present invention.
Figure 55:
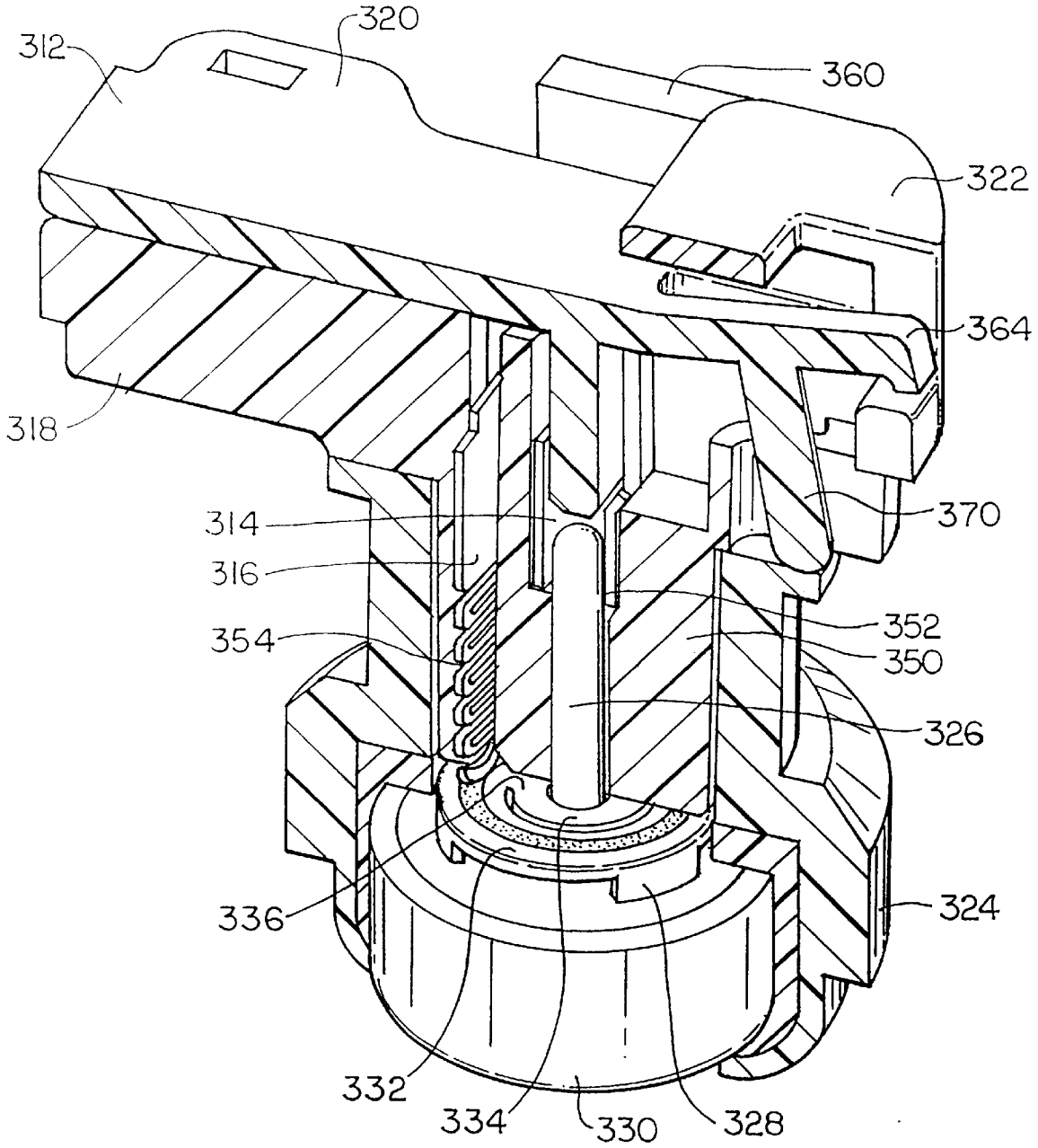
FIG. 55 is an isometric partially cut away view of a further embodiment of a squib connector assembly according to the present invention.
Figure 56:
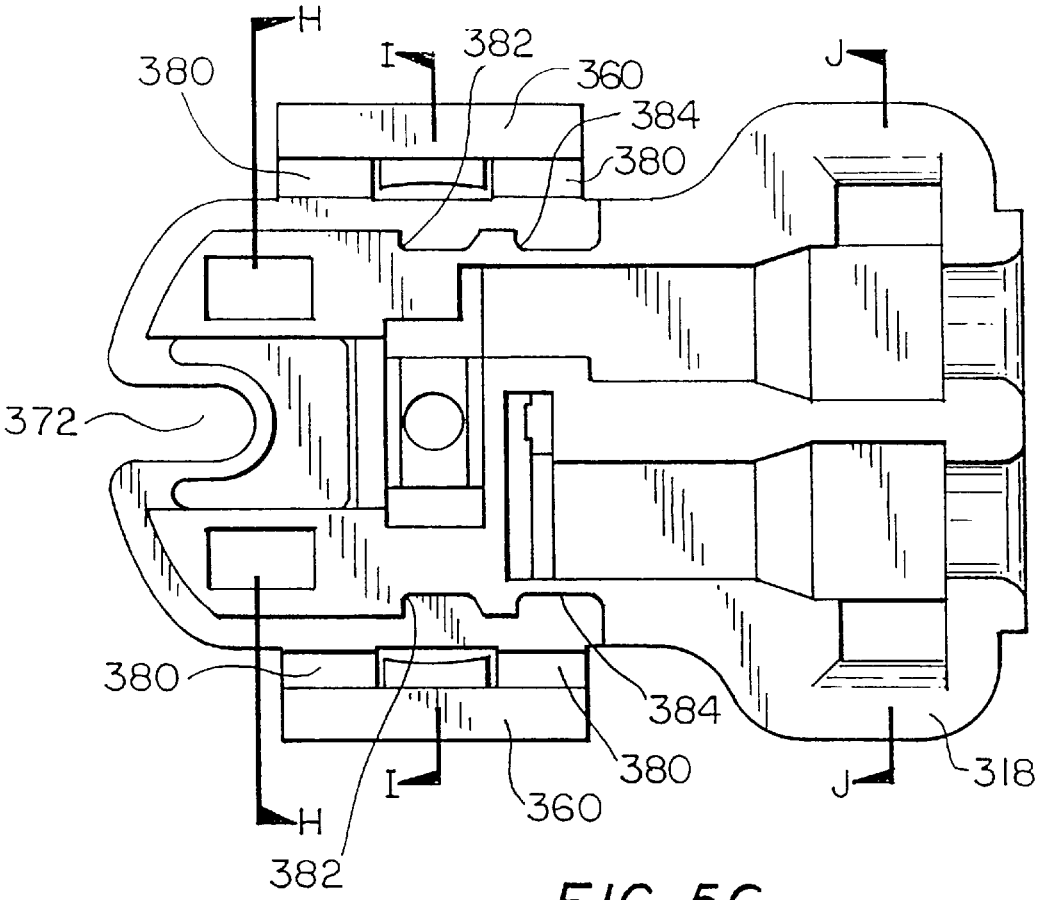
FIG. 56 is a top plan view of the connector housing of FIG. 55.
Figure 57:
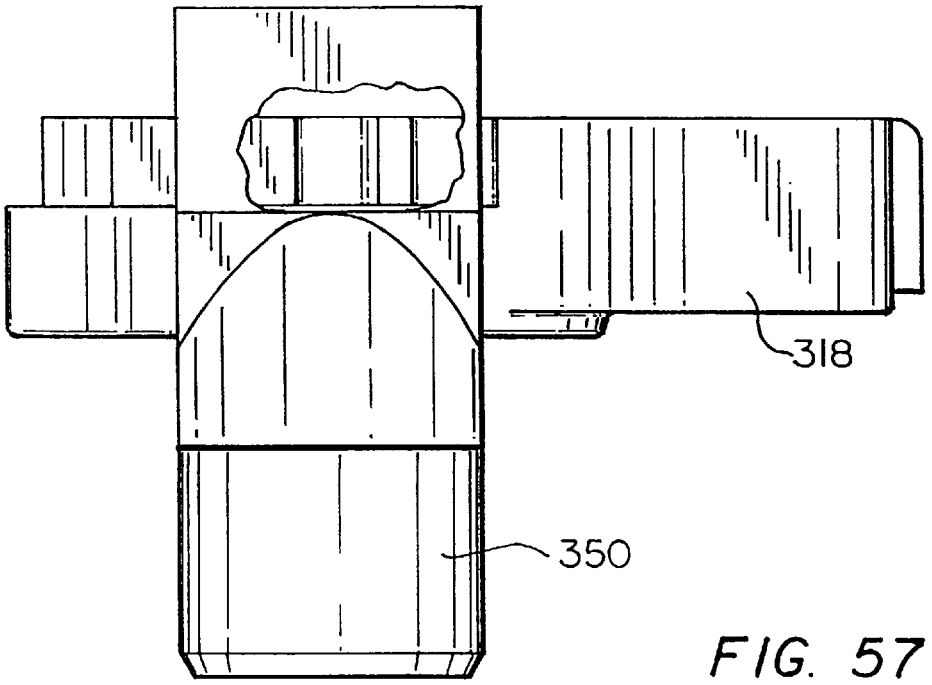
FIG. 57 is a side view of the connector housing of FIG. 56.
Figure 58:
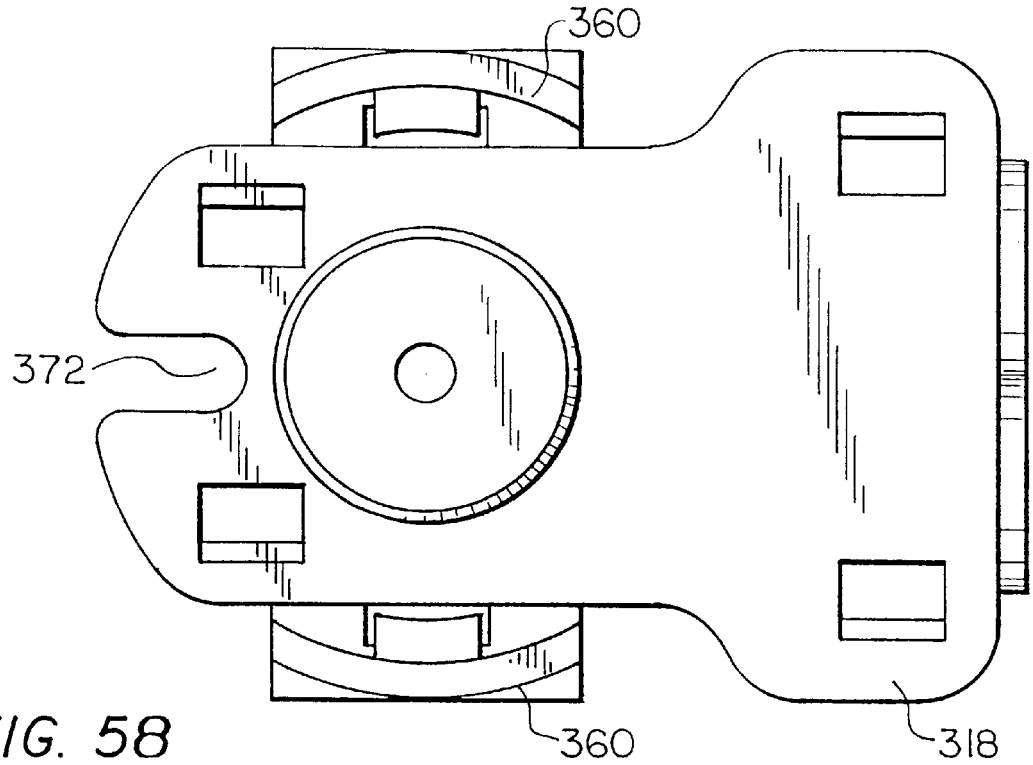
FIG. 58 is a bottom plan view of the connector housing of FIG. 56.
Figure 59:
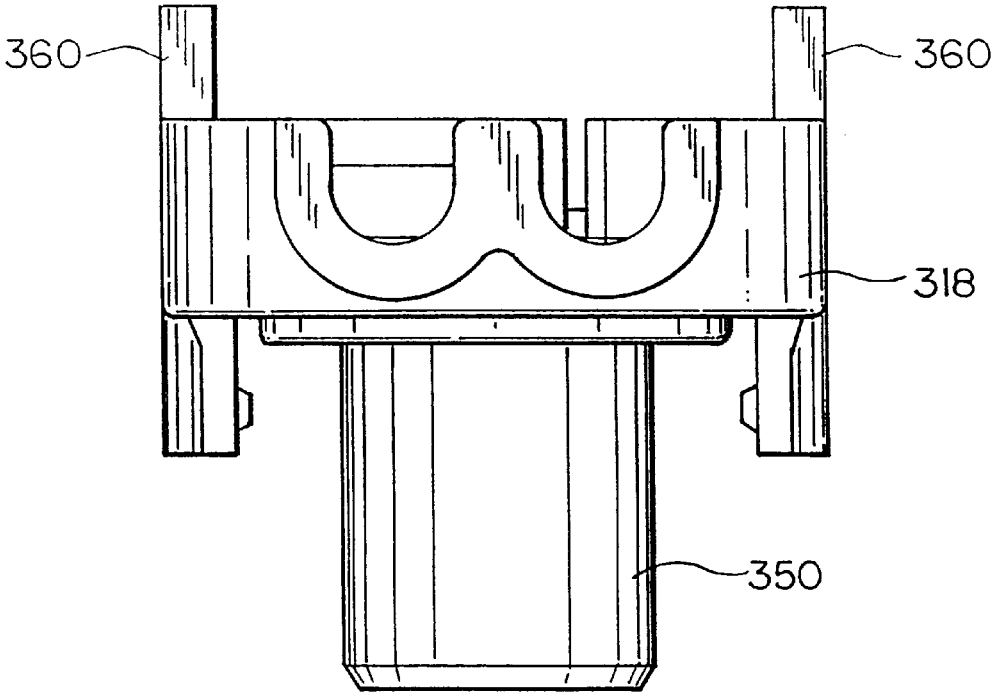
FIG. 59 is an end view of the connector housing of FIG. 56.
Figure 60:
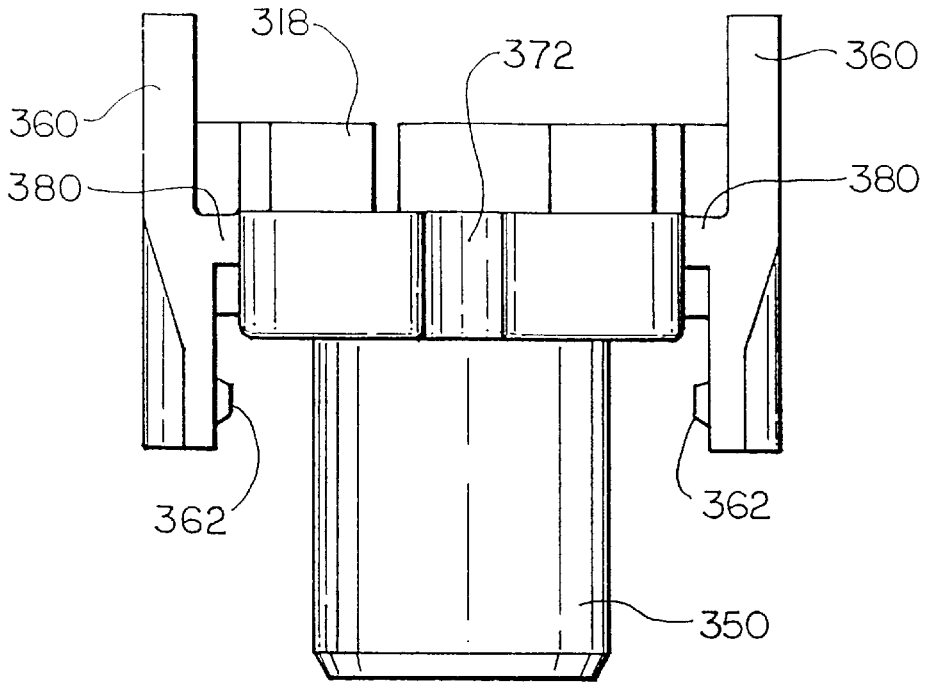
FIG. 60 is a further end view of the connector housing of FIG. 56.
Figure 61:
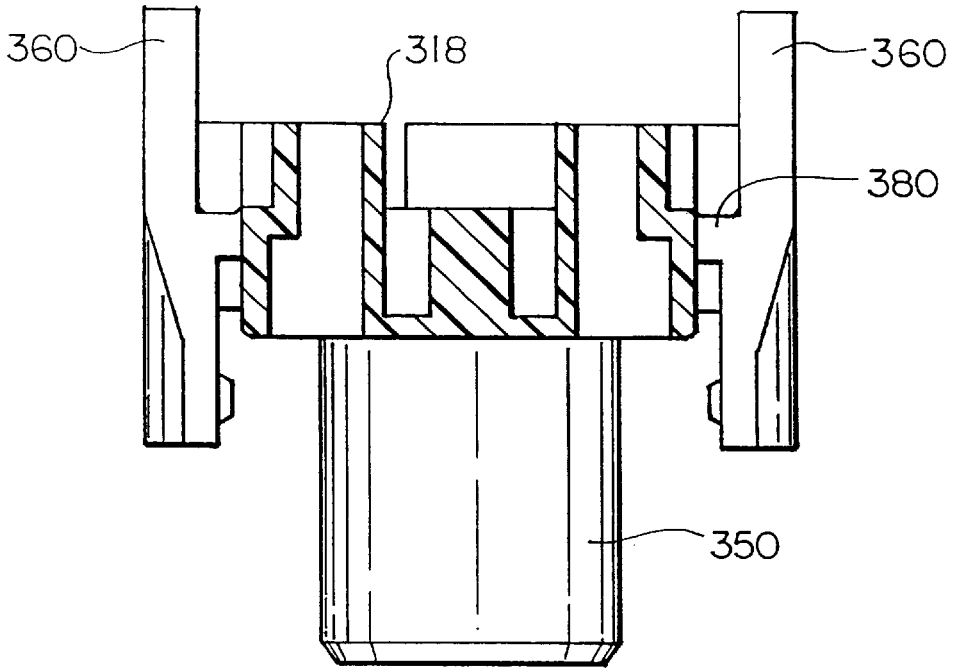
FIG. 61 is a cross sectional view taken along line H—H of FIG. 56.
Figure 62:
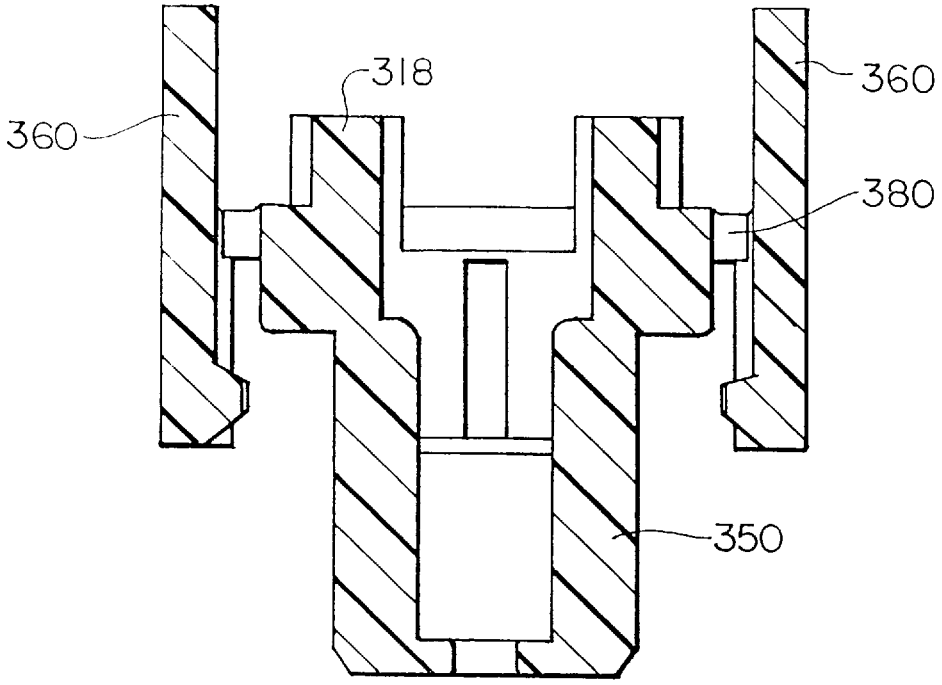
FIG. 62 is a cross sectional view taken along line I—I of FIG. 56.
Figure 63:
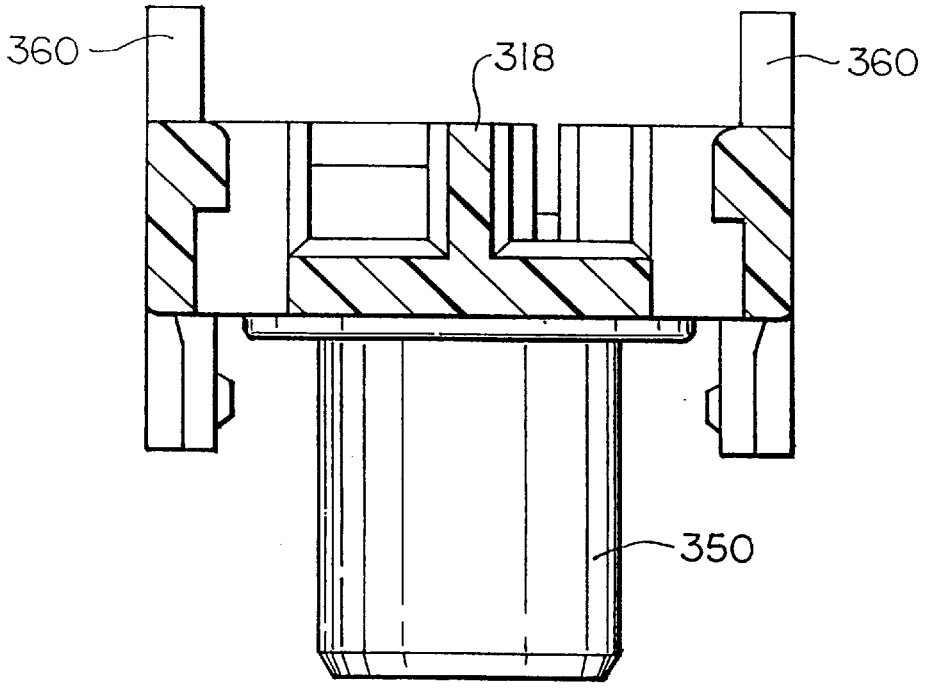
FIG. 63 is a cross sectional view taken along line J—J of FIG. 56.
Figure 64:
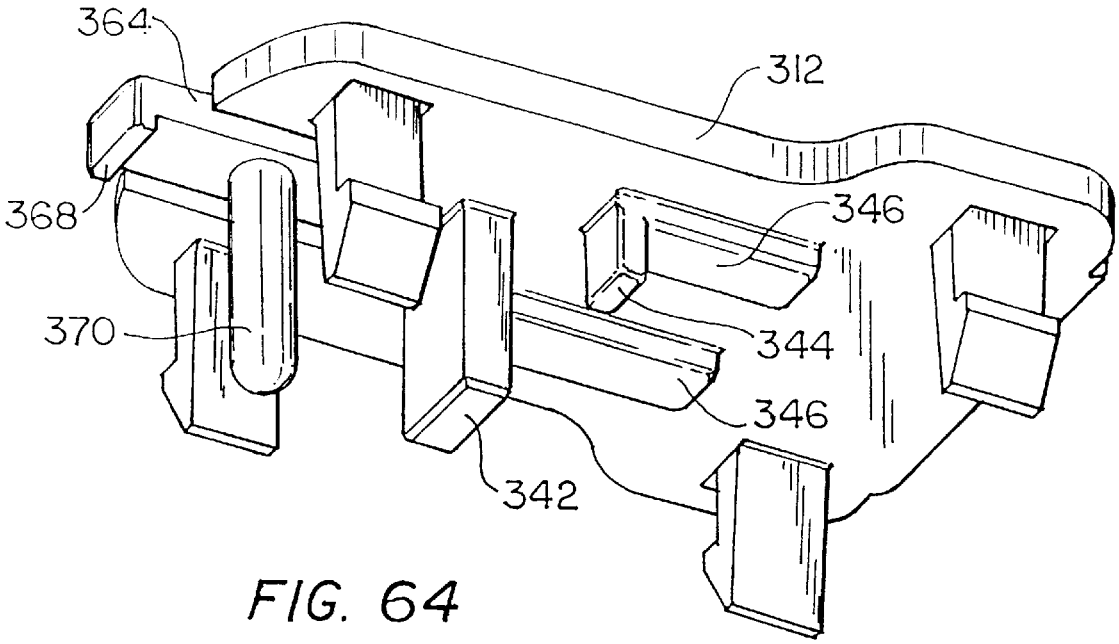
FIG. 64 is an isometric view of the cover of the connector of FIG. 55.
Figure 65:
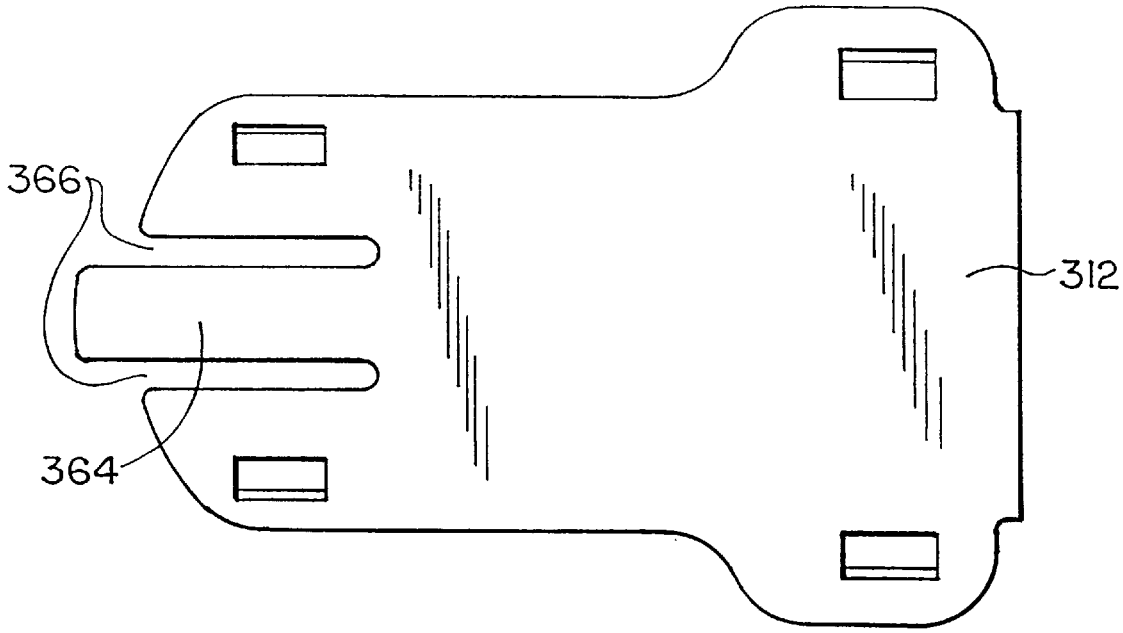
FIG. 65 is a top plan view of the cover of FIG. 64.
Figure 66:
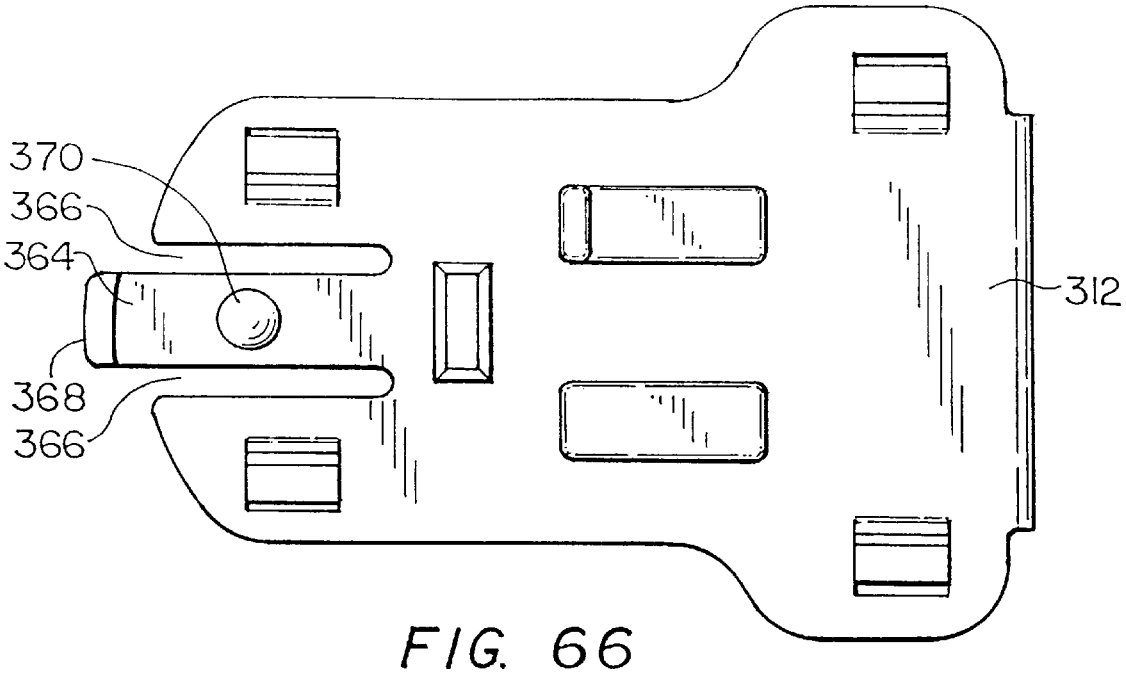
FIG. 66 is a bottom plan view of the cover of FIG. 64.
Figure 67:
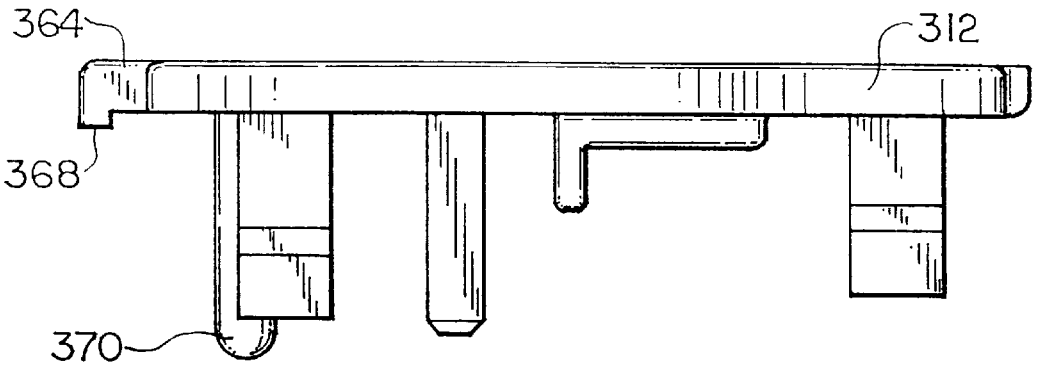
FIG. 67 is a side view of the cover of FIG. 64.
Figure 68:
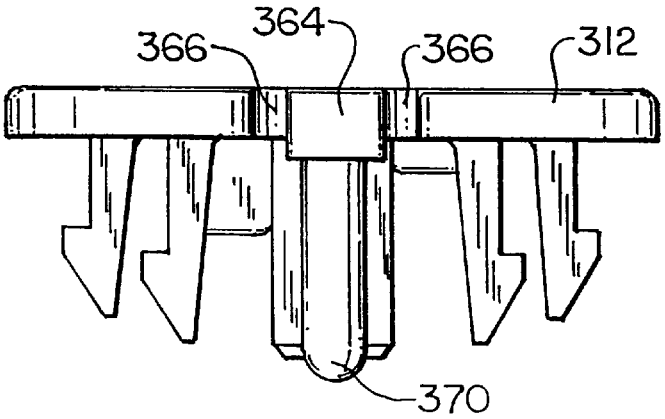
FIG. 68 is an end view of the cover of FIG. 64.
Figure 69:
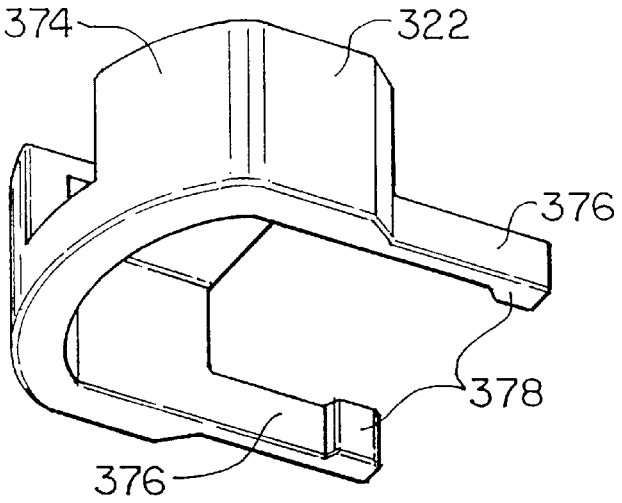
FIG. 69 is an isometric view of the CPA of the connector of FIG. 55.
Figure 70:
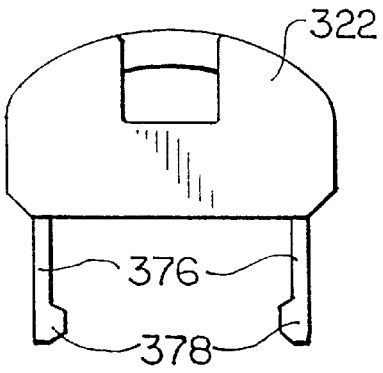
FIG. 70 is a top plan view of the CPA of FIG. 69.
Figure 71:
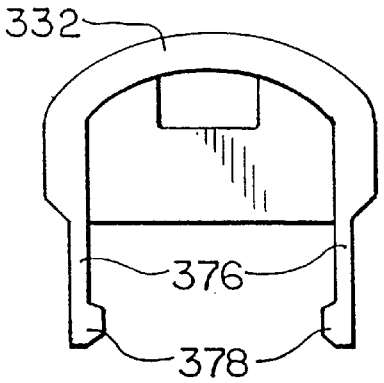
FIG. 71 is a bottom plan view of the CPA of FIG. 69.
Figure 72:
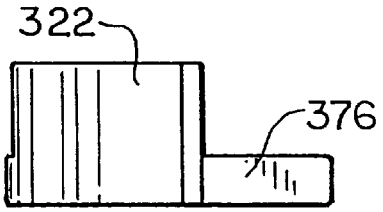
FIG. 72 is a side view of the CPA of FIG. 69.
Figure 73:
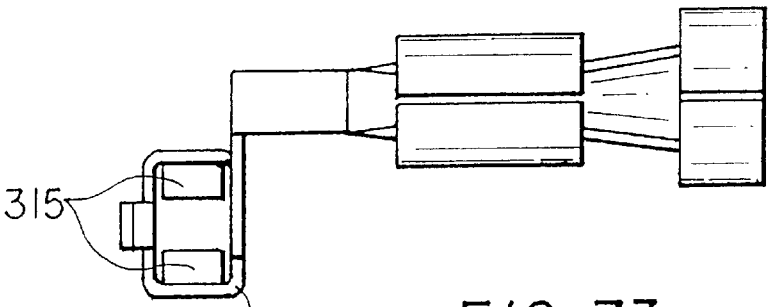
FIG. 73 is a top plan view of the female terminal of the squib assembly of FIG. 55.
Figure 75:
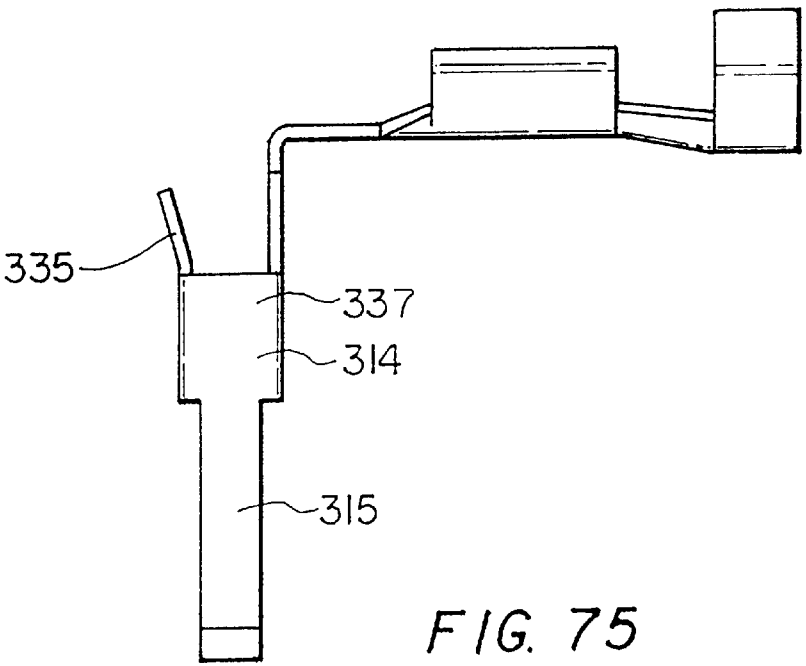
FIG. 75 is a side view of the female terminal of FIG. 73.
Figure 74:
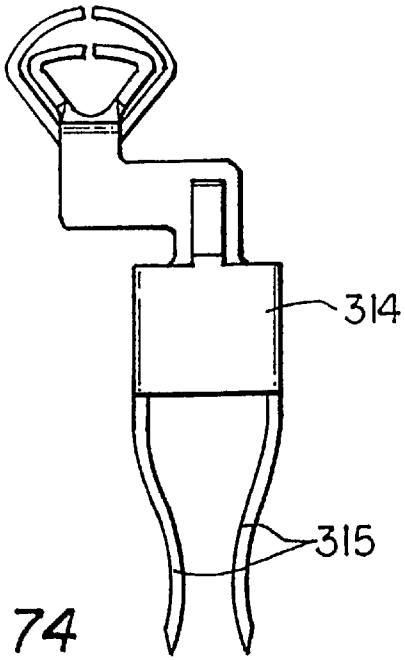
FIG. 74 is a front view of the female terminal of FIG. 73.
Figure 76:
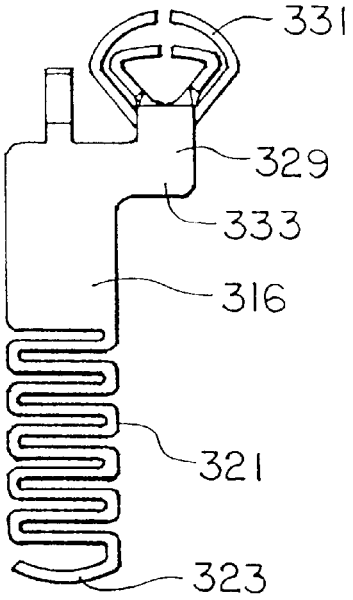
FIG. 76 is a front view of the male terminal of the squib connector assembly of FIG. 55.
Figure 77:
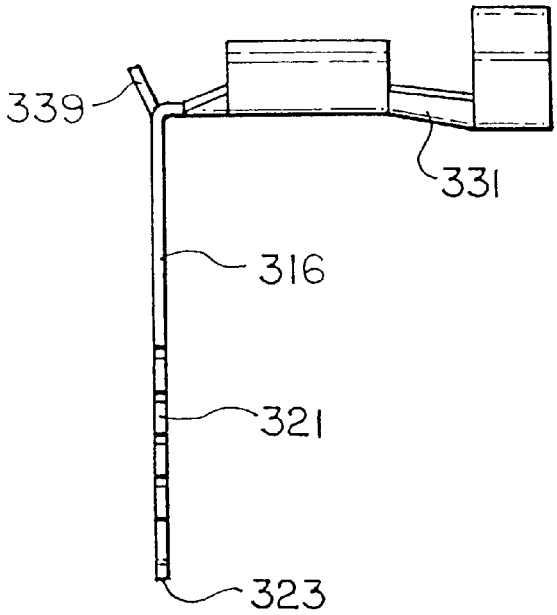
FIG. 77 is a side view of the male terminal of FIG. 76.
Figure 78:
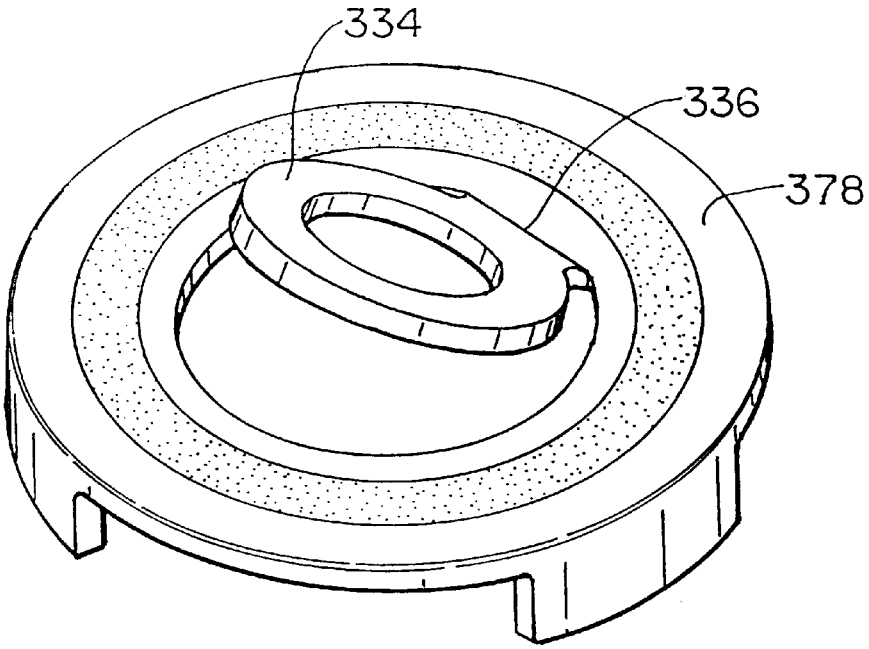
FIG. 78 is a further embodiment of a ground plate for use with the squib assembly of FIG. 55.

The socket housing 18 is a mild steel or aluminum roll formed to a circular configuration with an external recess 46 to provide a lip 48 for latching the connector 16, as discussed below. The internal diametrical area includes a step 50 to provide a positive location for the socket liner 20 and the initiator cup 22 when installed into the bottom of the socket housing. The wall thickness at the bottom 52 of the housing is reduced to allow for roll crimping of the housing around the socket liner and the initiator cup to create a non-separable assembly, as seen in FIGS. 19 and 55.

Referring to FIGS. 2–14, the connector 16 includes a connector body or housing 60 having a depending cylindrical portion 62 receivable within the cylindrical socket housing 18. A pair of terminals 64, 66 is mounted to the connector body to contact the initiator pin 24 and grounding plate 28 for electrical communication therewith when the connector 16 is inserted into the socket 12. A latching arm 68 is located on one side of the connector body for latching to the socket, described further below. The squib connector also includes a cover 70 and a connector position assurance clip or CPA 72 surrounding the body and the cover, also described further below.

The connector body 60, cover 70, and CPA 72 are formed from a suitable nonconducting material capable of meeting the structural requirements of the squib connector. The connector body, cover, and CPA may be suitably colored for easy visual recognition. The terminals are formed from a suitable conductive material. The terminals are preferably plated with a suitable conductive material.

A pair of wires 74 from a signal source, such as a deceleration sensor, enter the connector at a wire entrance area 76 between the cover and the body. The edges of the cover and body at the wire entrance area can be rounded to provide wire strain relief. A wire crimping device 78, associated with each terminal and wire, comprising an insulation grip 80 and a wire grip 82 fixes each wire within the body. Each wire crimping device is preferably formed as a single piece with its associated terminal via a suitable connecting member to provide a good electrical communication path between the wires and the initiator pin and ground plate of the squib. The wire crimping devices and terminals are formed from a suitable conductive material. The wire crimping devices are preferably plated with a suitable conductive material. A ferrite block 84 for EMI/RFI shielding is provided around the wires in a suitably sized cavity in the housing.

The wire crimping devices and ferrite block lie within correspondingly configured recesses 86, 88 respectively formed within the connector body 60. The recesses are generally aligned parallel to the axis 26 of the initiator pin 24 in the socket. Thus, the wires enter the connector assembly aligned parallel to the initiator pin axis as well.

Figure 3:
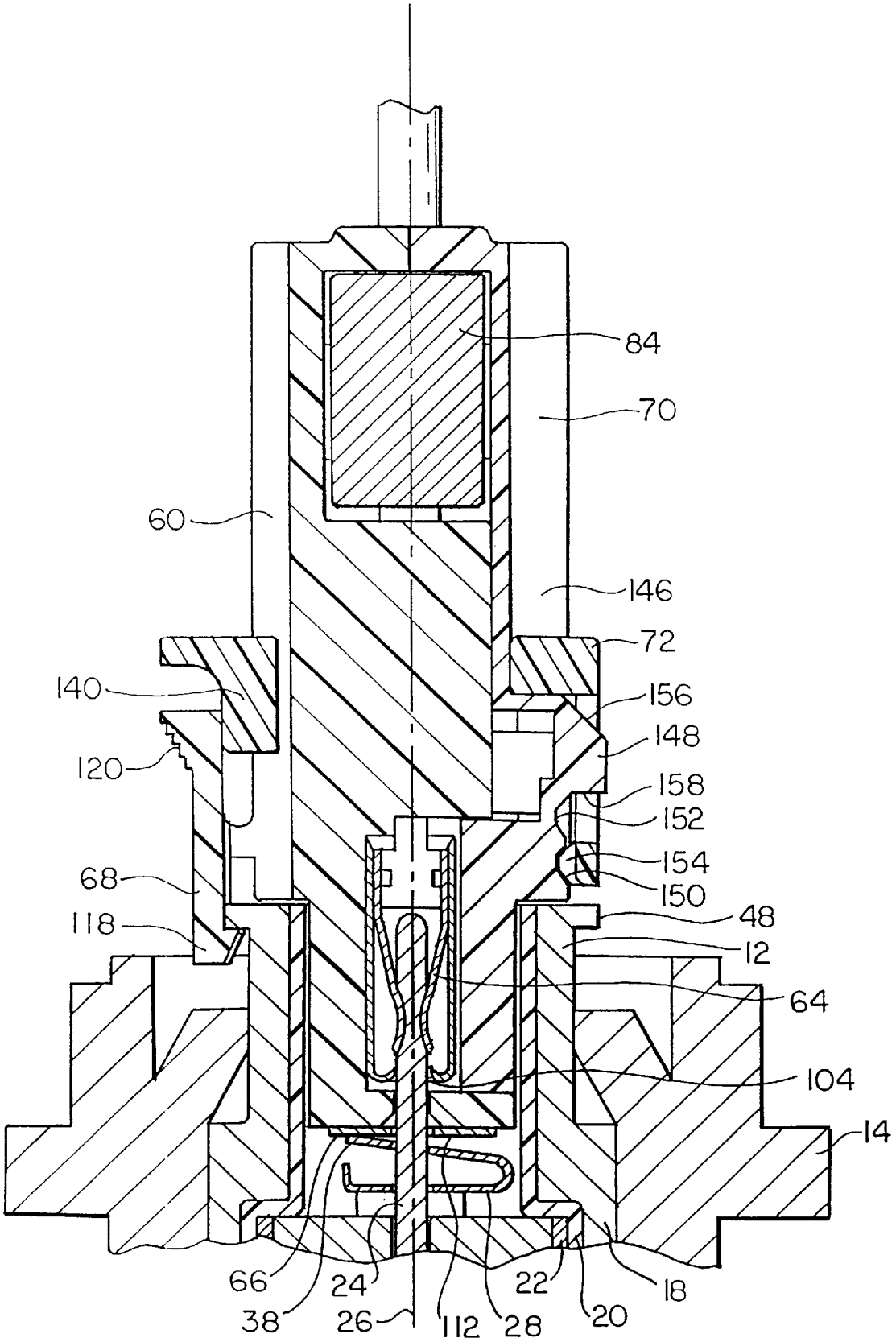
FIG. 3 is a cross sectional view along line A—A of the squib connector assembly of FIG. 1.

The first or female terminal 64 in the connector body comprises two opposed beams 90, 92 (see FIG. 12) which are sized and spaced to contact the initiator pin 24 of the squib on opposite sides thereof. The beams are integrally formed with and depend from a generally box-shaped portion 94. A connecting member 96 between the box-shaped portion 94 and the associated wire crimping device 78 includes an offset 97 configured to center the box-shaped portion 94 and the opposed contact beams 90, 92 within the cylindrical depending portion 62 of the connector body aligned along the axis 26. In this manner, the opposed contact beams are aligned with the initiator pin which is aligned with the central axis 26 of the squib socket. Each beam is bent convexly inwardly toward each other and the pin. The beams are sufficiently springy to retain a bias toward each other, such that upon insertion of the connector into the socket, the pin fits between and pushes the opposed beams away from each other. In this manner, each beam contacts the pin at at least one point, and the terminal as a whole makes at least two points of contact with the pin, as seen in FIG. 3. A conductive material is plated onto each beam at the area where the beam contacts the initiator pin. Typically, the pin is also plated with a compatible conductive material.

A hood 102 (see FIGS. 3 and 13) surrounds the opposed contact beams 90, 92 to protect the beams from damage during insertion of the initiator pin. The hood is generally rectangular in configuration and is crimped to the upper end of the box-shaped portion of the female terminal at one end. The other end includes an opening 104 therein disposed below the ends of the opposed contact beams 92, 94. If the connector is inserted at an angle into the socket or the initiator pin is bent, the tip of the initiator pin stubs against the end of the hood, rather than the opposed contact beams. The hood opening redirects the connector over the pin. The hood, which is usually conductive, is preferably formed from a metal that can be crimped to the female terminal. The hood is formed into a rectangular box configuration.

The depending cylindrical portion 62 of the connector body includes a bottom face 106 having a central opening 108 (see FIG. 9) located below the free ends of the opposed contact beams and the hood of the female terminal. During insertion, the central opening fits around and over the initiator pin of the squib. A chamfer may be provided about the edge of the central opening.

The second or ground terminal 66 in the connector body comprises a depending leg 110 having an annular contact ring 112 at the end thereof (see FIGS. 4–6 and 14). The leg extends downwardly in a slot 114 (see FIG. 8) formed on the surface of the depending cylindrical portion 62 of the connector body, and the contact ring fits against the bottom face 106 of the cylindrical portion. The length of the leg is preselected such that the contact ring abuts and electrically contacts contact beam tip 38 of the ground plate 28 when the connector is fully inserted in the squib socket. The bottom face of the contact ring is preferably plated with a suitable conducting material to ensure good electrical contact with the ground plate. As the connector is inserted into the socket, the contact ring contacts the tip 38 of the contact beam of the ground plate achieving signal circuit ground and pushes it downwardly against its upward bias and out of contact with the initiator pin, releasing the electrical shunt and retaining contact force between the electrical elements. The tip is preferably plated with a suitable conducting material to ensure good electrical contact with the ground terminal.

With this configuration, the ground terminal 66 can contact the contact beam 32 at any rotational orientation. Thus, there is no preferred rotational orientation for inserting the connector body into the socket. This feature simplifies assembly of the squib and connector, a problem with prior art squib connectors. Also, incorporation of the squib assembly into a vehicle is simplified, since the vehicle manufacturer does not have to be concerned with the orientation of the squib assembly in determining wire routing in body position of the vehicle.

The latching arm 68 extends from a side of the connector body. The latching arm is integrally connected to the body by two flexible members 116 which function as a hinge and includes a downwardly extending portion 118 and an upwardly extending portion 120. The downwardly extending portion fits over the outside of the socket. An inwardly extending lip 122 is provided on the downwardly extending portion. The lip 122 of the latching arm engages under the lip 48 of the socket housing to latch the body to the socket. To unlatch the connector from the socket, the upwardly extending portion 120 is squeezed toward the center, thereby pivoting the latching arm about the hinge axis and moving the downwardly extending portion 118 outwardly and the lip 122 out of the groove 46 on the socket housing. With the lip disengaged from the groove, the connector can be removed from the socket. In typical prior art sockets, the connector is latched within an internal groove or detent which must be machined into the socket. The external groove on the socket of the present invention can be manufactured in a metal rolling or plastic molding process, which is more economical and reduces undesirable burrs and slivers which accompany the machining processes of prior art sockets.

The cover 70 fits along one side of the connector body. A number of latching fingers 126 with tabs 128 on the ends extend from the inner side of the cover to fit into complementary recesses 130 in the connector body. When the cover is placed with the fingers in the recesses, the tabs snap under complementary shoulders 132 located within each recess, thereby fixedly retaining the cover to the body. The cover is not intended to be removed from the connector body once it is latched into place.

The CPA 72 (see FIGS. 2, 10, and 11) includes a ring-shaped shell 140 which circumferentially surrounds the housing and the cover when they are fixed together. A U-shaped slider 142 extends from the shell and slides between open and closed positions along the lengthwise axis of the connector in a recess 144 formed in one side of the cover. In the closed position, the slider abuts a wall 146 of the recess of the cover to limit its travel in the closed position direction. In the open position, the slider abuts against a protruding block 148 to limits its travel in the open position direction. A lower or closed position detent 150 is formed in the cover near the edge, and an upper or open position detent 152 is formed near the protruding block. The U-shaped slider includes a tab 154 which fits within the upper detent 152 in the open position and within the lower detent 150 in the closed position. During assembly of the connector, the CPA is slid along the recess 144 in the cover until the slider slides up a ramped portion 156 of the protruding block 148 and snaps over the protruding block. Once assembled, the CPA cannot be moved back over the protruding block, due to the sharp angle of the abutting wall 158 of the block.

Figure 4:
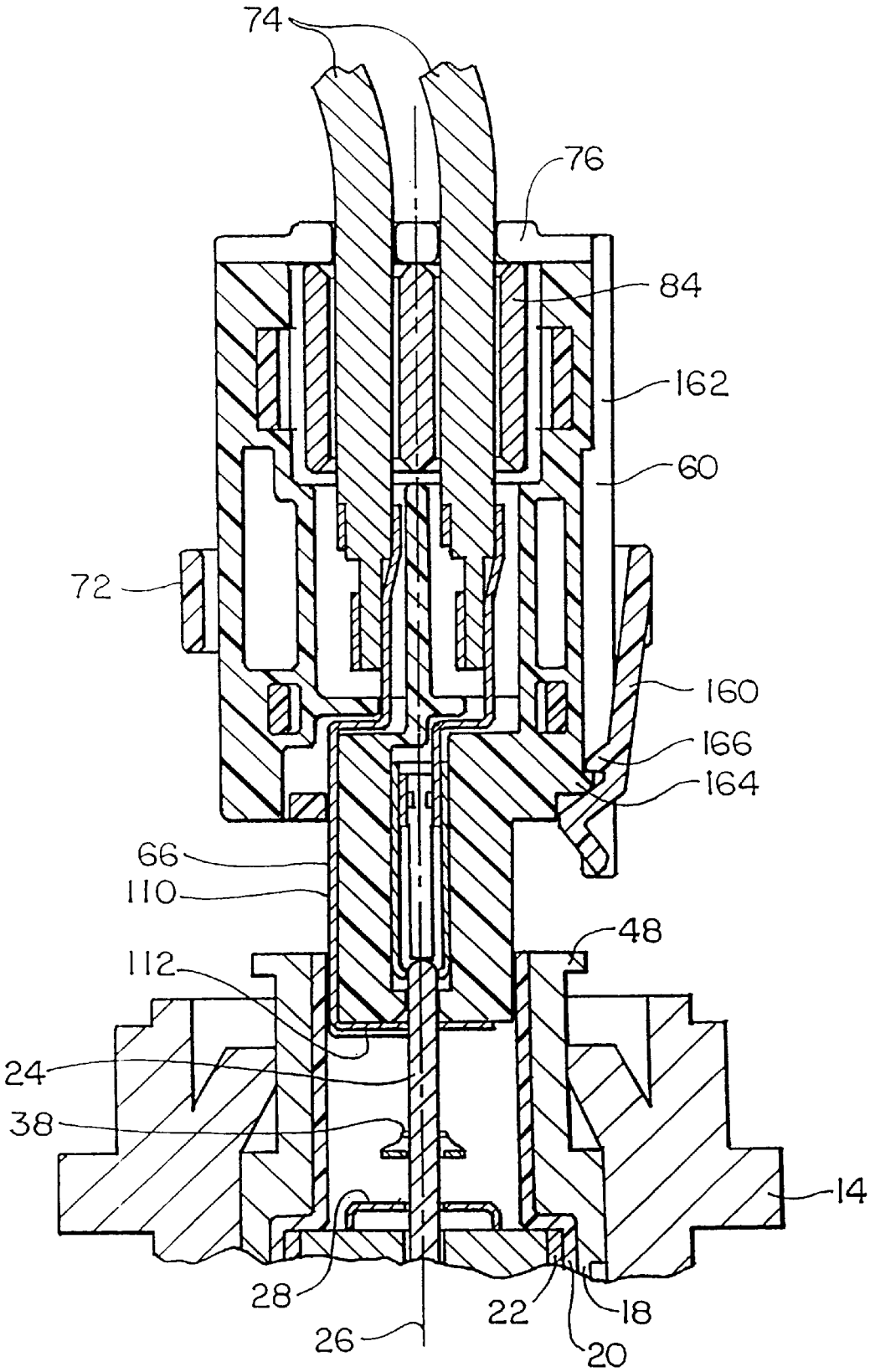
FIGS. 4, 5, and 6 are cross sectional views along line B—B of the squib connector assembly of FIG. 1 illustrating the connector in various positions with respect to the squib assembly.
Figure 5:
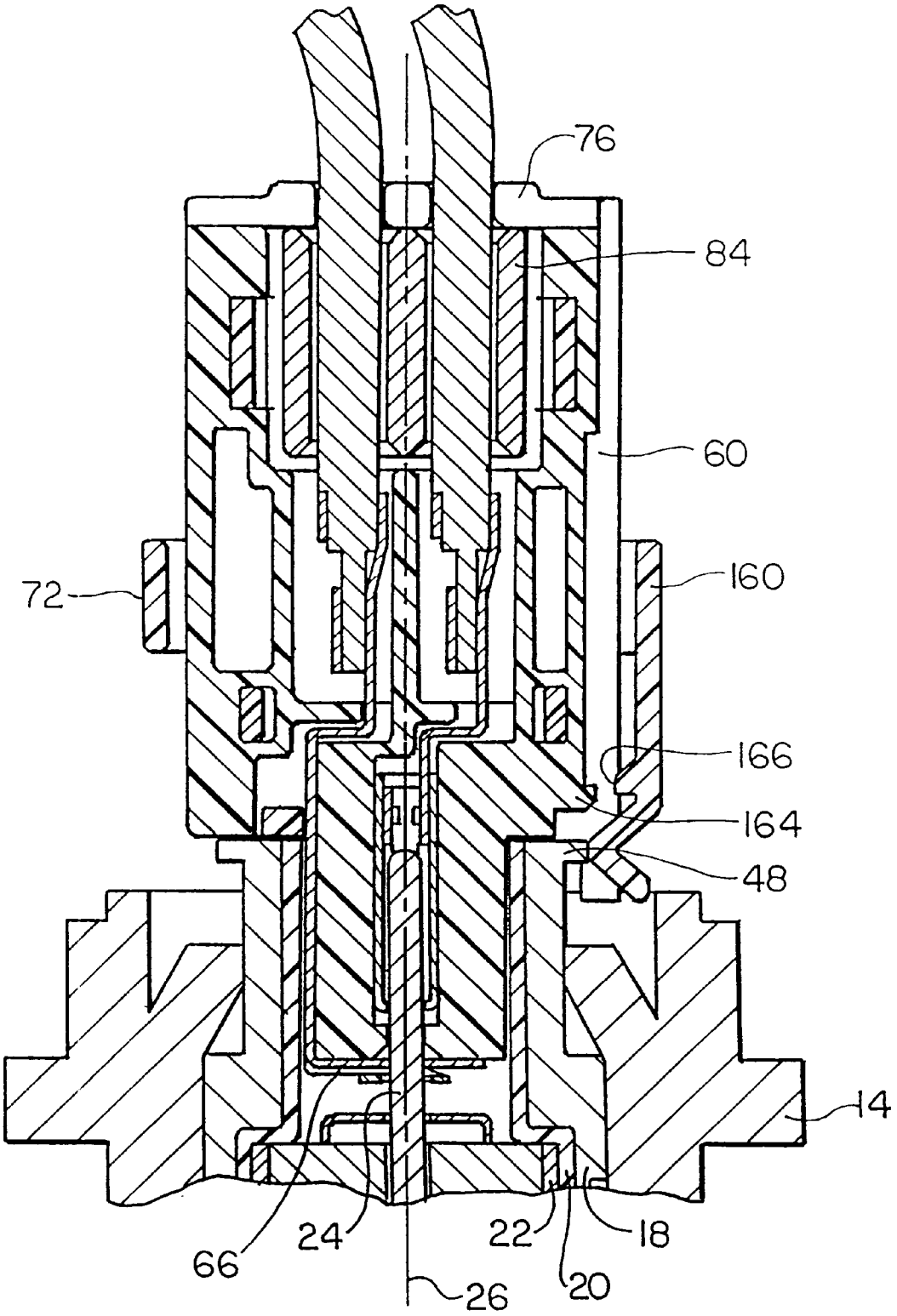
Figure 6:
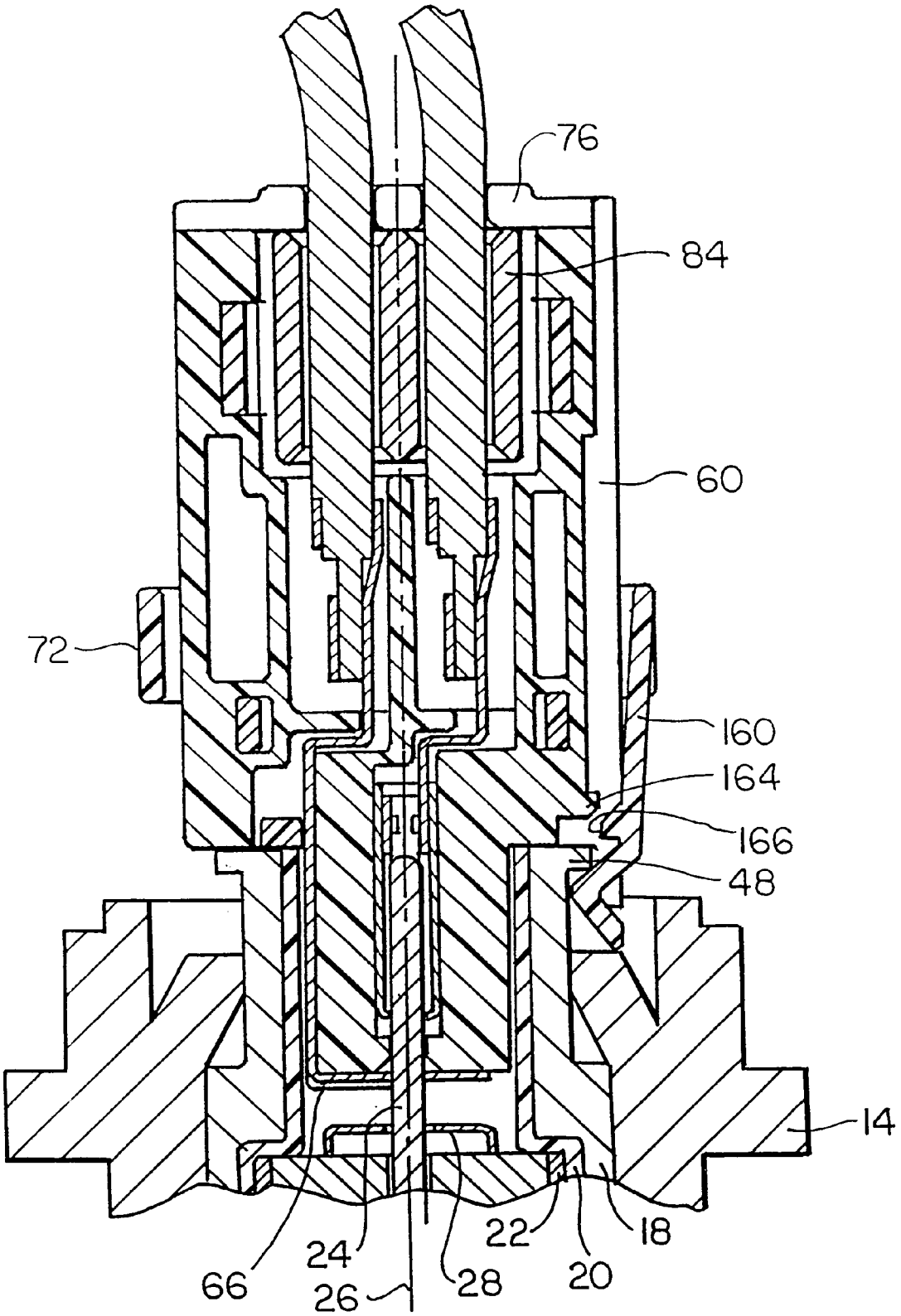
Figure 7:
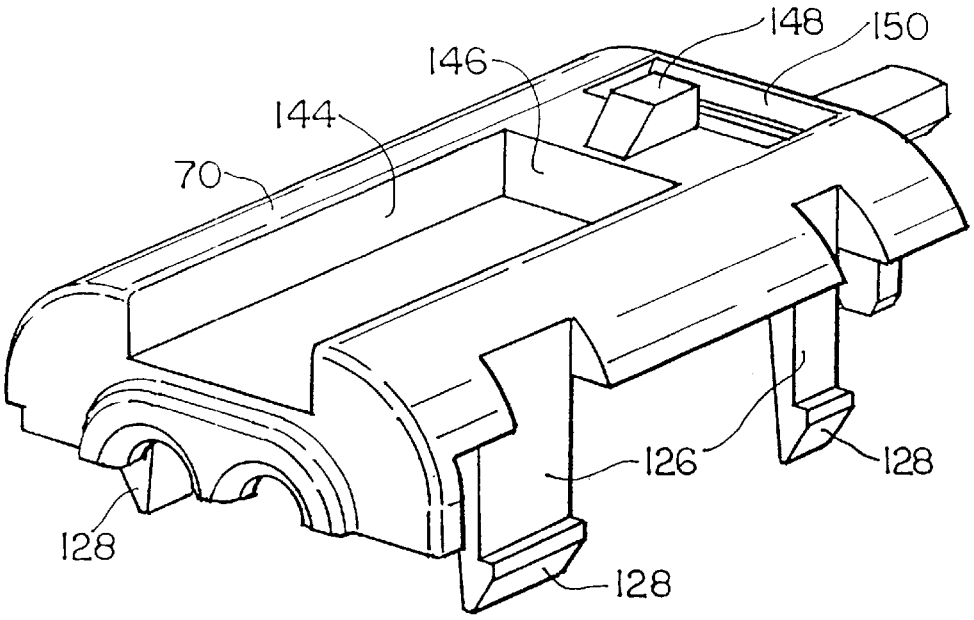
FIG. 7 is an isometric view of the cover of the connector of FIG. 1.
Figure 8:
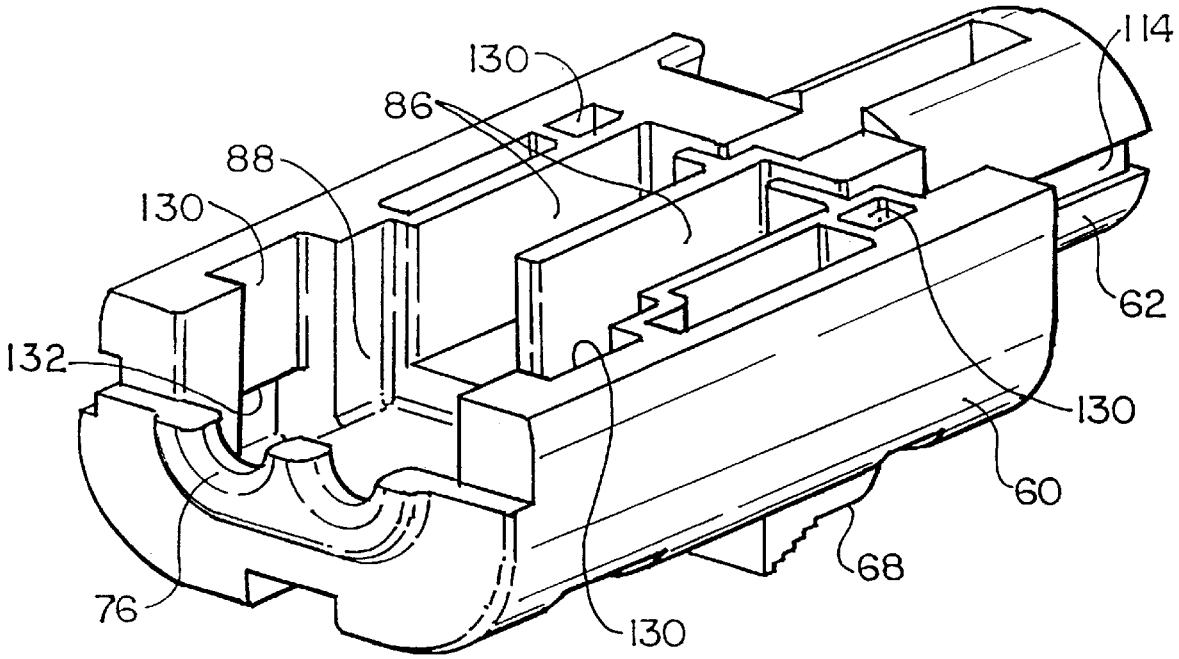
FIG. 8 is an isometric view of the connector housing of the connector of FIG. 1.
Figure 10:
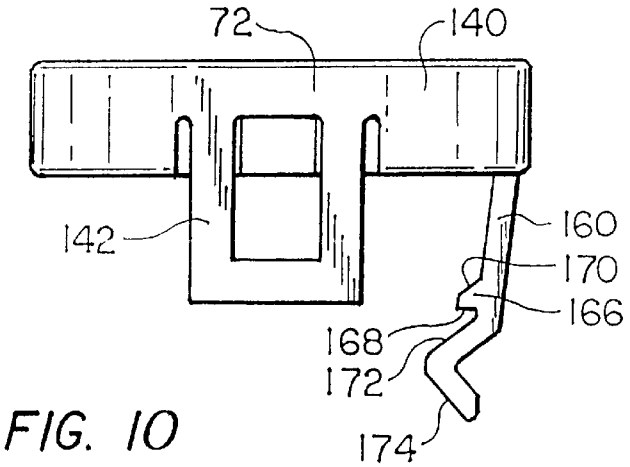
FIGS. 10 and 11 are side views of the CPA of FIG. 1.
Figure 11:
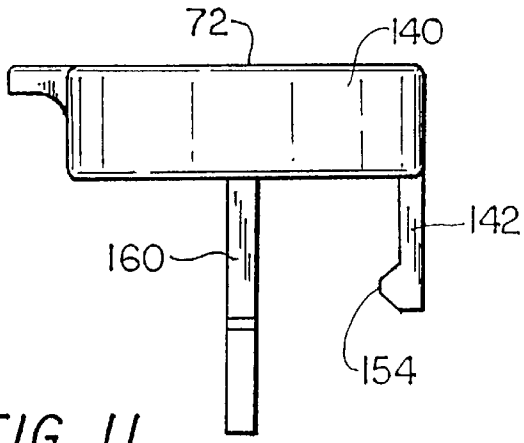
Figure 9:
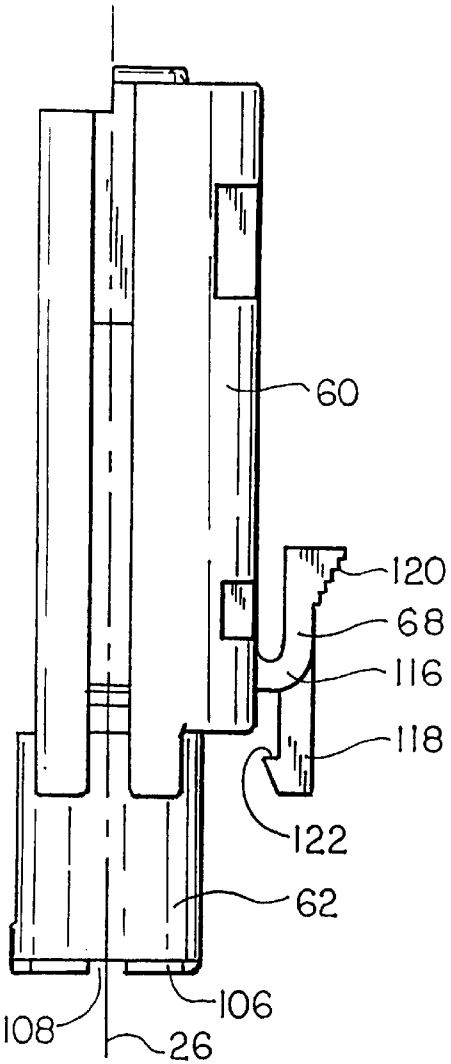
FIG. 9 is a side view of the connector housing of the connector of FIG. 1.
Figure 14:
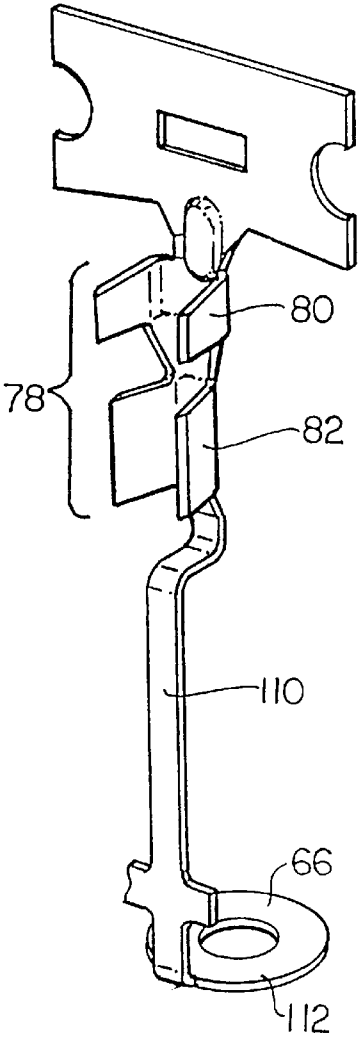
FIG. 14 is an isometric view of the ground terminal of the squib connector assembly of FIG. 1.
Figure 13:
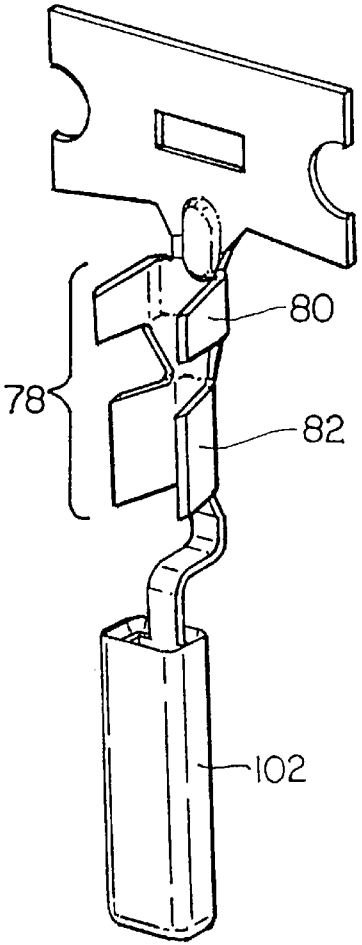
FIG. 13 is an isometric view of a hood attached to the female terminal.
Figure 12:
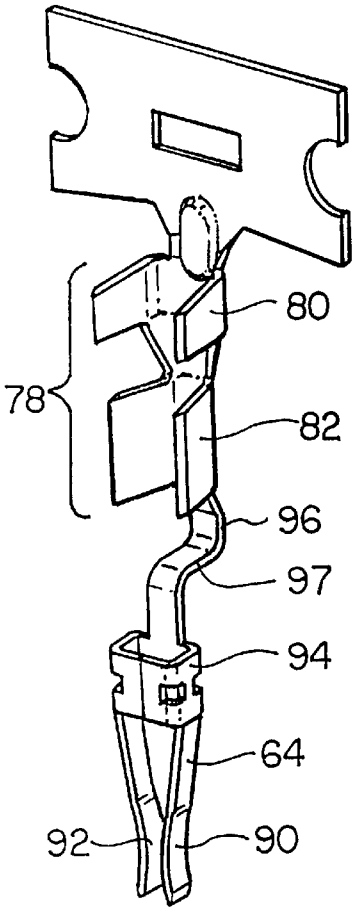
FIG. 12 is an isometric view of the female terminal of the squib connector assembly of FIG. 1.
Figure 15:
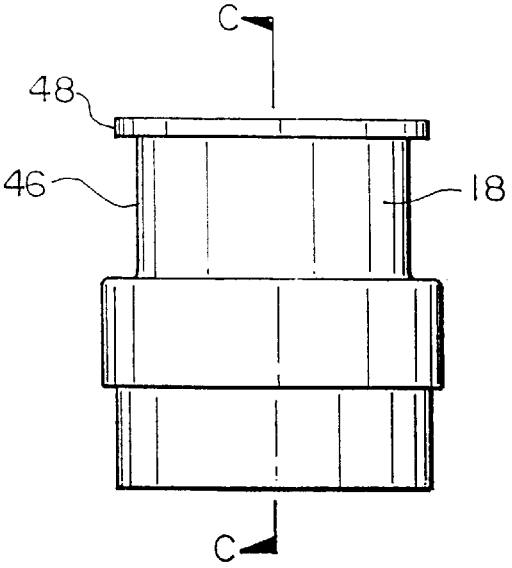
FIG. 15 is a side view of a housing of the squib assembly of FIG. 1.
Figure 16:
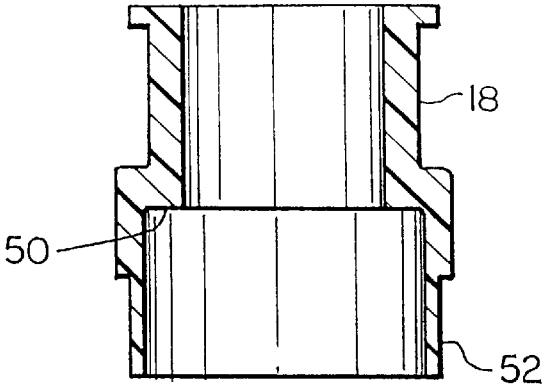
FIG. 16 is a cross sectional view along line C—C of FIG. 15.
Figure 17:
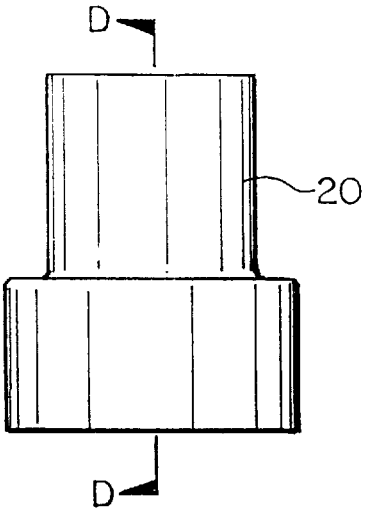
FIG. 17 is a side view of a socket liner of the squib assembly of FIG. 1.
Figure 18:
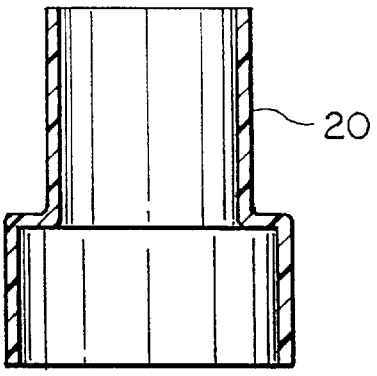
FIG. 18 is a cross sectional view along line D—D of FIG. 17.

Referring further to FIGS. 4–6, the CPA also includes a latching beam 160 which fits within a groove or slot in the body 60. A lip 164 is provided in the body at the end of the groove. The upper side of the lip provides a latching surface, and the underside of the lip provides an angled or ramped surface. The end of the latching beam includes a catch 166 spaced inwardly from the end of the beam. The catch has a latching shoulder 168 on one side and a ramped surface 170 on the other side, generally corresponding to the ramped surface on the underside of the lip 164. In the open position, shown in FIG. 4, the latching shoulder 168 on the catch 66 abuts against the latching surface on the lip 164, preventing the CPA from being slid into the closed position between the latching arm 68 and the connector body 60.

The end of the latching beam 160 of the CPA 72 below the catch 166 is bent inwardly and outwardly to provide two angled surfaces 172, 174. When the connector is inserted into the socket, the lower angled surface 174 abuts against the lip 48 of the socket, thereby biassing the latching beam 160 outwardly and displacing the latching shoulder 168 of the catch 166 from abutment with the latching surface of the lip 164, as seen in FIG. 5. In the displaced position, the CPA is able to move into the closed position.

Once the connector is seated within the socket, the CPA is slid downwardly into the closed position, shown in FIG. 6. The upper angled surface 172 abuts against the underside of the lip 48 of the socket. The CPA is retained in the closed position by the tab 154 on the U-shaped slider 142 seated within the lower detent 150 on the cover 70. Additionally, when the CPA is in the closed position, the shell 140 of the CPA fits between the upwardly extending portion 120 of the latching arm 68 of the connector body, preventing the upwardly extending portion from being pivoted toward the center of the body to unlatch the latching arm. In this manner, the CPA in the closed position prevents the connector body from being removed from the socket. To remove the connector body from the socket, the CPA is slid upwardly to the open position, which allows the latching arm 68 to flex. A firm upward pull on the CPA is sufficient to move the U-shaped slider out of the lower detent in the cover.

In assembly, two wires are crimped onto the female terminal with the hood and onto the ground terminal. The ground terminal depending beam is bowed outwardly for spring assembly to the connector body. The free ends of the wires are fed through holes in the ferrite block. The female terminal, hood end, is installed into the center rectangular hole of the connector body. The ground terminal wire crimping device is installed into the associated crimp recess of the body and pivoted downwardly with the depending beam in the slot of the body, and the contact ring is sprung onto the bottom of the body. The depending beam may also be affixed to the connector body. The ferrite block is located in its associated recess of the body. The cover is snapped onto the body. The CPA is slid over the body and cover and snapped into place over the protrusion. The finished assembly is checked for electrical continuity.

Figure 84:
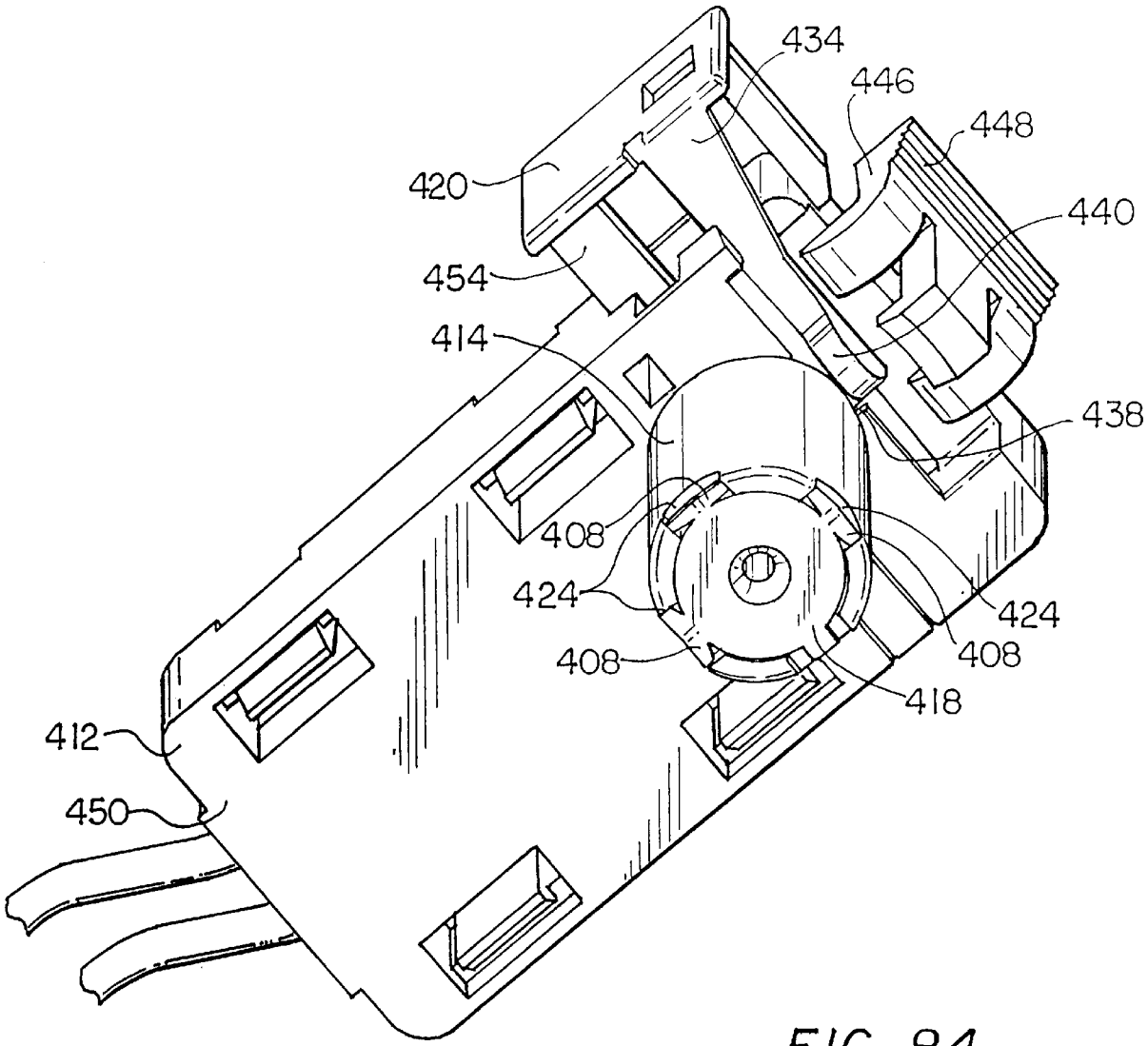
FIG. 84 is a further isometric view of the squib connector of FIG. 82.
Figure 85:
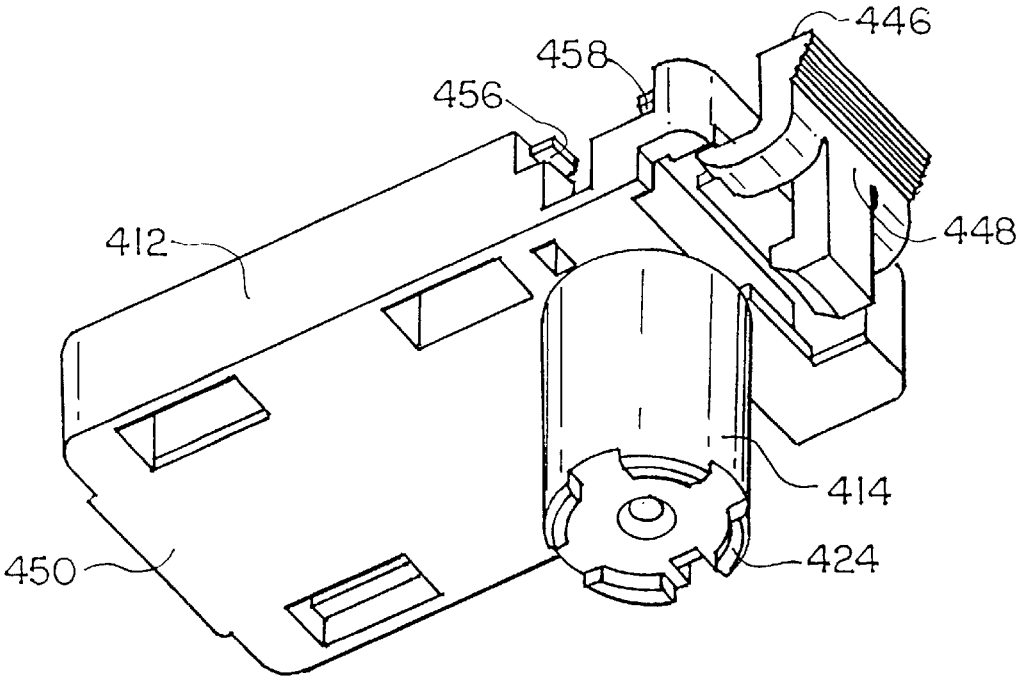
FIG. 85 is an isometric view of the connector body of the connector of FIG. 82.
Figure 86:
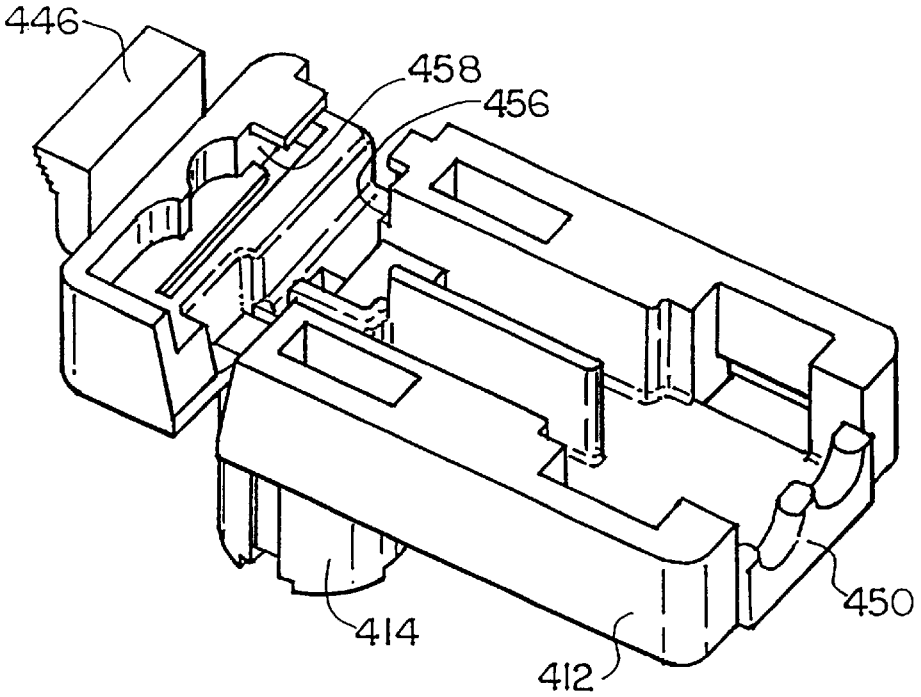
FIG. 86 is a further isometric view of the connector body of the connector of FIG. 82.
Figure 88:
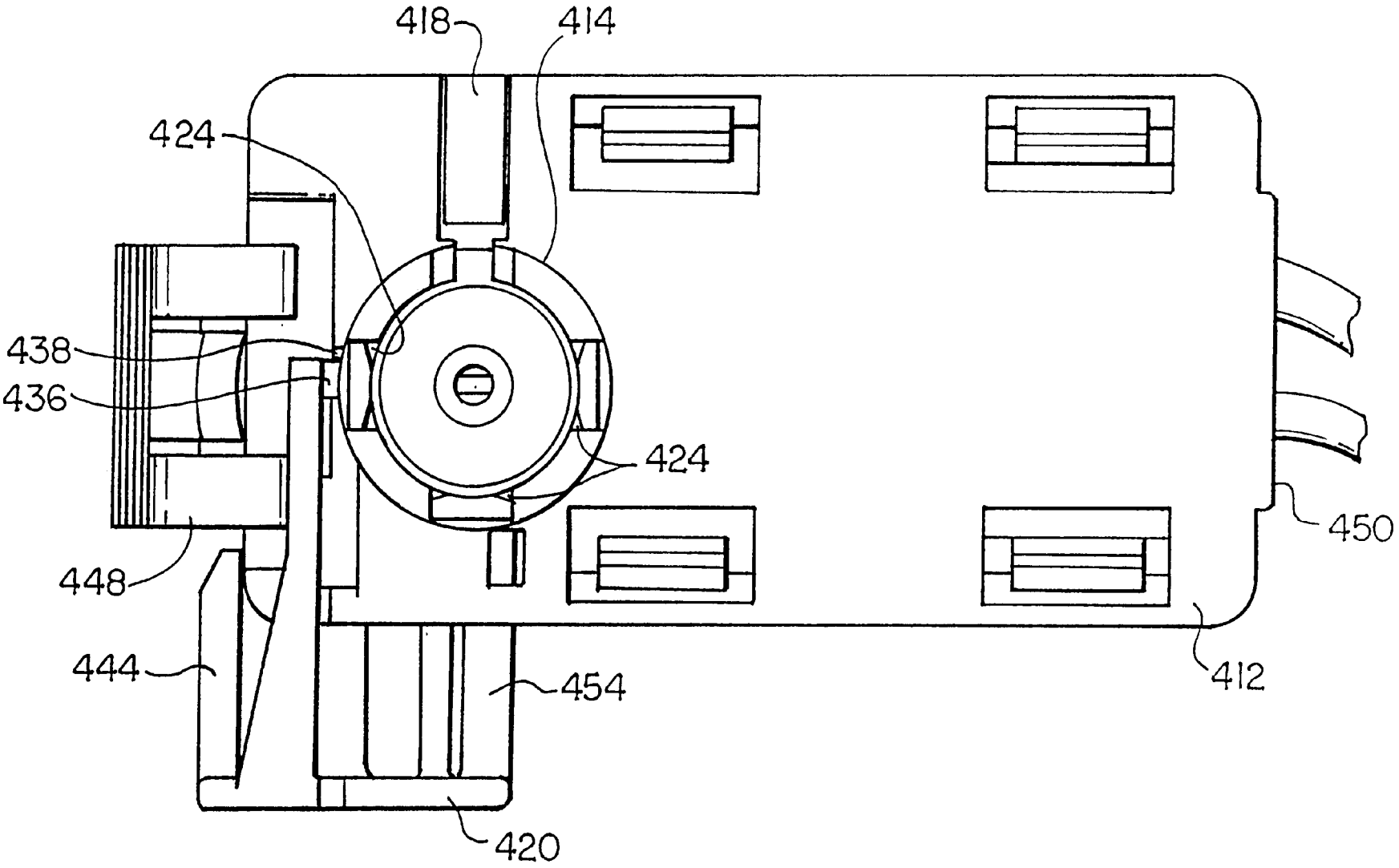
FIG. 88 is a bottom plan view of the connector of FIG. 82.
Figure 89:
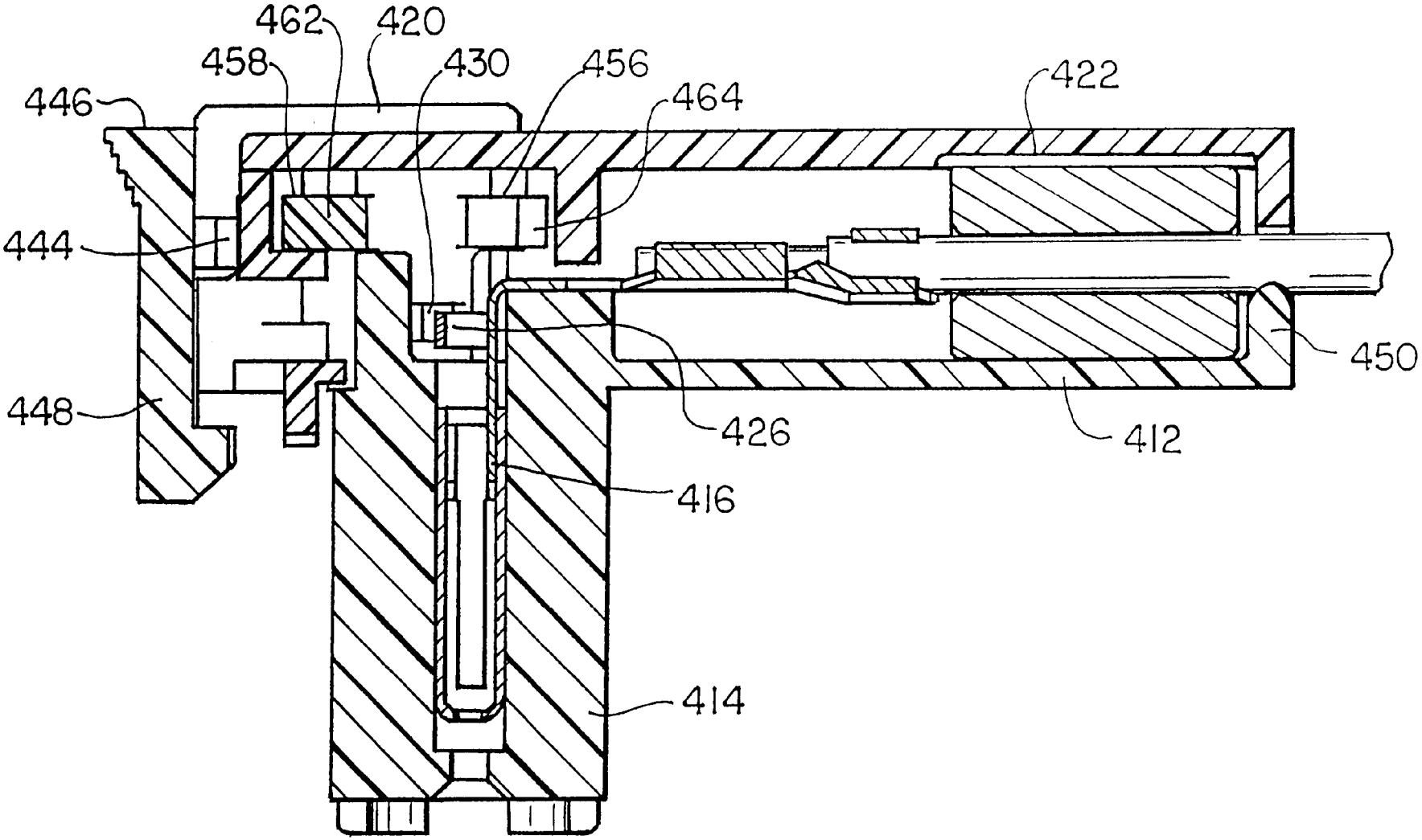
FIG. 89 is a cross sectional view along line K—K of FIG. 87.
Figure 90:
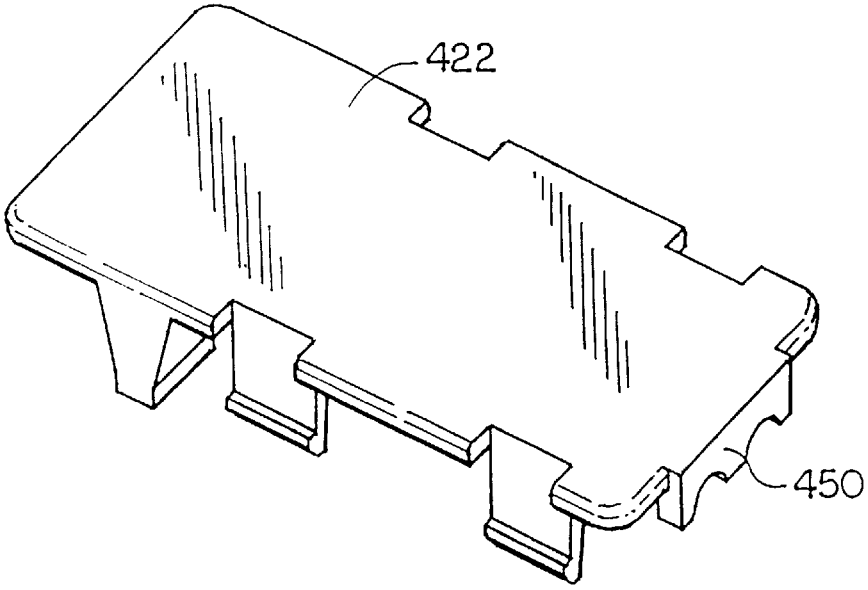
FIG. 90 is an isometric view of the cover of the connector of FIG. 82.
Figure 91:
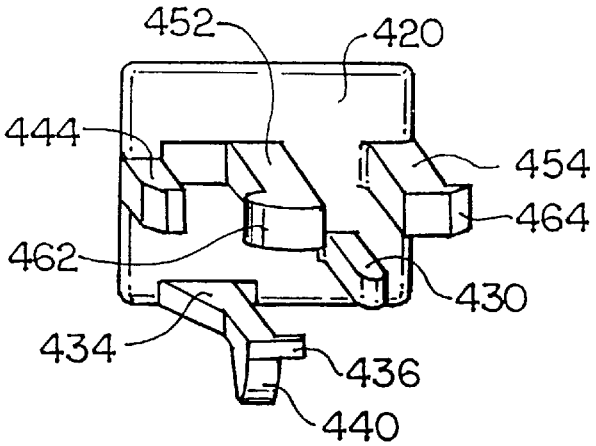
FIG. 91 is an isometric view of the CPA of the connector of FIG. 82.
Figure 92:
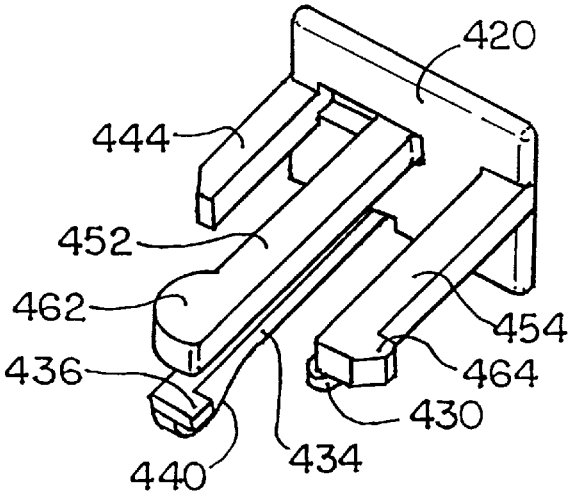
FIG. 92 is a further isometric view of the CPA of the connector of FIG. 82.
Figure 94:
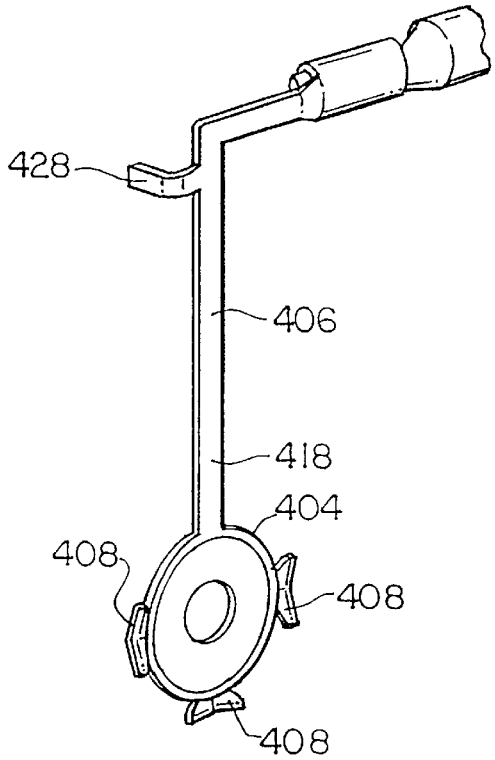
FIG. 94 is an isometric view of a ground terminal of the connector of FIG. 82.

A further embodiment of a ground terminal 418 within the connector body is illustrated in FIG. 94. In this embodiment, the annular contact ring 404 at the end of the depending leg 406 of the ground terminal includes a number of upwardly extending barbs 408. Preferably, the bottom face of the depending cylindrical portion 414 of the connector body 412 includes corresponding recesses 424 to receive the barbs (see FIGS. 84, 85, and 88). In assembly, the annular ring is bent to approximately 90° to the leg, and the barbs are pushed into the recesses in the body using a suitable tool to retain the ground terminal to the connector body.

A further embodiment of the orientationless squib connector assembly is illustrated in FIGS. 19–53. In this embodiment, the squib assembly 14 with initiator pin and ground plate are similar to that of the above embodiment and are accordingly designated with the same reference numerals used above. The connector assembly also includes a connector 202 having a connector body or housing 204 with a depending cylindrical portion 206 and a pair of terminals 280, 282 therein. Wires 212 enter the connector at approximately 90° to the initiator pin in the squib assembly. A latching arm 214 extends from an end of the connector body opposite the wire entrance area 216. The latching arm is integrally connected to the body by a flexible member 218 which functions as a hinge and includes a downwardly extending portion 220 and an upwardly extending portion 222. The downwardly extending portion fits over the outside of the socket. An inwardly extending lip 224 is provided on the downwardly extending portion 220. The lip 224 of the latching arm engages under the lip 48 of the socket housing 18 to latch the connector to the socket. To unlatch the connector from the socket, the upwardly extending portion 222 is squeezed toward the wire entrance area 216, thereby pivoting the latching arm about the hinge axis and moving the downwardly extending portion 220 outwardly and the lip out of the groove 46 on the socket housing. With the lip disengaged from the groove, the connector can be removed from the socket.

A cover 228 fits over the top of the connector body 204. A number of latching fingers 230 with tabs 232 on the ends depend from the underside of the cover to fit into complementary recesses 234 in the connector body. When the cover is placed with the fingers in the recesses, the tabs snap under complementary shoulders 236 located within each recess, thereby fixedly retaining the cover to the body. The cover is not intended to be removed from the connector body once it is latched into place.

Figure 20:
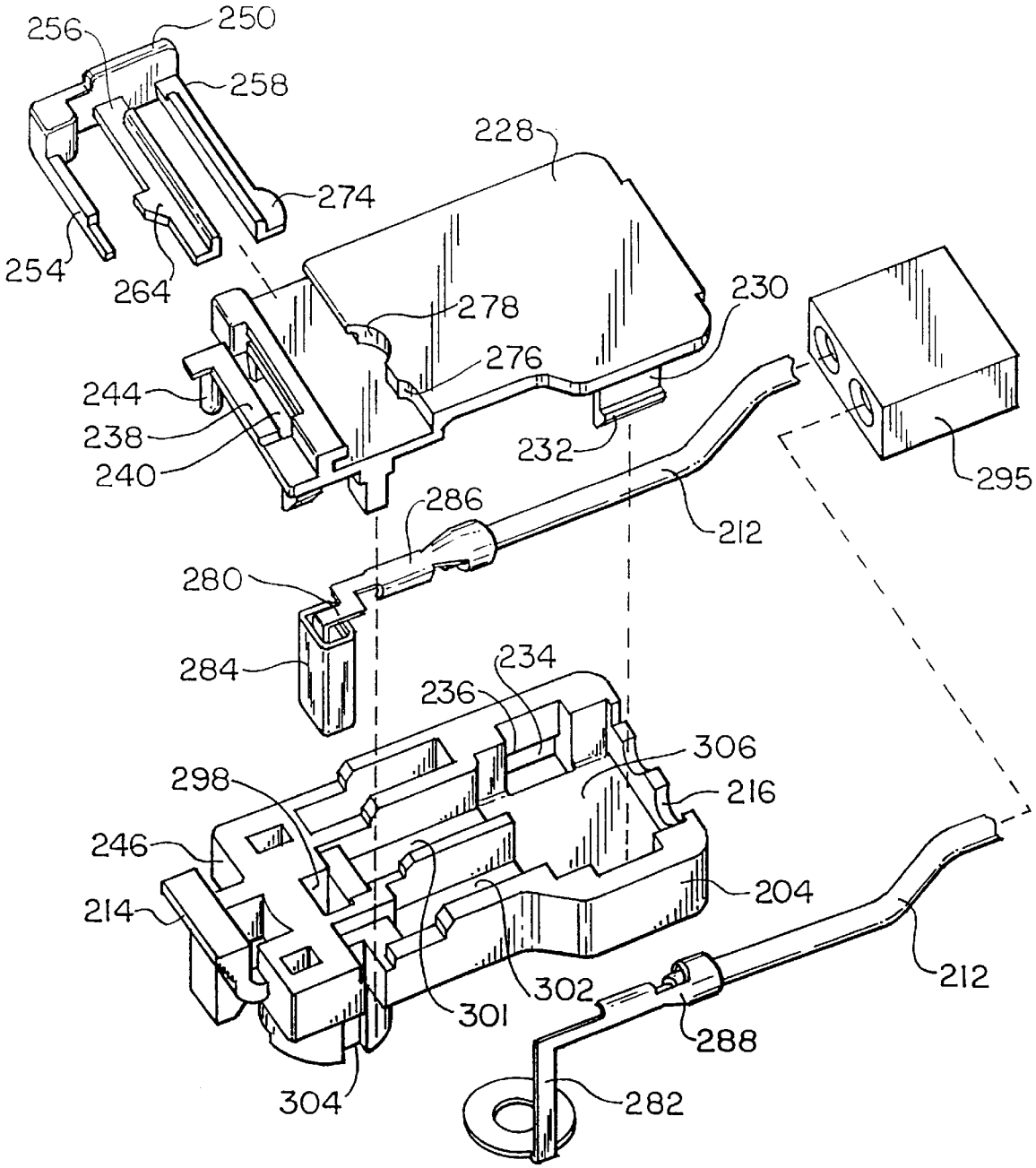
FIG. 20 is an exploded view of the squib connector assembly of FIG. 19.
Figure 21:
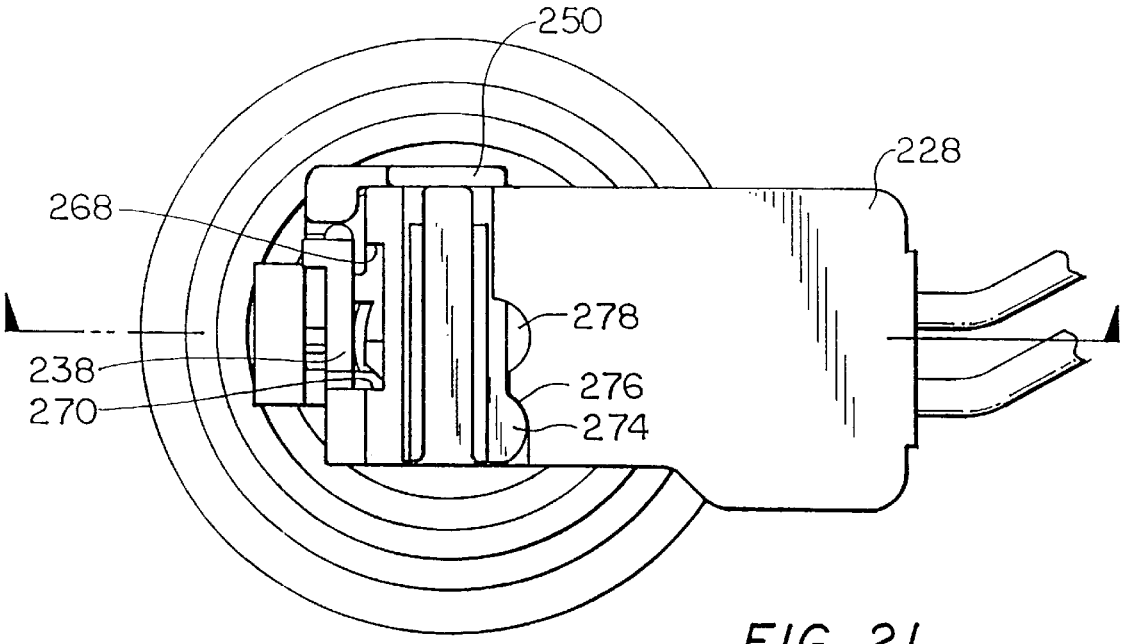
FIG. 21 is a top plan view of the squib connector assembly of FIG. 19.
Figure 22:
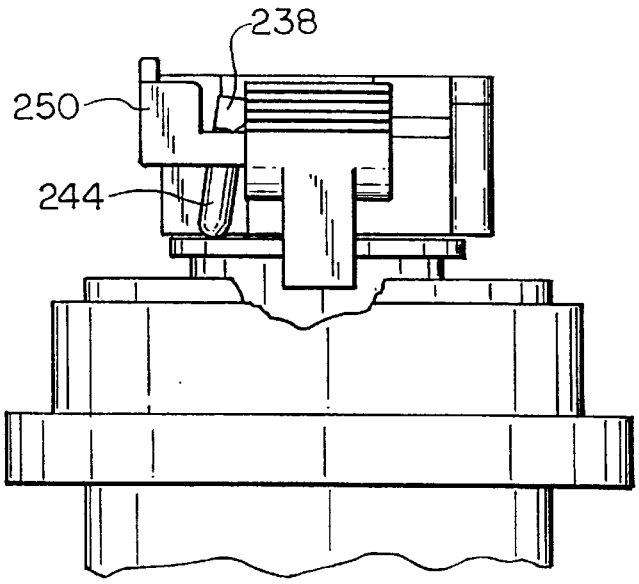
FIG. 22 is a side view of the squib connector assembly of FIG. 19.
Figure 23:
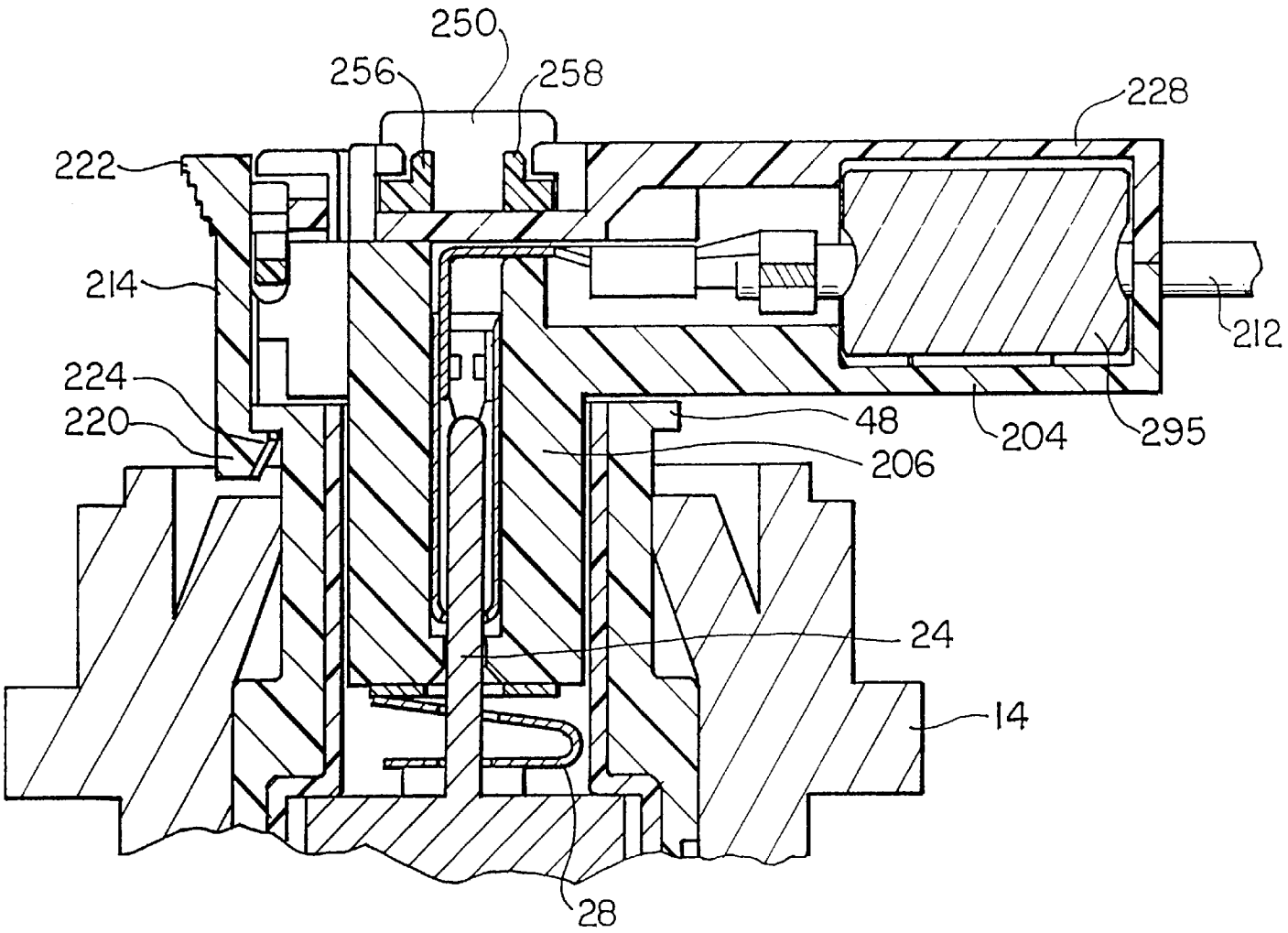
FIG. 23 is a cross sectional view of the squib connector assembly of FIG. 19.
Figure 24:
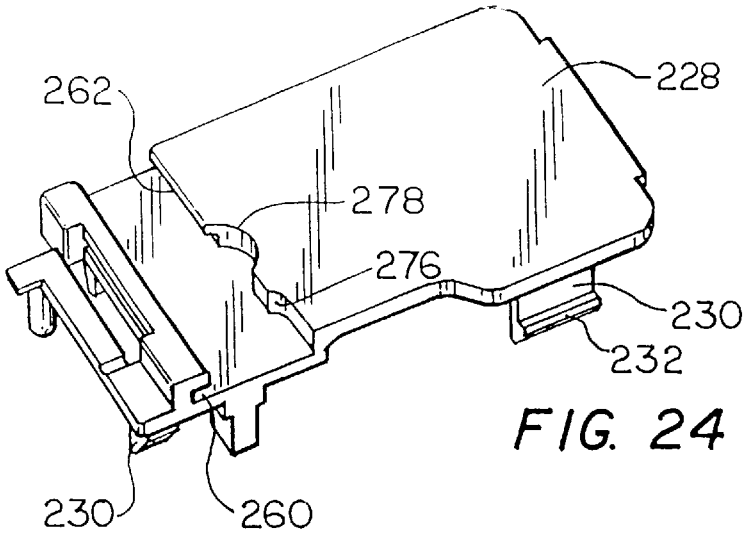
FIG. 24 is an isometric view of the cover of the connector of FIG. 19.
Figure 25:
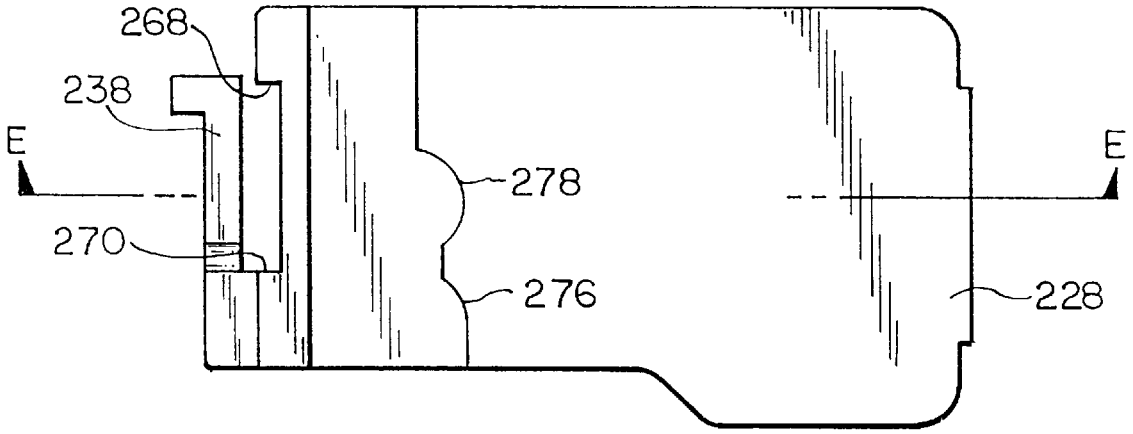
FIG. 25 is a top plan view of the cover of FIG. 14.
Figure 26:
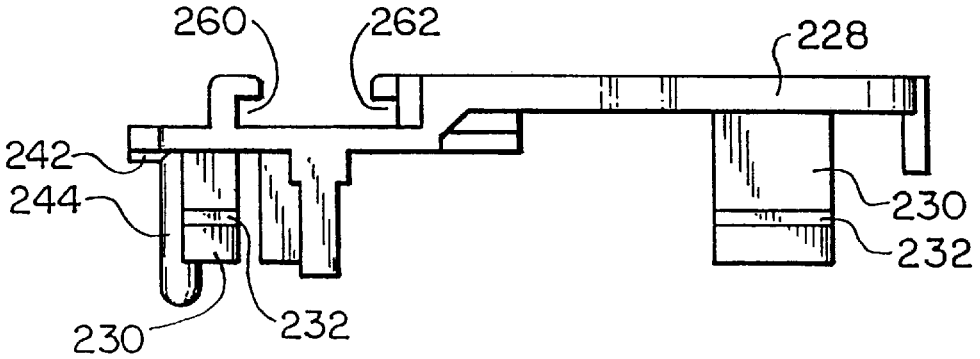
FIG. 26 is a side view of the cover of FIG. 24.
Figure 27:
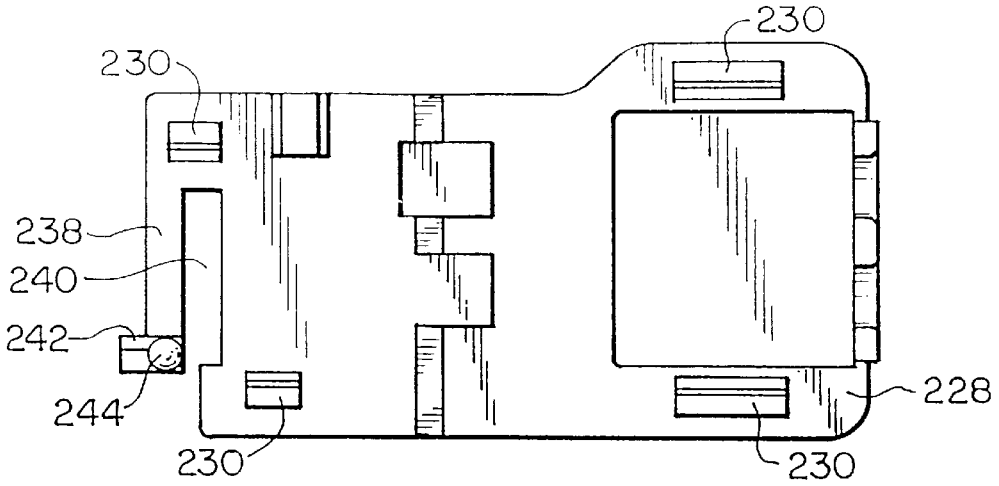
FIG. 27 is a bottom view of the cover of FIG. 24.
Figure 28:
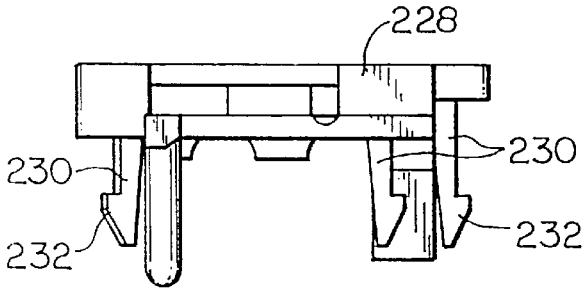
FIG. 28 is an end view of the cover of FIG. 24.
Figure 29:
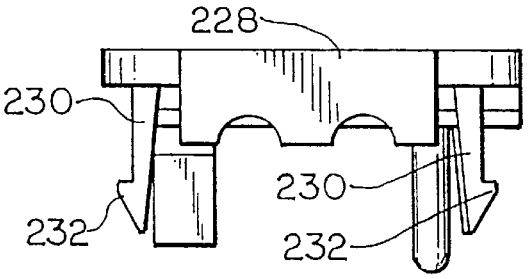
FIG. 29 is a further end view of the cover of FIG. 24.
Figure 30:
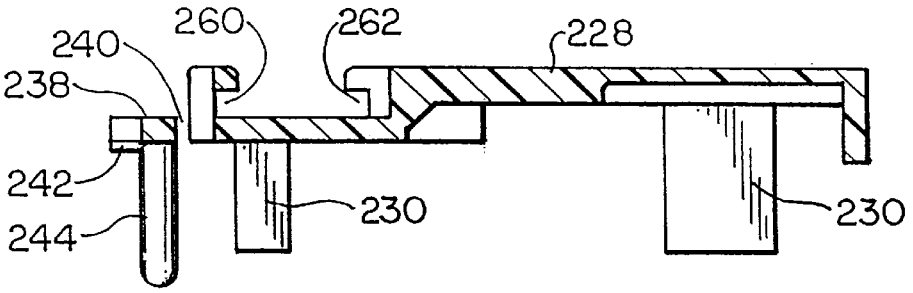
FIG. 30 is a cross sectional view along line E—E of FIG. 25.
Figure 31:
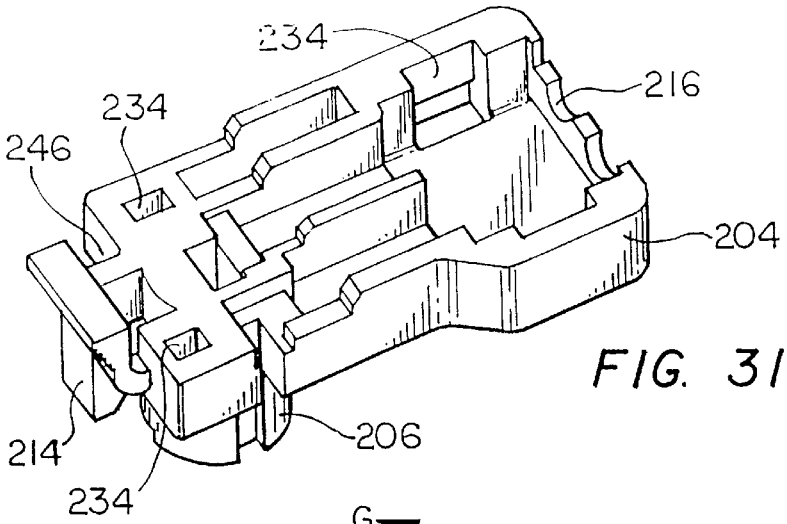
FIG. 31 is an isometric view of the connector housing of the connector of FIG. 19.
Figure 32:
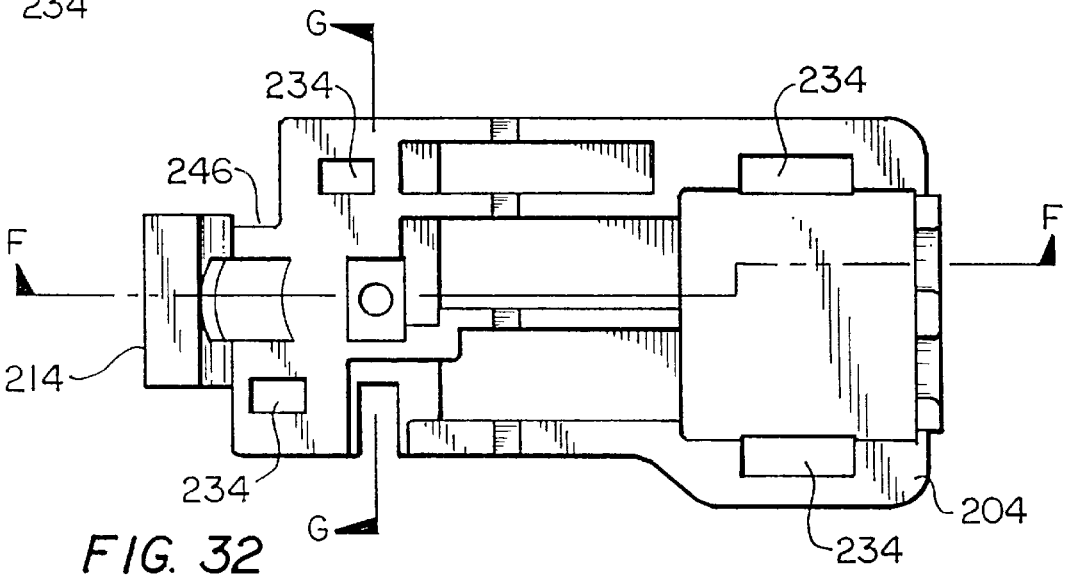
FIG. 32 is a top view of the housing of FIG. 31.
Figure 33:
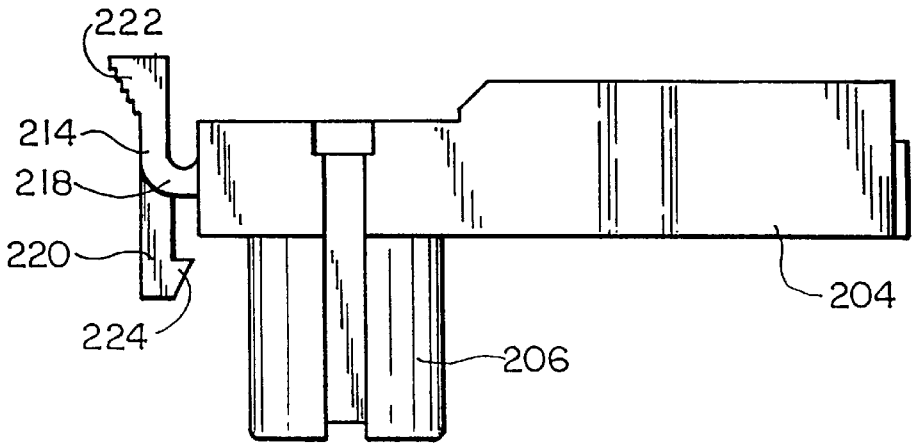
FIG. 33 is a side view of the housing of FIG. 31.
Figure 34:
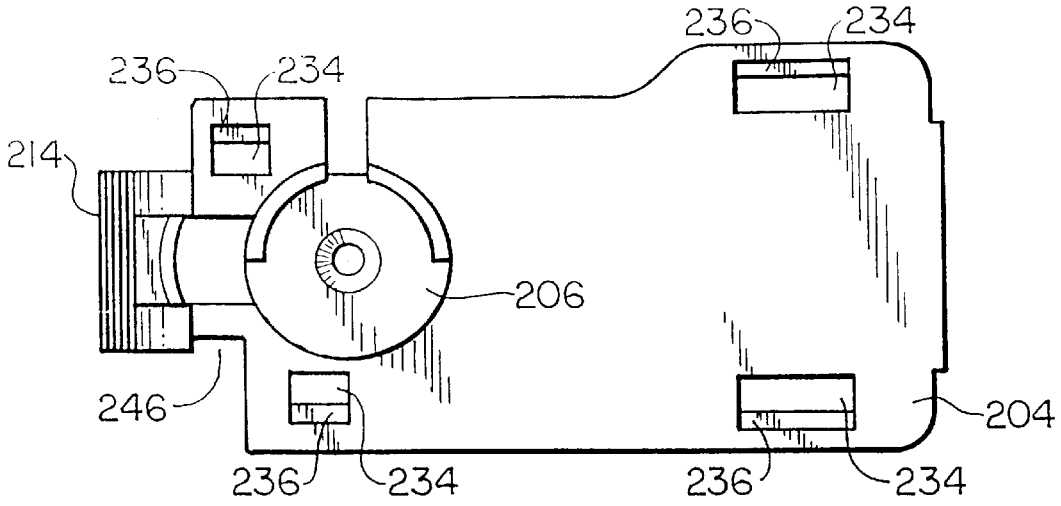
FIG. 34 is a bottom view of the housing of FIG. 31.
Figure 35:
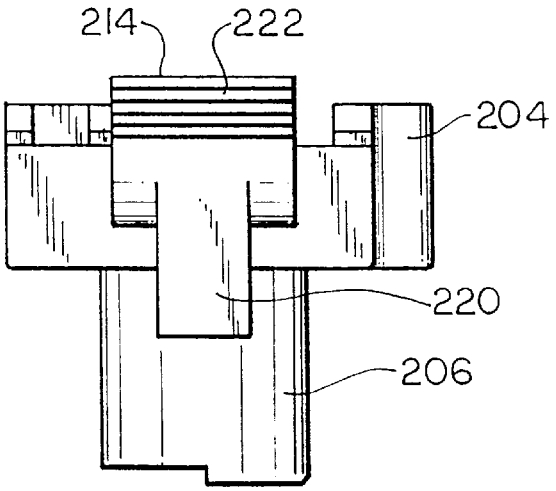
FIG. 35 is an end view of the housing of FIG. 31.
Figure 36:
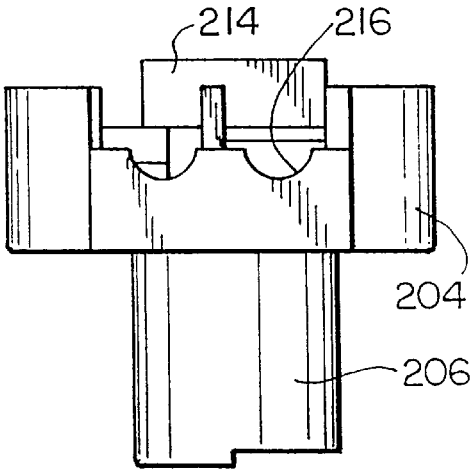
FIG. 36 is a further end view of the housing of FIG. 31.
Figure 37:
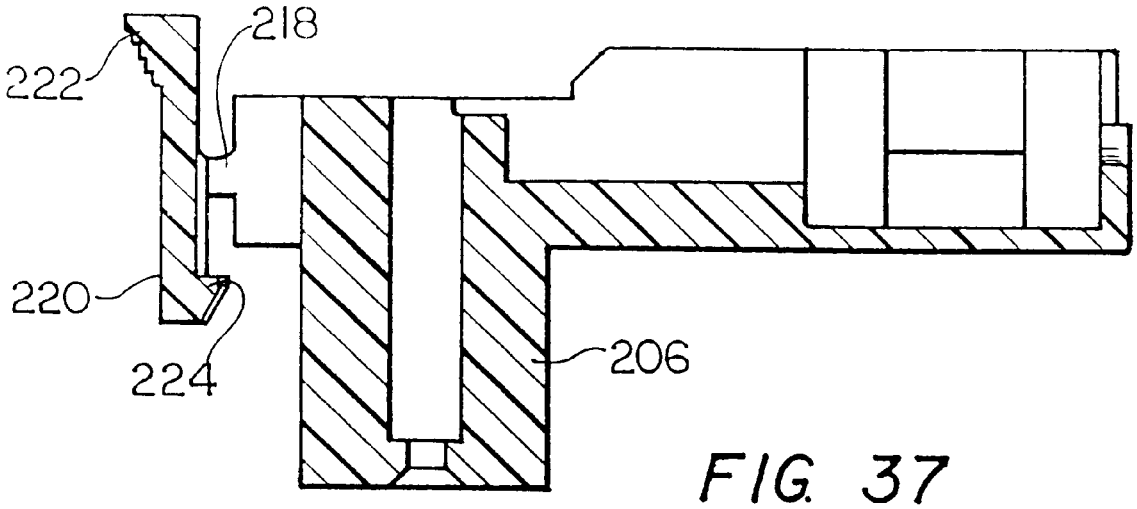
FIG. 37 is a cross sectional view along line F—F of FIG. 32.
Figure 38:
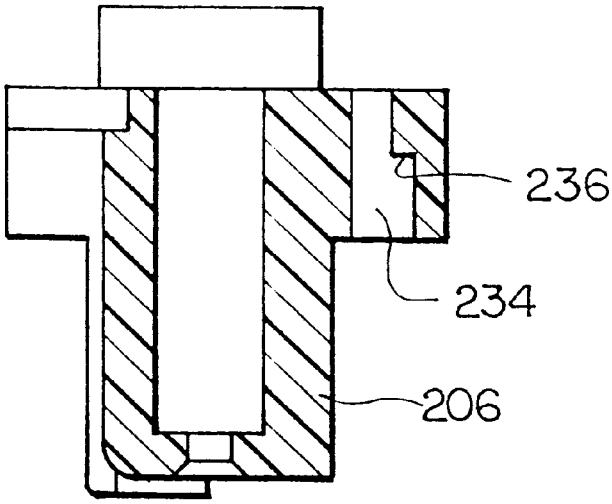
FIG. 38 is a cross sectional view along line G—G of FIG. 32.
Figure 39:
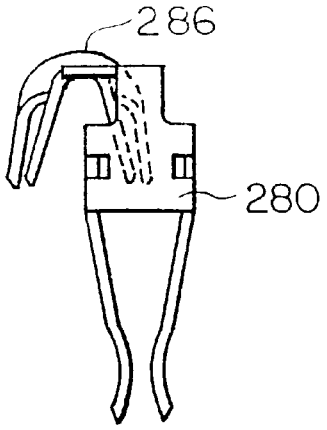
FIG. 39 is an end view of a female terminal of the connector of FIG. 19.
Figure 40:
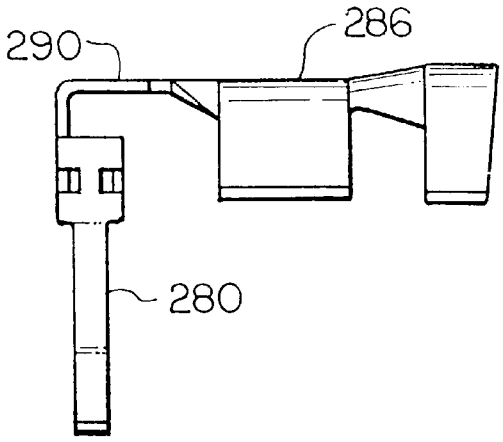
FIG. 40 is a side view of the female terminal of FIG. 39.
Figure 41:
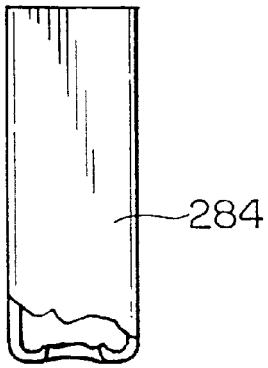
FIGS. 41 and 42 are partially cut away side views of a hood for use with the female terminal of FIG. 39.
Figure 42:
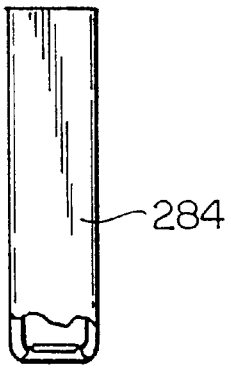
Figure 43:
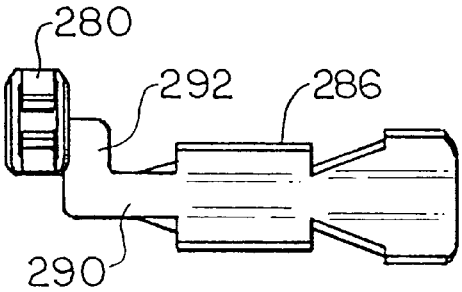
FIG. 43 is a top plan view of the female terminal of FIG. 39.
Figure 44:
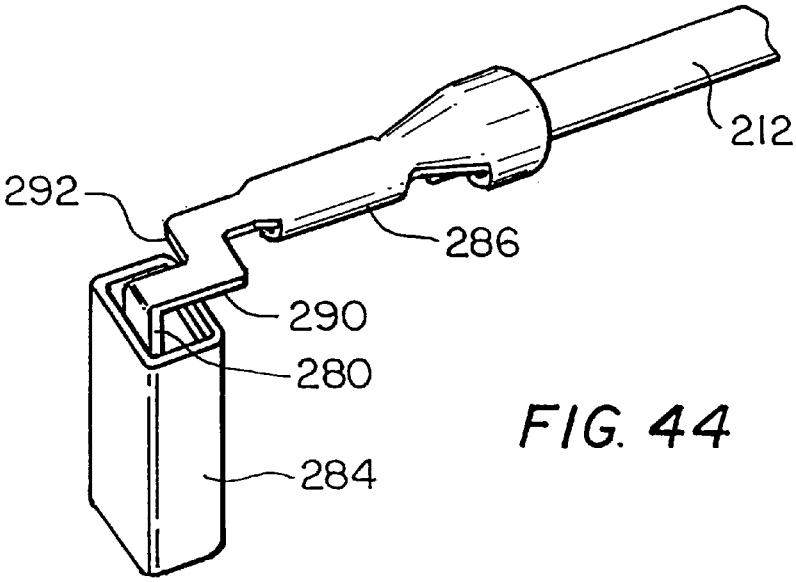
FIG. 44 is an isometric view of the female terminal of FIG. 39 with the hood and a wire attached.
Figure 45:
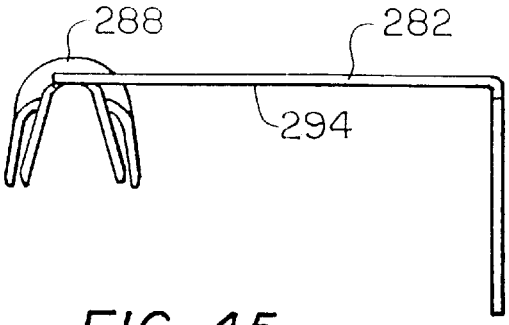
FIG. 45 is a side view of a ground terminal of the connector of FIG. 19.
Figure 46:
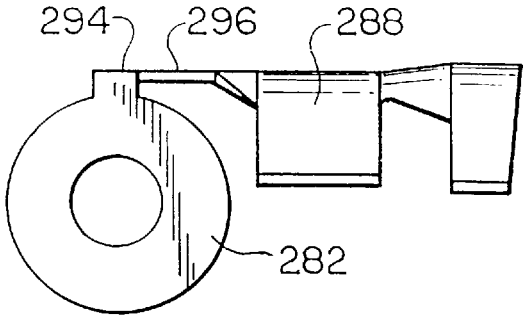
FIG. 46 is a plan view of the ground terminal of FIG. 45.
Figure 47:
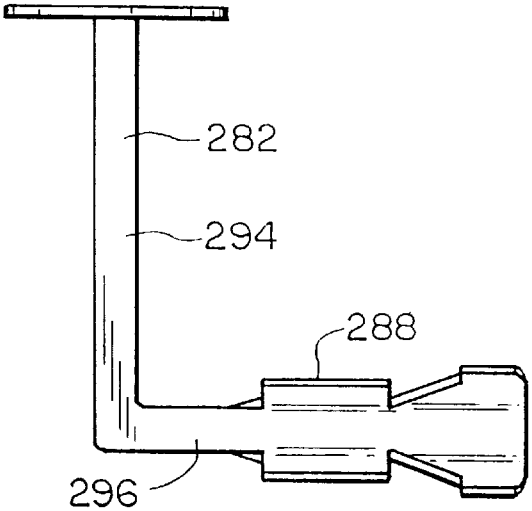
FIG. 47 is a further side view of the ground terminal of FIG. 45.
Figure 48:
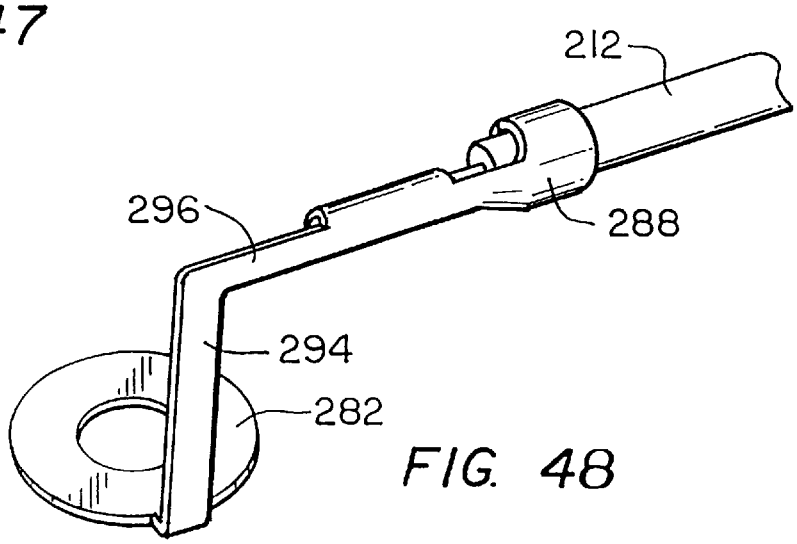
FIG. 48 is an isometric view of the ground terminal of FIG. 45 with a wire attached.
Figure 49:
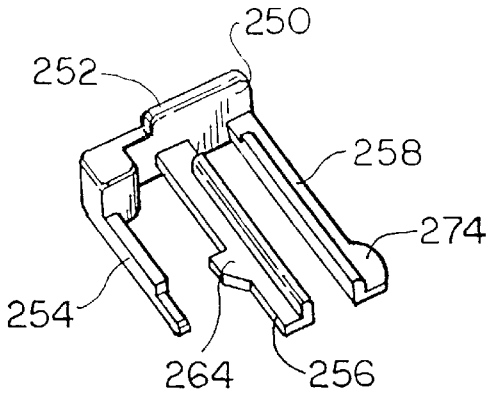
FIG. 49 is an isometric view of a CPA of the connector of FIG. 19.
Figure 50:
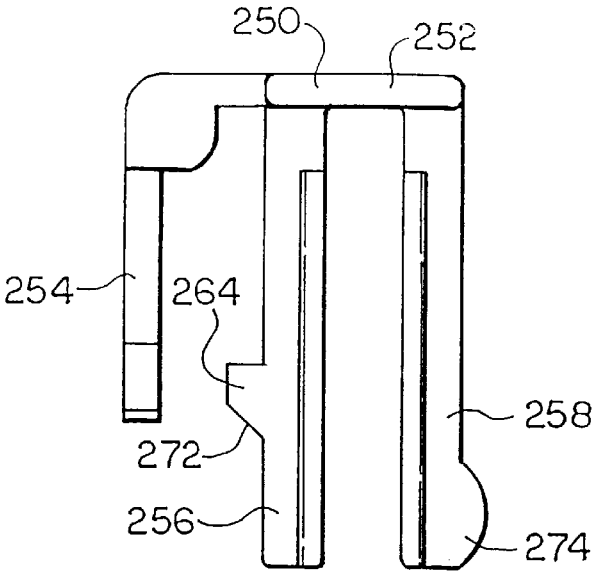
FIG. 50 is a top plan view of the CPA of FIG. 49.
Figure 51:
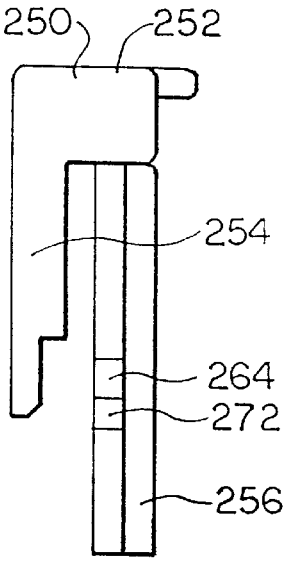
FIGS. 51 and 52 are side views of the CPA of FIG. 49.
Figure 52:
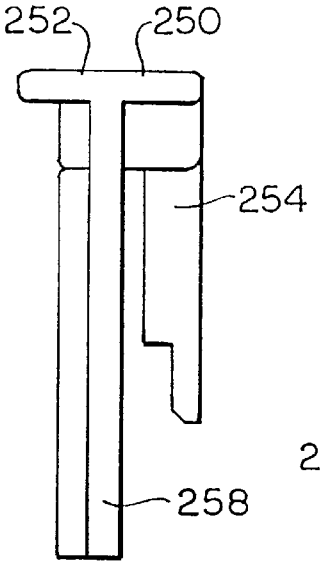
Figure 53:
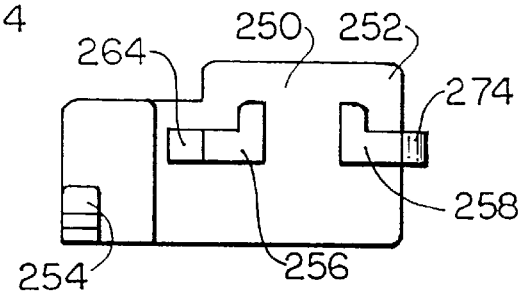
FIG. 53 is an end view of the CPA of FIG. 49.

Referring to FIG. 20, a flexible beam 238 is formed by a slit 240 placed in the rearward edge of the cover 228, opposite the wire entrance area 216. A downward catch 242 is formed on the end of the flexible beam. A downwardly extending post 244 is provided on the underside of the flexible beam. The connector body includes a recess 246 in a rearward region opposite the wire entrance area. When the cover is latched to the body, the downwardly extending post on the cover fits within this recess. Referring to FIG. 22, when the connector is inserted into the socket, a bottom of the post abuts against the top edge of the socket, thereby pivoting the flexible beam upwardly for a purpose discussed further below.

A CPA 250 is slidable between open and closed positions with respect to the cover and the connector body. The CPA includes a shell 252 and an arm 254 extending outwardly from the shell to fit between the latching arm 214 and the side of the connector body above the hinge member 218. The CPA also includes a pair of sliders 256, 258 which slide within respective slots 260, 262 in the top of the cover. One slider includes a protrusion 264 extending therefrom at an intermediate position which fits an opening 266 formed adjacent the slot in the cover. The protrusion abuts against stops 268, 270 (see FIGS. 21 and 25) at the ends of the opening to limit the travel of the CPA between the open and closed positions and prevent the CPA, once installed, from being removed from the cover. One face 272 of the protrusion is angled to ease installation of the CPA into the cover. The other slider 258 also includes a protrusion 274 extending from an end. Two detents 276, 278 are provided in the associated slot of the cover for receiving the protrusion when the CPA is in the closed or open positions. A rounded configuration to the protrusion and ramped or curved faces of the detents ease sliding of the protrusion into and out of the detents. Gentle snapping of the protrusion into the closed position detent 276 provides a tactile signal indicating that the CPA is in the closed position. The protrusion can be moved out of the closed position detent 276 by pulling firmly on the CPA and out of the open position detent 278 by pushing firmly on the CPA.

When the connector 202 is not inserted in a socket, the catch 242 of the flexible beam 238 on the cover 228 prevents the CPA 250 from being pushed all the way into the closed position. When the connector is inserted into the socket, the depending post 244 on the flexible beam abuts the socket, thereby pivoting the beam 238 upwardly and moving the catch 242 out of the way of the CPA 250 and allowing the CPA to slide inwardly to the closed position Thus, the CPA cannot slide in to the closed position unless the flexible beam is pivoted upwardly, and the flexible beam cannot be pivoted upwardly unless the connector is properly seated in the socket with the post abutting the top edge of the socket. In this manner, the CPA in the closed position provides an assurance that the connector has been properly inserted in the socket.

Additionally, when the CPA 250 is in the closed position, the arm 254 of the CPA fits between the upwardly extending portion 222 of the latching arm 214 of the connector body 204, preventing the upwardly extending portion 222 from being pivoted toward the wire entrance area 216 to unlatch the latching arm. In this manner, the CPA in the closed position prevents the connector body from being removed from the socket.

A female terminal 280 with hood 284 and ground terminal 282 are provided which are similar to the terminals 64, 66 respectively described above. Each terminal has an associated wire crimping portion 286, 288. A connecting portion 290 with an offset 292 is provided between the female terminal 280 and its wire crimping portion 286. In assembly, the connecting portion is bent approximately 90° downwardly. The ground terminal 282 includes a depending leg 294 which is also connected to its wire crimping portion 288 at an approximate 90° angle by a connecting portion 296.

In assembly, the two wires 212 are crimped onto the wire crimping portions of the female terminal 280 with the hood and onto the ground terminal 282. The female terminal is bent approximately 90° downwardly at the juncture with the connecting portion. The ground terminal depending leg 294 is bowed outwardly for spring assembly to the connector body. The free ends of the wires are fed through holes in a ferrite block 295. The female terminal with the hood is installed into the center opening 298 of the connector body and its wire crimping device is installed into an associated crimp recess 301 of the body. The ground terminal wire crimping device is installed into an associated crimp recess 302 and pivoted downwardly with the depending leg in the slot 304 of the body, and the contact ring is sprung onto the bottom of the body. Alternatively, barbs 418 that bite into the lower face of the connector body could be provided on the ground terminal, as discussed above with reference to FIG. 94. Other ways of fastening the terminal could be used, such as sonic welding. The ferrite block 295 is located in its associated recess 306 of the body. The cover is snapped onto the housing. The CPA is snapped into the cover horizontal slot. The finished assembly is checked for electrical continuity.

A further embodiment of the squib connector assembly of the present invention is shown in FIGS. 55–78. In this embodiment, the socket 324 includes an initiator pin 326 and ground plate 328 anchored to the cup 330. The ground plate includes an annular base plate, and the contact beam comprises an inner ring 334 formed within the annular base plate and attached to the base plate by a flexible hinge element 336. The inner ring is bent to be biassed slightly upwardly from the plane of the annular base plate to provide a shunt to the initiator pin when the connector is not present in the socket.

Figure 79:
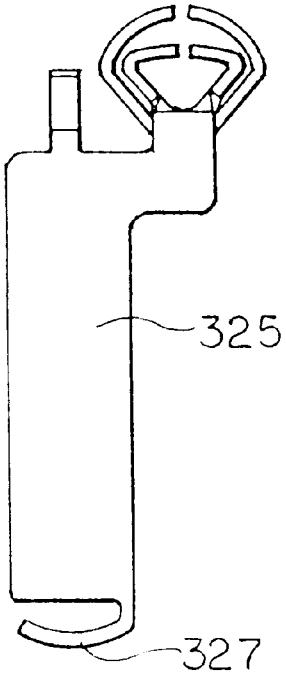
FIG. 79 is a front view of a further embodiment of a male terminal of the squib connector assembly of FIG. 55.
Figure 80:
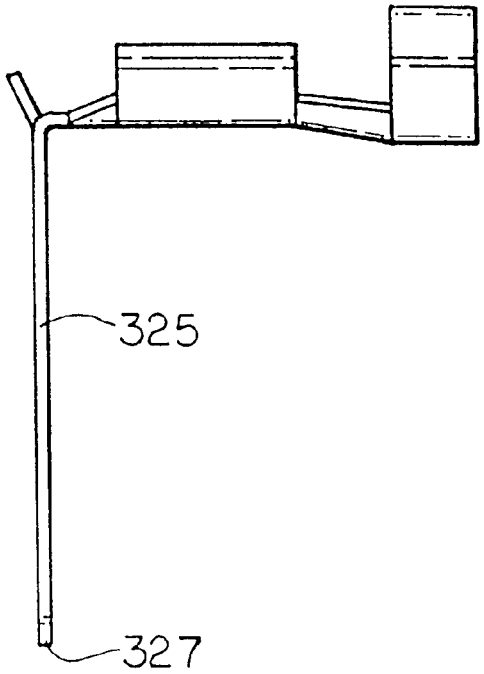
FIG. 80 is a side view of the male terminal of FIG. 79.

The assembly comprises a connector 312 having a female terminal 314 and a ground terminal 316. The connector includes a connector body 318, cover 320, and CPA 322. The female terminal 314 in the connector body comprises two opposed beams 315 which are sized and spaced to contact the initiator pin, as discussed above. The ground terminal 316 comprises a series of depending beams 321 which contacts the ground plate at the tip 323. The beams are formed with a serpentine shape to give the beam resilience and ensure a good contact between the beam and the ground plate with a minimum of downward contact force being applied to the beam. In a further alternative embodiment shown in FIGS. 79 and 80, the depending beam may be a solid member 325 with a hook 327 at the tip, to provide resilience at least at that location. In either embodiment, the bottom, contacting surface of the beam is preferably plated with a suitable conducting material to ensure good contact with the grounding plate.

The connecting member 329 between the ground terminal 316 and its associated wire crimping device 331 includes an offset 333 connecting with the depending beam. The connecting member and offset are configured to align the depending beam 321 generally along a radial line with the opposed contact beams 315 of the female terminal 314.

Primary and secondary terminal latching are provided to ensure that the terminals in the connector cannot accidentally be pulled out of the connector. Primary latching is provided by an upwardly extending and outwardly angled first tab 335 on the box-shaped portion 337 of the first terminal 314 (see FIG. 75) which abuts against a downwardly facing first shoulder formed within the connector body. In assembly of the connector, the first terminal is pressed into the depending cylindrical portion until the first tab catches under the first shoulder, thereby fixedly retaining the first terminal within the connector body. The second terminal similarly includes an upwardly extending and outwardly angled second tab 339 (see FIG. 77) which abuts against a corresponding downwardly facing second shoulder formed within the connector body. In assembly, the second terminal is also pressed into the depending cylindrical portion until the second tab catches under the second shoulder, thereby fixedly retaining the second terminal within the connector body.

Secondary terminal latching is provided by a first member 342 depending from the underside of the cover to abut against the top of the box terminal. Similarly, a second member 344 depends from the underside of the cover to abut against the second terminal at a location slightly in advance of the wire grip of the wire crimping device. Additional security is provided by the rectangular members 346 formed on the underside of the cover which abut against the wire crimping devices.

The depending cylindrical portion 350 of the connector body includes a central opening 352 aligned with the opposed contact beams of the female terminal and a radially offset second opening 354 through which the tip of the ground terminal 316 extends. The central opening 352 fits around and over the initiator pin 326. A chamfer may be provided about the edge of the central opening.

The connector housing includes two latching arms 360 which extend from each side of the connector body and include lips 362 which engage with the lip 48 on the socket housing. Each latching arm is similar to the latching arm discussed above. To remove the connector from the socket, the upwardly extending portions of both latching arms are squeezed inwardly towards each other to pivot about hinges 380.

The cover 320 (see FIGS. 55 and 64 through 68), which is fixedly retained on the connector body, as discussed above, includes a flexible beam 364 formed by two parallel slits 366 placed in the rearward edge of the cover, opposite the wire entrance area. As with the cover discussed above, a downward catch 368 is formed on the end of the flexible beam, and a downwardly extending post 370 is provided on the underside of the flexible beam to fit within a recess 372 in the connector body. When the connector is inserted into the socket, the bottom of the post abuts against the top edge of the socket, thereby pivoting the flexible beam upwardly.

The CPA 322 includes a shell portion 374 which fits around the rearward edge of the cover and the rearward region of the connector body. Two arms 376 having protrusions 378 on their ends extend outwardly from the shell and fit between the latching arms 360 and sides of the connector body above the hinges 380. The CPA is slidable between open and closed positions. Stops 382 on the connector body abut the protrusions when in the open position to prevent removal of the CPA from the connector body and the cover. During assembly, the protrusions are slid over the stops. Detents 384 are also provided on the connector body for receiving the protrusions when the CPA is slid into the closed position. As discussed above, the CPA cannot be moved into the closed position unless the connector body is properly inserted into the socket, thereby pivoting the flexible beam upwardly.

Additionally, when the CPA is in the closed position, the shell of the CPA fits between the upwardly extending portions of the latching arms of the connector body, preventing the upwardly extending portions from being pivoted inwardly toward each other. In this manner, the CPA in the closed position prevents the connector body from being removed from the socket.

Figure 81:
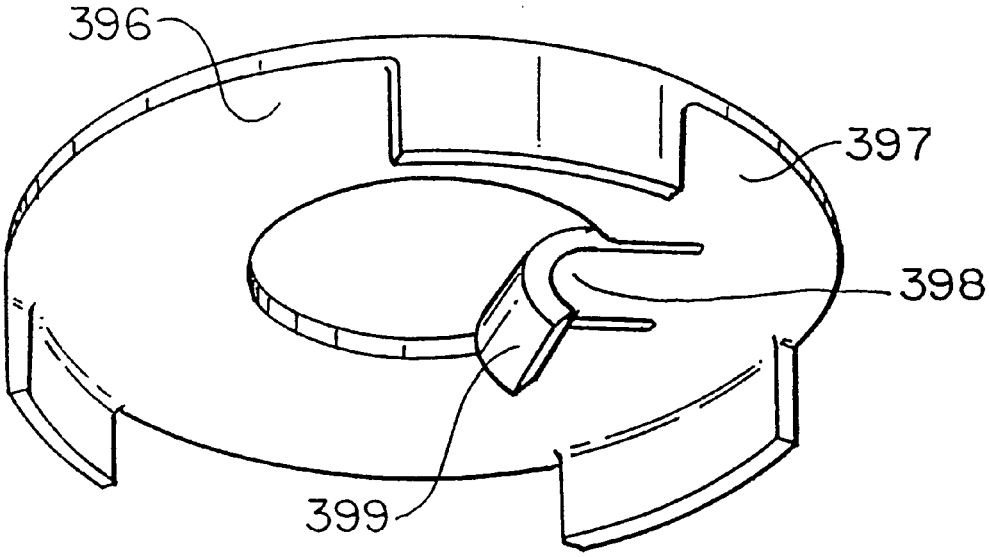
FIG. 81 is a further embodiment of a ground plate for use with the squib assembly of FIG. 55.

A further embodiment of the ground plate in the socket is shown in FIG. 81. The ground plate 396 includes an annular base plate 397 and a contact beam which is a resilient beam 398 which extends radially inwardly to contact the initiator pin. The tip or free end 340 of the contact beam is bent slightly downwardly. A conductive stripe may be plated onto the tip 399 of the beam where it contacts the initiator pin to ensure good electrical contact. The cylindrical portion of the connector body is formed such that when fully inserted it extends slightly below the plane of the base plate to push the resilient beam out of contact with the pin.

In a further alternative embodiment, the ferrite or other inductive body is molded onto the positive wire at a selected location just outside the connector to prevent stray EMI/RFI signals from affecting the squib. By locating the ferrite body outside the connector on the wire, the ferrite body can be placed in an optimum location. This location can be determined by EMI/RFI testing in a suitable facility. An additional advantage of placing the ferrite body outside the connector is that the size of the connector can be further minimized.

Figure 82:
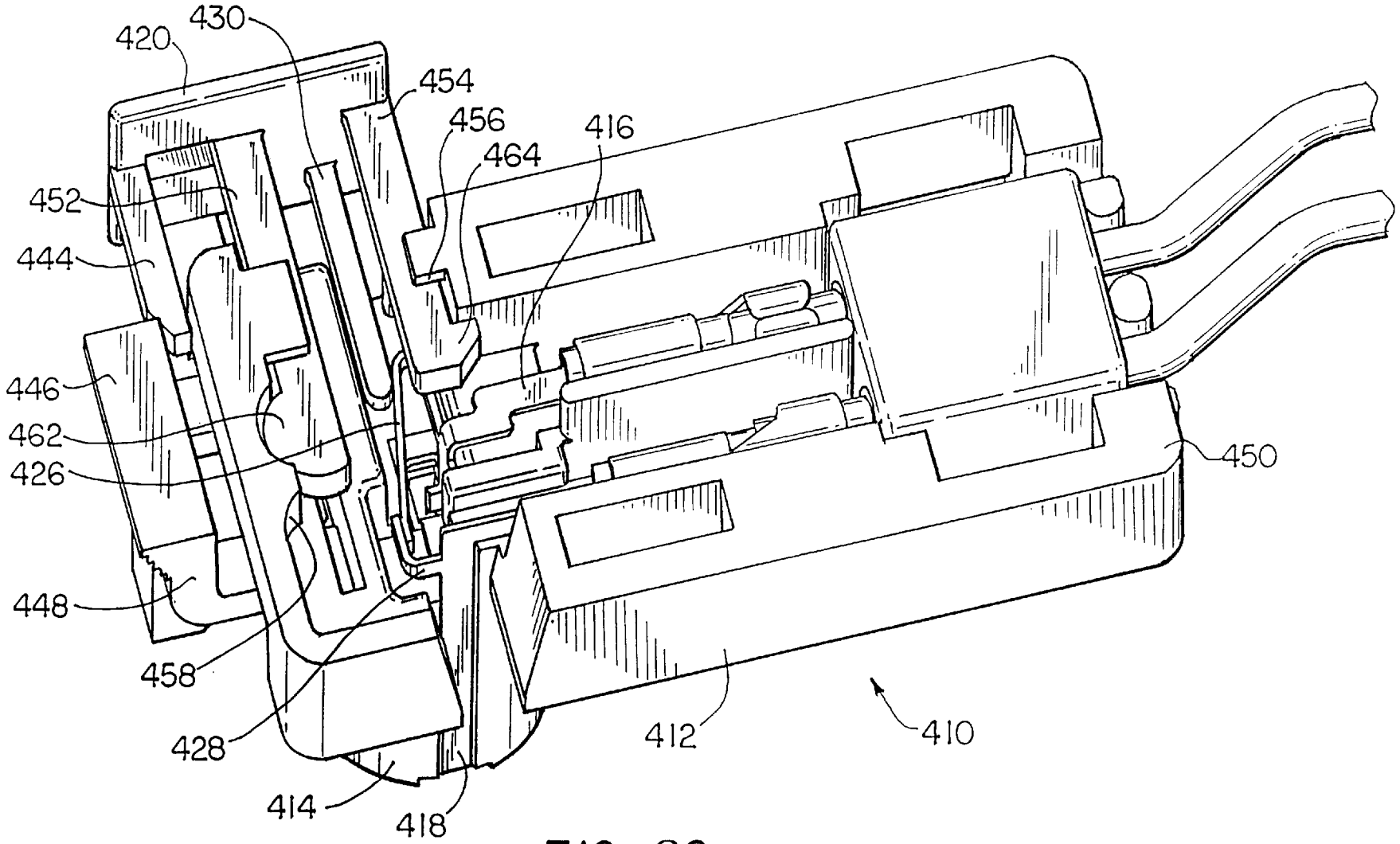
FIG. 82 is an isometric view of a further embodiment of a squib connector according to the present invention.
Figure 83:
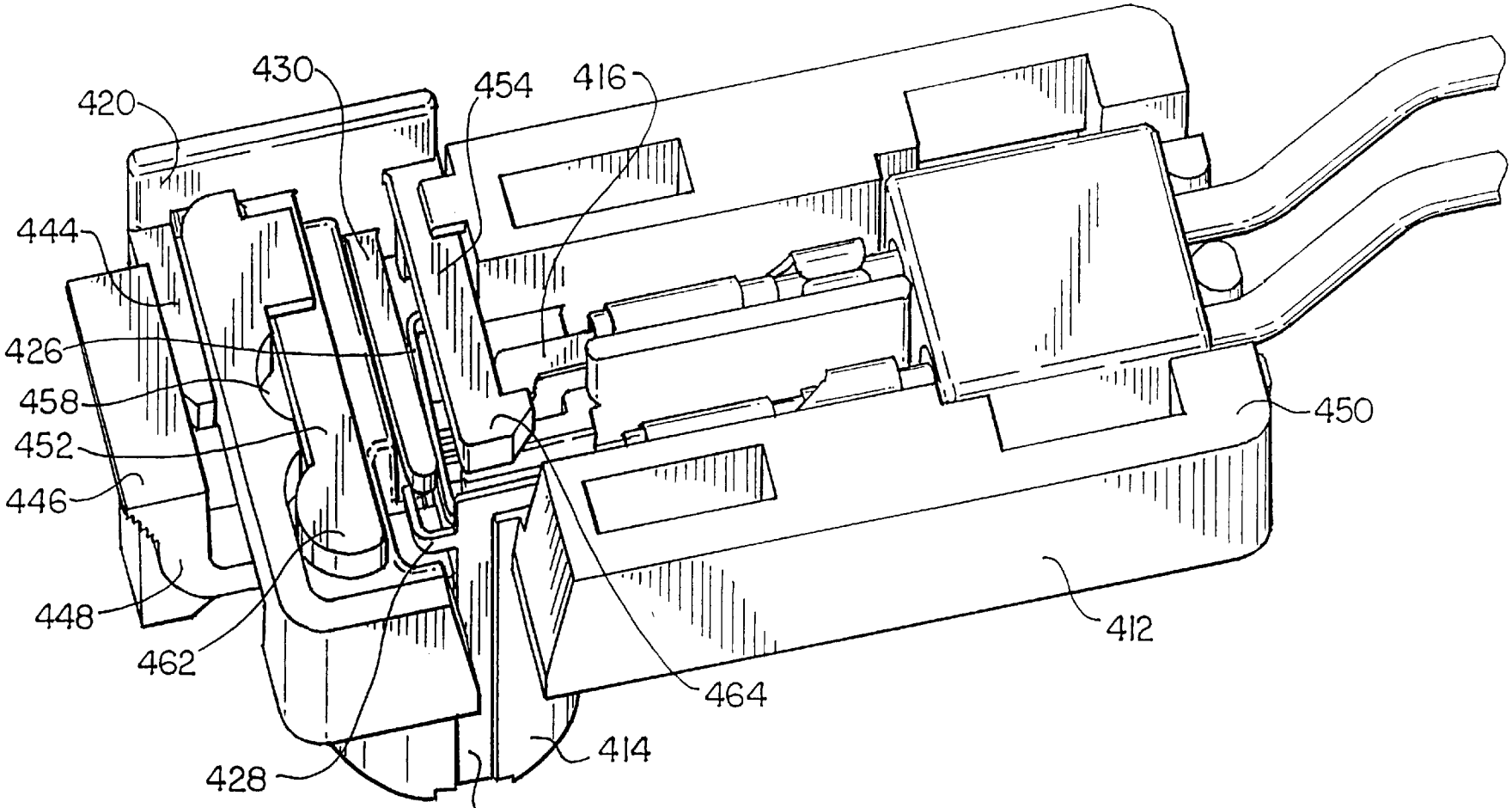
FIG. 83 is a further isometric view of the squib connector of FIG. 82.
Figure 87:
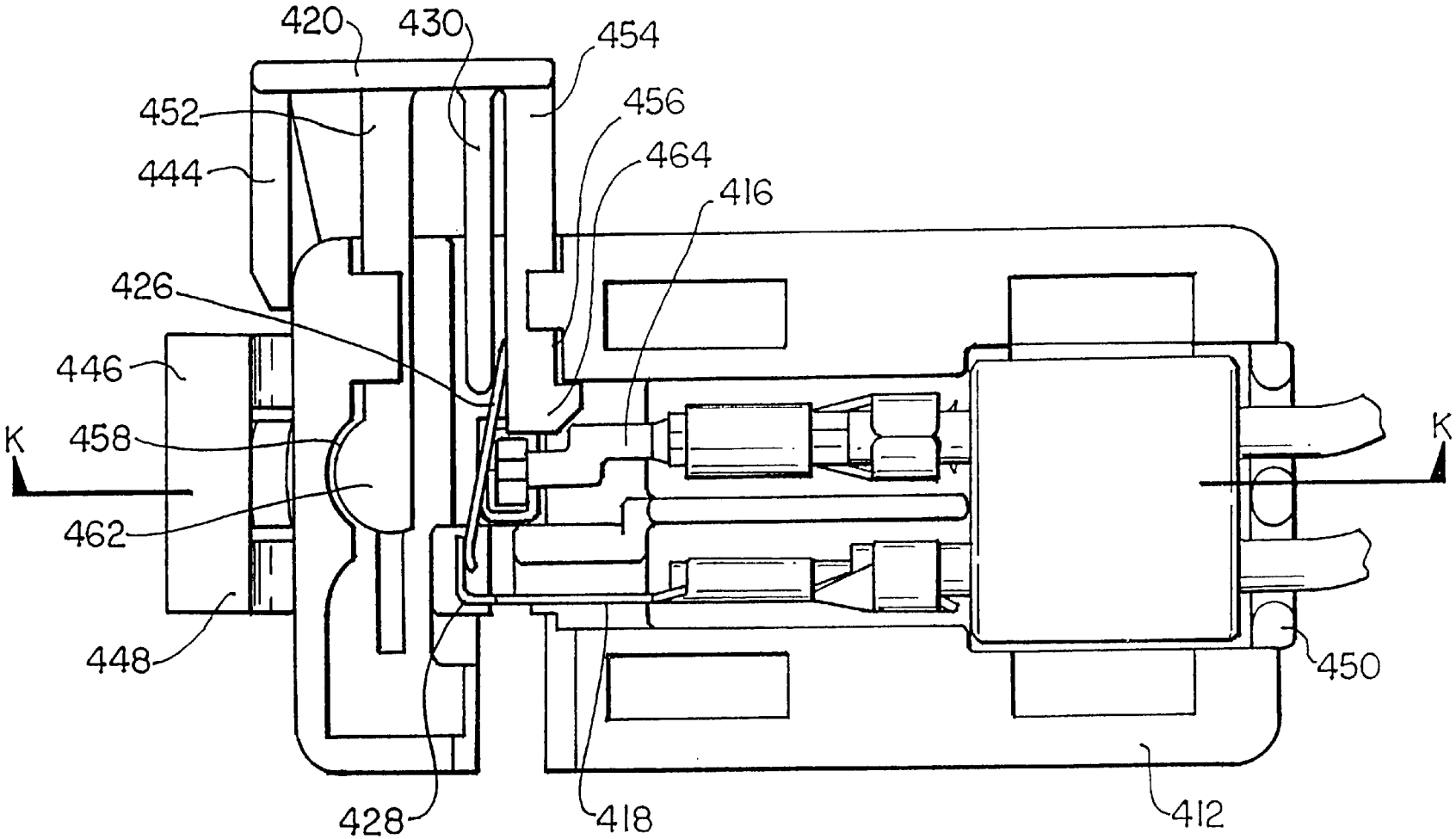
FIG. 87 is a top plan view of the connector of FIG. 82.
Figure 93:
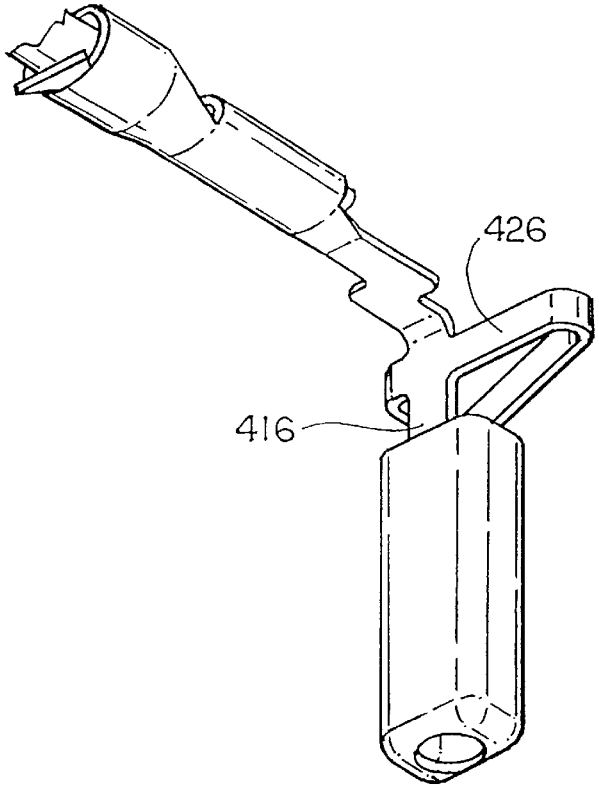
FIG. 93 is an isometric view of a female terminal of the connector of FIG. 82.

FIGS. 82–94 illustrate a further embodiment of a connector in which the wires enter the connector at approximately 90° to the terminals. As with the embodiments discussed above, the connector assembly 410 includes a connector body or housing 412 with a depending cylindrical portion 414 and a pair of terminals 416, 418 therein, a connector position assurance member or CPA 420, and a cover 422. The female terminal 416 includes a spring member 426 having a hairpin shape (see FIG. 93) biassed to contact a tab 428 on the ground terminal 418 when the CPA 420 is not fully engaged in the closed position in the connector body 412 (see FIGS. 82 and 87). The CPA 420 includes an arm 430 which pushes the spring member 426 away from the tab 428 when the CPA is in the closed position in the connector body (see FIG. 83). In this way, when the CPA is in the open position (see FIGS. 82 and 87), the terminals 416, 418 are shorted by electrical contact between the spring member 426 and the tab 428. Thus, electronic diagnostic testing can be performed during assembly to determine if a short circuit exists, rather than relying upon a visual inspection to see if the CPA is fully engaged in the closed position.

In this embodiment, the CPA also includes a cam arm 434 having a protrusion 436 which abuts against a stop 438 on the connector body 412 when the connector is not inserted into a squib socket, preventing the CPA from being pushed into the closed position with respect to the connector. The cam arm also includes a cam portion 440 depending from the arm 434. When the connector body is inserted into the squib socket, the top edge 245 of the socket (see FIG. 22) contacts the cam portion 440 of the cam arm, pushing the cam arm up and moving the protrusion 436 out of abutment with the stop 438 on the housing. Once the protrusion no longer abuts against the stop, the CPA can be pushed into the closed position in the connector body.

The CPA 420 includes an arm 444 which fits between the upwardly extending portion 446 of the latching arm 448 of the connector body, preventing the upwardly extending portion from being pivoted toward the wire entrance area 450 to unlatch the latching arm, as indicated with reference to the embodiments discussed above. In this manner, the CPA in the closed position prevents the connector body from being removed from the socket. Also, the CPA includes a pair of sliders 452, 454 which slide within respective slots 456, 458 within the connector body. Protrusions 462, 464 on the sliders abut against faces on the connector body to limit travel of the CPA between the open and closed positions and prevent the CPA, once installed, from being fully removed from the cover.

Figure 95:
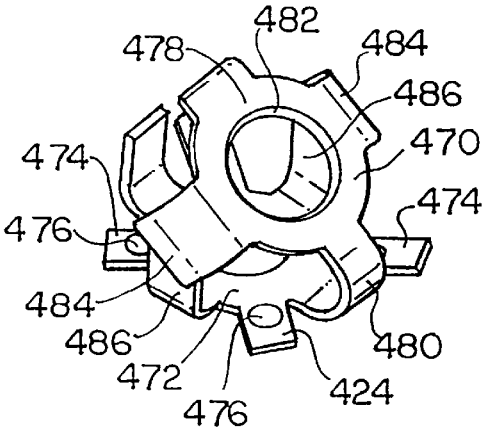
FIG. 95 is an isometric view of a further embodiment of a ground plate according to the present invention.
Figure 96:
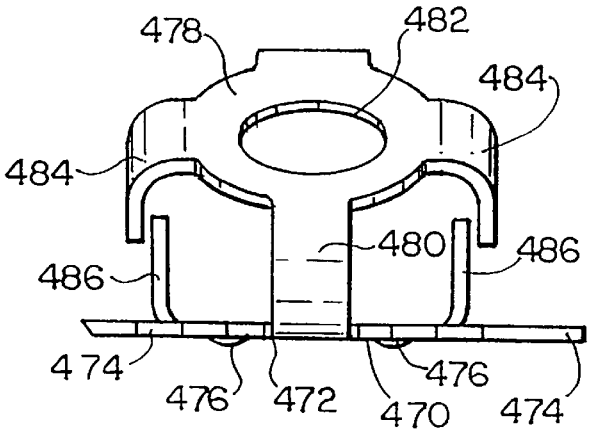
FIG. 96 is a side view of the ground plate of FIG. 95.

A further embodiment of a ground plate 470 within the socket is shown with reference to FIGS. 95–96. In this embodiment, the ground plate 470 includes a base plate 472 having flat anchor tabs 474 for attachment to the initiator cup by a suitable welding process. Protrusions 476 may be formed on the anchor tabs to assist in the welding process. The ground plate also includes an upwardly biassed contact or shorting member 478 formed as a beam connected to the base plate by a flexible hinge element 480. The contact beam includes a central opening 482 formed therein through which the initiator pin 24 extends. A pair of downwardly depending alignment tabs 484 extend from opposite sides of the contact beam 478 and a corresponding pair of upwardly extending alignment tabs 486 rise from the base plate 472. The upwardly extending tabs 486 are spaced to fit within and between the downwardly depending tabs 484. In this manner, when the contact beam 478 is pushed downwardly out of contact with the initiator pin 24, the upwardly extending tabs 486 are able to abut against the downwardly depending tabs 484 to limit side to side motion of the contact beam and resultant inadvertent contact between the initiator pin and the opening 482 within the contact beam.

The invention is not to be limited by what has been particularly shown and described, except as indicated by the appended claims.

We claim:

1. An orientationless squib connector assembly for an automotive air bag assembly, the squib connector assembly comprising:

a socket comprising a cylindrical inner wall, defining a central axis, and a bottom surface, a first electrically conductive terminal extending axially along the central axis, and a second electrically conductive terminal comprising an electrically conductive plate having a centrally located opening therein, the plate sized and configured to fit within the socket with the centrally located opening coaxially disposed about and spaced from the first electrically conductive terminal, and a shorting member connected to the plate by a flexible hinge member and extending radially inwardly toward the centrally located opening within the socket with respect to the central axis and biassed into electrical contact with the first electrically conductive terminal when no external force is applied to the shorting member; and a connector comprising a connector body having a cylindrical portion sized to fit in mating engagement within the cylindrical inner wall of the socket, a third electrically conductive terminal centrally located within the cylindrical portion and configured to electrically contact the first electrically conductive terminal when the connector is inserted in the socket, and a fourth electrically conductive terminal having a depending member located within the cylindrical portion radially displaced from the third electrically conductive terminal and having a contacting surface disposed to contact the second electrically conductive terminal and displace the shorting member from electrical contact with the first electrically conductive terminal at any angular orientation about the central axis of the connector with respect to the socket when the connector is inserted in the socket.

2. The orientationless squib connector assembly of claim 1, wherein the socket further comprises a cylindrical outer wall having a circumferential groove formed therein, and the connector includes a latching mechanism comprising a lip configured to fit within the groove at any radial location about the circumference of the socket.

3. The orientationless squib connector assembly of claim 2, wherein the latching mechanism comprises a latching arm connected at a hinge to the connector body, the latching arm including a downwardly extending portion, the lip inwardly extending from a free end thereof.

4. The orientationless squib connector assembly of claim 3, wherein the latching arm further includes an upwardly extending portion, the hinge comprising a pivot point such that movement of the upwardly extending portion inwardly causes the downwardly extending portion to move outwardly, thereby disengaging the lip from the groove in the socket.

5. The orientationless squib connector assembly of claim 4, further comprising a connector position assurance member movable between a closed position between the upwardly extending portion and the connector body in which inward motion of the upwardly extending portion is prevented, and an open position in which inward motion of the upwardly extending portion is possible.

6. The orientationless squib connector assembly of claim 5, wherein:

the socket further comprises a top edge;

the connector comprises an abutment face on a lower surface thereof; and and the connector position assurance member includes a cam arm having a cam surface thereon, the cam arm disposed to abut against the abutment face in an open position, the cam surface disposed to contact the top edge of the socket to displace the cam arm from abutment with the abutment face upon insertion of the connector in the socket.

7. The orientationless squib connector assembly of claim 1, further comprising wire grips electrically connected to the third and fourth electrically conductive terminals and axially aligned with respect to the central axis.

8. The orientationless squib connector assembly of claim 1, further comprising wires connected to the third and fourth electrically conductive terminals in the connector, and an inductive body disposed about the wire connected to the third terminal at a location outside of the connector predetermined to minimize effects of stray signals on the squib connector assembly.

9. The orientationless squib connector assembly of claim 1, further comprising a shorting member biassed into electrical contact between the third electrically conductive terminal and the fourth electrically conductive terminal, and a member disposed for movement between an open position and a closed position on the connector, the member disposed in the closed position to displace the shorting member from of electrical contact between the third electrically conductive member and the fourth electrically conductive member.

10. An orientationless squib connector assembly for an automotive air bag assembly, the squib connector assembly comprising:

a socket comprising a cylindrical inner wall, defining a central axis, and a bottom surface, and a top edge, a first electrically conductive terminal extending axially along the central axis, and a second electrically conductive terminal comprising a shorting member extending radially within the socket with respect to the central axis and biassed into electrical contact with the first electrically conductive terminal when no external force is applied to the shorting member; and a connector comprising a connector body having a cylindrical portion sized to fit in mating engagement within the cylindrical inner wall of the socket, a third electrically conductive terminal centrally located within the cylindrical portion and configured to electrically contact the first electrically conductive terminal when the connector is inserted in the socket, and a fourth electrically conductive terminal having a depending member located within the cylindrical portion radially displaced from the third electrically conductive terminal and having a contacting surface disposed to contact the second electrically conductive terminal and displace the shorting member from electrical contact with the first electrically conductive terminal at any angular orientation about the central axis of the connector with respect to the socket when the connector is inserted in the socket, the connector further comprising a flexible cantilever beam having a catch on a free end thereof, and a post depending from the flexible beam, the post sized and configured to abut the top edge of the socket when the connector is inserted into the socket to move the flexible beam and the catch upwardly.

11. The orientationless squib connector assembly of claim 10, further comprising a connector position assurance member mounted on the connector body for movement between an open position and a closed position, the connector position assurance member disposed to abut against the catch of the flexible beam when in the open position and to bypass the catch of the flexible beam to move to the closed position when the flexible beam and the catch are moved upwardly.

12. An orientationless squib connector assembly for an automotive air bag assembly, the squib connector assembly comprising:

a socket comprising a cylindrical inner wall, defining a central axis, and a bottom surface, a first electrically conductive terminal extending axially along the central axis, and a second electrically conductive terminal comprising a shorting member extending radially within the socket with respect to the central axis and biassed into electrical contact with the first electrically conductive terminal when no external force is applied to the shorting member; and a connector comprising a connector body having a cylindrical portion sized to fit in mating engagement within the cylindrical inner wall of the socket, a third electrically conductive terminal centrally located within the cylindrical portion and configured to electrically contact the first electrically conductive terminal when the connector is inserted in the socket, and a fourth electrically conductive terminal having a depending member located within the cylindrical portion radially displaced from the third electrically conductive terminal and having a contacting surface disposed to contact the second electrically conductive terminal and displace the shorting member from electrical contact with the first electrically conductive terminal at any angular orientation about the central axis of the connector with respect to the socket when the connector is inserted in the socket; and wherein the second electrically conductive terminal comprises a ground plate and the shorting member comprises a beam including a ring portion surrounding the first electrically conductive terminal and connected to the ground plate by a flexible member, the flexible member bent upwardly sufficiently such that an inner edge of the ring portion contacts the first electrically conductive terminal when no external force is applied to the shorting member.

13. The orientationless squib connector assembly of claim 12, wherein the beam includes a tip extending from the ring portion and disposed to contact the fourth electrically conductive terminal and wherein the contacting surface of the fourth electrically conductive terminal comprises an annular member disposed to abut against the tip of the beam when the connector is inserted in the socket.

14. The orientationless squib connector assembly of claim 12, wherein the ground plate includes an annular contact area and wherein the flexible member of the beam connects the beam to the ground plate at a location interior of the annular contact area, and wherein the contacting surface of the fourth electrically conductive terminal comprises a tip of the depending member.

15. An orientationless squib connector assembly for an automotive air bag assembly, the squib connector assembly comprising:

a socket comprising a cylindrical inner wall, defining a central axis, and a bottom surface, a first electrically conductive terminal extending axially along the central axis, and a second electrically conductive terminal comprising a ground plate and a shorting member comprising a beam extending radially inwardly from the ground plate within the socket with respect to the central axis and biassed into electrical contact with the first electrically conductive terminal at a free end of the beam when no external force is applied to the shorting member; and a connector comprising a connector body having a cylindrical portion sized to fit in mating engagement within the cylindrical inner wall of the socket, a third electrically conductive terminal centrally located within the cylindrical portion and configured to electrically contact the first electrically conductive terminal when the connector is inserted in the socket, and a fourth electrically conductive terminal having a depending member located within the cylindrical portion radially displaced from the third electrically conductive terminal and having a contacting surface disposed to contact the second electrically conductive terminal and displace the shorting member from electrical contact with the first electrically conductive terminal at any angular orientation about the central axis of the connector with respect to the socket when the connector is inserted in the socket;

wherein the cylindrical portion of the connector body includes a downwardly disposed face having an opening therein, the opening sized to fit over the first electrically conductive terminal in the socket, the face disposed to contact and move downwardly the shorting member out of electrical contact with the first electrically conductive terminal.

16. An orientationless squib connector socket for an automotive air bag assembly, the squib connector socket comprising:

a cylindrical inner wall, defining a central axis, and a bottom surface;

a first conductive terminal extending from the bottom surface axially along the central axis within the cylindrical inner wall; and a second conductive terminal comprising a shorting member extending radially within the cylindrical inner wall with respect to the central axis and biassed into electrical contact with the first electrically conductive terminal when no external force is applied to the shorting member, the second electrically conductive terminal comprising a ground plate and the shorting member comprising a beam including a ring portion surrounding the first electrically conductive terminal and connected to the ground plate by a flexible member, the flexible member bent upwardly sufficiently such that an inner edge of the ring portion contacts the first electrically conductive terminal when no external force is applied to the shorting member.

17. The orientationless squib connector socket of claim 16, wherein the first conductive terminal comprises an electrically conductive pin.

18. The orientationless squib connector socket of claim 16, wherein the beam includes a tip extending from the ring portion.

19. The orientationless squib connector socket of claim 16, wherein the ground plate includes an annular contact area and wherein the flexible member of the beam connects the beam to the ground plate at a location interior of the annular contact area.

20. The orientationless squib connector socket of claim 16, wherein the second conductive terminal further comprises a plurality of anchor legs depending from the ground plate, the anchor legs fastened to the bottom surface of the socket.

21. The orientationless squib connector socket of claim 20, wherein the anchor legs are welded to the bottom surface of the socket.

22. The orientationless squib connector assembly of claim 16, wherein the second electrically conductive terminal comprises a ground plate and the shorting member comprises a beam extending radially inwardly from the ground plate to contact the first electrically conductive terminal at a free end thereof when no external force is applied to the shorting member.

23. The orientationless squib connector socket of claim 22, wherein the free end of the shorting beam is bent downwardly.

24. The orientationless squib connector socket of claim 16, further comprising a cylindrical outer wall, a circumferential detent provided in the outer wall to receive a latching mechanism in any radial orientation about the circumference of the cylindrical outer wall.

25. The orientationless squib connector socket of claim 16, wherein the cylindrical wall terminates at an upper edge providing an upwardly facing annular surface.

26. The orientationless squib connector socket of claim 16, wherein the beam includes a first pair of side-to-side alignment tabs and the ground plate includes a second pair of side-to-side alignment tabs disposed to surround outer faces of the first pair of side-to-side alignment tabs to minimize sideways movement of the beam.

27. An orientationless squib connector for an automotive air bag assembly, the squib connector comprising:

a connector body having a cylindrical portion, defining a central axis, configured to fit in mating engagement with a squib socket;

a first electrically conductive terminal symmetrically located about the central axis within the cylindrical portion; and a second electrically conductive terminal located within the cylindrical portion radially offset from the first electrically conductive terminal with respect to the central axis and comprising a depending beam extending to a free end and having a downwardly facing contacting surface at the free end.

28. The orientationless squib connector of claim 27, wherein the first conductive terminal comprises a pair of opposed, resilient beams, the beams biassed toward each other.

29. The orientationless squib connector of claim 28, wherein the beams-are convexly curved toward each other.

30. The orientationless squib connector of claim 27, wherein the first terminal includes a box-shaped portion disposed within the connector body, the opposed beams depending from the box-shaped portion.

31. The orientationless squib connector of claim 27, wherein the first terminal further comprises a wire crimping portion and an interconnecting portion integrally formed between the opposed beams and the wire crimping portion, the interconnecting portion including an offset arm, the opposed beams depending from the offset arm symmetrically about the central axis of the connector body.

32. The orientationless squib connector of claim 27, wherein the first terminal includes an outwardly extending member disposed to abut against a shoulder integrally formed within the connector body to retain the first terminal within the connector body.

33. The orientationless squib connector of claim 27, wherein the contacting surface of the second terminal comprises an annular member surrounding the central axis.

34. The orientationless squib connector of claim 27, wherein the depending beam of the second terminal further comprises a resilient portion.

35. The orientationless squib connector of claim 34, wherein the resilient portion comprises a serpentine configuration.

36. The orientationless squib connector of claim 34, wherein the resilient portion comprises a hook configuration at the free end of the depending beam.

37. The orientationless squib connector of claim 27, wherein the second terminal includes an outwardly extending member disposed to abut against a shoulder integrally formed within the connector body to retain the second terminal within the connector body.

38. The orientationless squib connector of claim 27, wherein the second terminal further comprises a wire crimping portion and an interconnecting portion integrally formed between the depending beam and the wire crimping portion, the interconnecting portion including an offset arm, the depending beam depending from the offset arm at a location radially displaced from the central axis of the connector body.

39. The orientationless squib connector of claim 27, further comprising a cover fixed to the connector body, the cover including a flexible cantilever beam having a catch on a free end thereof, a post depending from the flexible beam, the post sized and configured to abut a top edge of the squib socket when the connector is inserted into the squib socket, whereby the flexible beam and the catch are moved upwardly.

40. The orientationless squib connector of claim 39, further comprising a connector position assurance member mounted on the connector body for movement between an open position and a closed position, the connector position assurance member disposed to abut against the catch of the flexible beam when in the open position and to bypass the catch of the flexible beam to move to the closed position when the flexible beam and the catch are moved upwardly.

41. The orientationless squib connector of claim 39, wherein the cover includes a rounded edge adjacent a wire entrance area and the connector body includes a further rounded edge opposite the rounded edge of the cover to provide wire strain relief.

42. The orientationless squib connector of claim 39, wherein the cover includes depending members located to overlie the first conductive terminal and the second conductive terminal.

43. The orientationless squib connector of claim 27, further comprising:

a latching mechanism extending outwardly from the connector body to fit externally about the squib socket and including a latching member matable with a corresponding detent externally provided in the squib socket.

44. The orientationless squib connector of claim 43, wherein the latching mechanism comprises a latching arm connected at a hinge to the connector body, the latching arm including a downwardly extending portion having a tab disposed on an end thereof, the tab configured to fit with the corresponding detent in the squib socket.

45. The orientationless squib connector of claim 44, wherein the downwardly extending portion is curved to conform to an external curved configuration of the socket.

46. The orientationless squib connector of claim 44, wherein the latching arm further includes an upwardly extending portion, the hinge comprising a pivot point such that movement of the upwardly extending portion inwardly causes the downwardly extending portion to move outwardly, thereby disengaging the tab from the detent in the squib socket.

47. The orientationless squib connector of claim 46, further comprising a connector position assurance member movable between a closed position between the upwardly extending portion and the connector body in which inward motion of the upwardly extending portion is prevented, and an open position in which inward motion of the upwardly extending portion is possible.

48. The orientationless squib connector of claim 27, wherein the cylindrical portion of the connector body includes a downwardly disposed face having an opening therein, the opening sized to fit over an initiator pin in the squib socket, the face disposed to contact and move downwardly a shorting member out of electrical contact with the initiator pin.

49. The orientationless squib connector of claim 27, wherein the first terminal includes a wire crimping portion, the wire crimping portion axially aligned with respect to the central axis to receive a wire substantially parallel to the central axis.

50. The orientationless squib connector of claim 33, wherein the annular member includes barb elements for fixing to a bottom face of the cylindrical portion of the connector body.

* * * * *